US008084141B2

(12) United States Patent
Dorsy

(10) Patent No.: US 8,084,141 B2
(45) **Date of Patent: *Dec. 27, 2011**

(54) EXPANDABLE PANEL STRUCTURES AND METHODS OF MANUFACTURING THE SAME

(76) Inventor: Sean C. Dorsy, Miami, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/888,981

(22) Filed: Sep. 23, 2010

(65) Prior Publication Data

US 2011/0011025 A1 Jan. 20, 2011

Related U.S. Application Data

(63) Continuation of application No. 11/826,139, filed on Jul. 12, 2007, now Pat. No. 7,803,467, which is a continuation-in-part of application No. 11/783,238, filed on Apr. 6, 2007, now Pat. No. 7,803,466.

(60) Provisional application No. 60/789,871, filed on Apr. 7, 2006.

(51) Int. Cl.
*B21C 27/00* (2006.01)

(52) U.S. Cl. ..... 428/596; 428/134; 428/131; 428/136; 428/573; 52/635

(58) Field of Classification Search ..... 52/410, 52/412, 222, 204.69, 204.54, 109, 90.1, 670, 52/671, 673, 677, 635, 649.7, 649.8; 135/145; 160/136, 351; 428/573, 596, 597, 601, 134, 428/131, 136, 135

See application file for complete search history.

(56) References Cited

U.S. PATENT DOCUMENTS

| | | | |
|---|---|---|---|
| 429,095 | A | 5/1890 | Livingstone |
| 583,235 | A | 5/1897 | McCormick |
| 777,236 | A | 12/1904 | Acers |
| 834,873 | A | 10/1906 | Curtis |
| 1,506,296 | A | 8/1924 | Forsyth |
| 1,704,608 | A | 3/1929 | Humphris |
| 2,018,085 | A | 10/1935 | Otte |
| 2,105,771 | A | 1/1938 | Holdsworth |
| 2,290,842 | A | 7/1942 | Bush |
| 2,520,664 | A | 8/1950 | Turner |
| 2,639,471 | A | 5/1953 | Neves |
| 2,692,019 | A | 10/1954 | Zalkind |
| 3,256,577 | A | 6/1966 | Granville |
| 3,710,806 | A | 1/1973 | Kelly et al. |
| 3,763,616 | A | 10/1973 | Pastorelli et al. |
| 3,825,465 | A | 7/1974 | Stock |
| 3,888,056 | A | 6/1975 | Kelly et al. |
| 3,892,898 | A | 7/1975 | Yasui |
| 3,973,371 | A | 8/1976 | Heller |
| 4,187,652 | A | 2/1980 | Bobrovnikov et al. |
| 4,194,036 | A | 3/1980 | Davis et al. |

(Continued)

*Primary Examiner* — Eileen D Lillis
*Assistant Examiner* — Chi Nguyen
(74) *Attorney, Agent, or Firm* — Finnegan, Henderson, Farabow, Garrett & Dunner, LLP

(57) ABSTRACT

A multi-tiered building structure. The multi-tiered building structure includes a panel member having a pattern of cuts, a pattern of legs, and a pattern of tabs configured to move the panel member between a nonexpanded position, wherein the panel member forms a substantially flat shape, and an expanded position, wherein the panel member forms a substantially stepped shape. The building structure also includes a support structure configured to accept at least one of the pattern of tabs of the panel member and maintain the panel member in the expanded position.

20 Claims, 67 Drawing Sheets

U.S. PATENT DOCUMENTS

| | | | | |
|---|---|---|---|---|
| 4,452,025 | A | 6/1984 | Lew | |
| 4,514,950 | A | 5/1985 | Goodson, Jr. | |
| 4,559,752 | A | 12/1985 | Kieffer | |
| 4,563,851 | A | 1/1986 | Long | |
| 4,580,376 | A | 4/1986 | Vinum et al. | |
| 4,583,338 | A | 4/1986 | Sewell et al. | |
| 4,597,813 | A | 7/1986 | Hipkins | |
| 4,612,225 | A | 9/1986 | Graffam et al. | |
| 4,669,521 | A | 6/1987 | Barnes et al. | |
| 4,706,436 | A | 11/1987 | Mabey et al. | |
| 4,723,587 | A | 2/1988 | Scruggs, Jr. | |
| 4,803,128 | A | 2/1989 | Bender | |
| 4,816,310 | A | 3/1989 | Truyens | |
| 4,866,999 | A | 9/1989 | Burnette et al. | |
| 4,894,974 | A | 1/1990 | Mayhew et al. | |
| 5,167,105 | A | 12/1992 | Isban et al. | |
| 5,199,142 | A | 4/1993 | Davis | |
| 5,302,466 | A | 4/1994 | Davis et al. | |
| 5,326,615 | A | 7/1994 | Tsuchihashi et al. | |
| 5,484,640 | A | 1/1996 | Mullen et al. | |
| 5,491,950 | A | 2/1996 | Obegi | |
| 5,651,218 | A | 7/1997 | Bright et al. | |
| 5,736,221 | A | 4/1998 | Hardigg et al. | |
| 5,875,609 | A | 3/1999 | Quinif | |
| 5,992,127 | A | 11/1999 | Quinif | |
| 6,117,521 | A | 9/2000 | Yoshida et al. | |
| 6,156,444 | A | 12/2000 | Smith et al. | |
| 6,244,016 | B1 | 6/2001 | Wolf | |
| 6,306,522 | B1 | 10/2001 | Strutz et al. | |
| 6,447,928 | B2 | 9/2002 | Suitts | |
| 6,532,787 | B2 | 3/2003 | Suitts | |
| 7,074,474 | B2 | 7/2006 | Toi et al. | |
| 7,803,466 | B2 * | 9/2010 | Dorsy | 428/596 |
| 7,803,467 | B2 * | 9/2010 | Dorsy | 428/596 |
| 2002/0170255 | A1 | 11/2002 | Rizo | |
| 2004/0148893 | A1 | 8/2004 | Kornfalt | |
| 2005/0076600 | A1 | 4/2005 | Moody et al. | |
| 2005/0086895 | A1 | 4/2005 | Elliot et al. | |
| 2005/0098273 | A1 | 5/2005 | DeBoard | |
| 2006/0096229 | A1 | 5/2006 | Serpico et al. | |
| 2007/0051061 | A1 | 3/2007 | Weinmann | |

* cited by examiner

EXPANDABLE PANEL STRUCTURES AND METHODS OF MANUFACTURING THE SAME

RELATED APPLICATION

This application is a continuation application of U.S. patent application Ser. No. 11/826,139, filed Jul. 12, 2007 (now U.S. Pat. No. 7,803,467), which is a continuation-in-part of U.S. patent application Ser. No. 11/783,238, filed on Apr. 6, 2007 (now U.S. Pat. No. 7,803,466), which claims the benefit of priority to U.S. Provisional Patent Application No. 60/789,871, filed on Apr. 7, 2006. These applications are hereby incorporated by reference.

BACKGROUND OF THE INVENTION

I. Field of the Invention

The present invention relates generally to multi-tiered, expandable panel structures and methods of manufacturing such structures. Although not limited to a single field of use, multi-tiered, expandable panel structures are particularly well-suited for use in the architecture and construction industries.

II. Description of the Prior Art

Conventional structural approaches in the architecture and construction industries generally include rectangular frames, each frame having generally horizontal upper and lower beams, and generally vertical end beams connecting respective distal ends of the upper and lower beams. A plurality of substantially vertical studs may be fixed to the upper and lower beams, provided at spaced intervals between the two vertical end beams. Panels or sheathing, such as sheet rock, drywall, and gypsum board, are then fixed to the combination of upper and lower beams, end beams, and studs to define an internal wall. Alternatively, materials such as siding, brick, or the like are fixed to the frame to define an external wall.

Conventional materials and construction, however, suffer from many drawbacks. For instance, construction of each frame and attachment of the studs thereto generally must be performed at the construction site. This process is slow, labor-intensive, and often subject to weather and labor problems. The process also is subject to relative imprecision in comparison to prefabricated methods. As a result, conventional construction approaches are relatively slow, expensive, and inefficient. Moreover, the volume of materials that must be shipped to the job site to build according to standard practices occupies a relatively significant amount of space in transport vehicles used for the job. The resulting number of trips required to transport all of the necessary materials to the job site further adds to the overall job time, complexity, and cost.

Moreover, relatively tall structures, such as multi-storied buildings require the complex assembly of rectangular frames. The process of assembling multiple tiers of framing requires stacking and connecting panels of studs with systems of joists, columns, and/or "I-beams". Thus, the assembly of multi-tiered structures is often arduous and time-consuming. The need for complex building materials and numerous man hours adds considerable expense to such construction.

Therefore, it would be advantageous to provide, for instance, an expandable panel construction approach that can be easily manufactured and assembled, in a modular and cost-effective manner, in any one of a limitless variety of different configurations.

It would also be advantageous to provide a multi-tiered expandable panel structure, which is easily and quickly constructed from a plurality of individually expandable panel members and support structures. Moreover, it would be advantageous to provide a multi-story walled structure with relatively inexpensive building materials, which are simple to manufacture and assemble.

SUMMARY OF THE INVENTION

The advantages and purposes of the invention will be set forth in part in the description that follows, and in part will be obvious from the description, or may be learned by practice of the invention. Moreover, the advantages and purposes of the invention will be realized and attained by means of the elements and combinations particularly pointed out in the appended claims.

One aspect of the invention provides a panel assembly including: a sheet of material configured to move between a nonexpanded position, wherein the sheet of material forms a substantially flat shape, and an expanded position, wherein the sheet of material forms a substantially stepped shape; a first side segment formed in the sheet of material and having an outer leg and an inner leg configured to allow the first side segment to bow when the sheet of material moves from the nonexpanded position to the expanded position; a second side segment formed in the sheet of material and having an outer leg and an inner leg configured to allow the second side segment to bow when the sheet of material moves from the nonexpanded position to the expanded position; an inner segment formed in the sheet of material and having a first leg and a second leg configured to allow the inner segment to bow when the sheet of material moves from the nonexpanded position to the expanded position; and at least one first end plate and at least one second end plate, each of the first and second end plates configured to maintain the sheet of material in the expanded position.

Another aspect of the invention provides a method of forming a wall structure including: providing a panel member having a substantially planar portion having front and rear surfaces, right and left side edges, and first and second distal ends; forming a plurality of spaced substantially parallel apertures through the panel portion from the front surface to the rear surface so as to define a pattern of legs, a pattern of tabs, and a pair of first and second panel surfaces facing each other; providing a support structure including a first end plate and a second end plate, each having a plurality of spaced apart apertures; pulling the panel member in opposite directions by the right and left side edges, thereby spreading apart the panel member along each cut, with the panel surface between the cuts bending apart to define front and rear planes; inserting the tabs of the panel member into corresponding apertures of the support structure to secure the panel member in its expanded position; and affixing sheathing adjacent to at least one of the front and rear planes of the panel member.

Another aspect of the invention provides a building structure including: a panel member having a pattern of cuts, a pattern of legs, and a pattern of tabs configured to move the panel member between a nonexpanded position, where the panel member forms a substantially flat shape, and an expanded position, where the panel member forms a substantially stepped shape; and a support structure configured to accept at least one of the pattern of tabs of the panel member and maintain the panel member in the expanded position.

It is to be understood that both the foregoing general description and the following detailed description are only exemplary, and are intended to provide further explanation of the invention as claimed.

BRIEF DESCRIPTION OF THE DRAWINGS

The accompanying drawings are included to provide a further understanding of the invention and are incorporated in and constitute a part of this specification. The drawings illustrate embodiments of the invention and, together with the description, serve to explain the principles of the invention. In the drawings.

DETAILED DESCRIPTION OF THE INVENTION

Reference will now be made in detail to the present embodiment of the invention, an example of which is illustrated in the accompanying drawings. Wherever possible, the same reference numbers will be used throughout the drawings to refer to the same or like parts.

Figure 1:
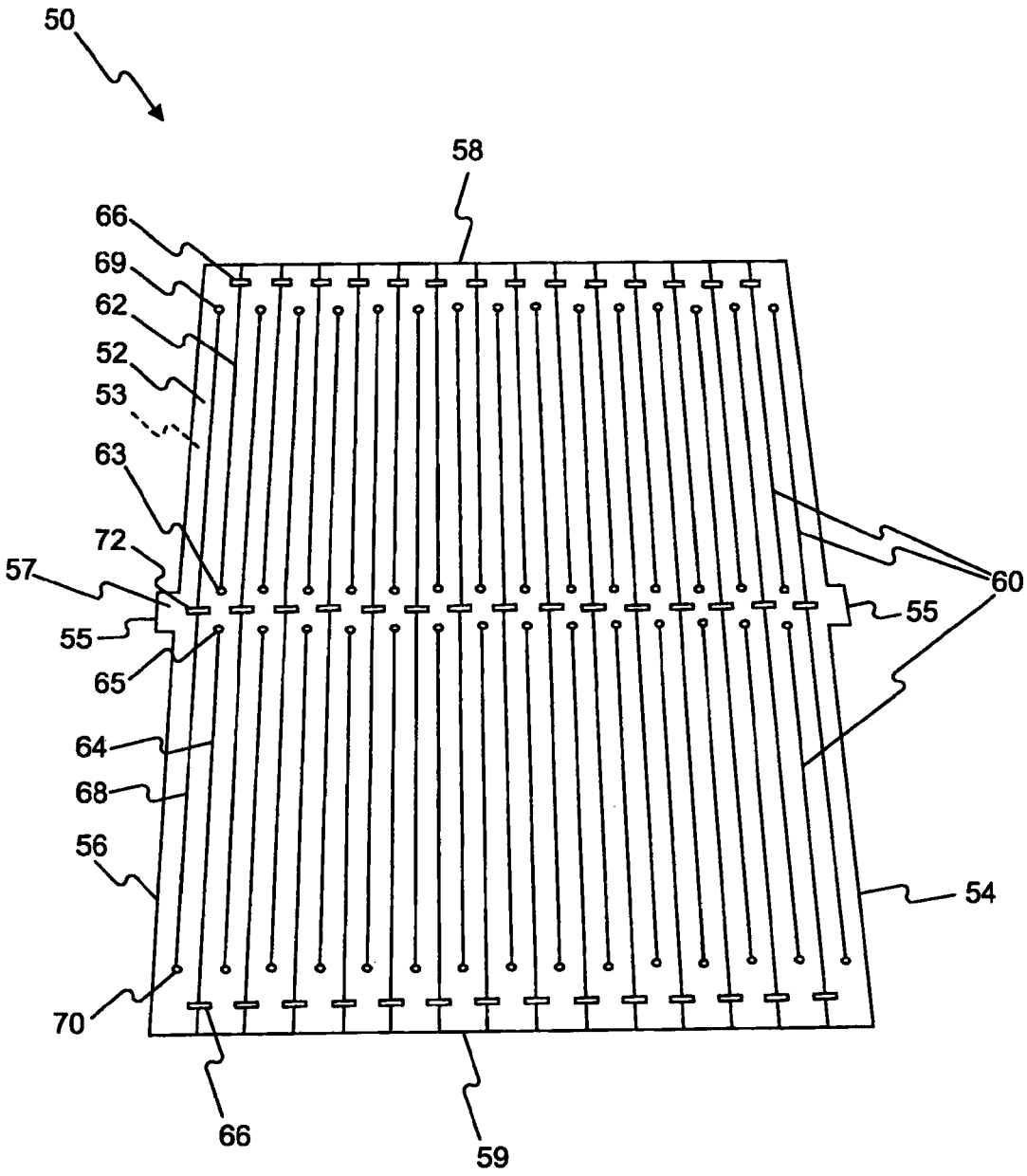
FIG. 1 is a front view of an expandable panel consistent with the present invention in a nonexpanded position, displaying the pattern of cuts.

As broadly embodied herein and referring to FIG. 1, an exemplary expandable panel 50 may preferably include a substantially planar front surface 52, a substantially planar rear surface 53 (not shown in FIG. 1), right and left side edges 54 and 56, and first and second distal ends 58 and 59. A central portion 57 may be defined midway between the first and second distal ends 58 and 59. Tab portions 55 may extend from either end of the central portion 57. In one embodiment, the tab portions 55 extend from the right and left side edges 54 and 56.

The panel 50 may preferably include a pattern of cuts 60, a pattern of apertures 63, 65, 69, 70, and a pattern of gaps 66, 72. Each pattern may penetrate through the front and rear surfaces 52, 53 of the panel 50. The pattern of cuts 60 may include a first series of generally parallel cuts 62 that may extend along a longitudinal direction of the panel 50. Each cut 62 may be spaced apart from one another by any suitable spacing so long as the panel 50 can be moved between a nonexpanded position and an expanded position.

The pattern of apertures may include a first series of apertures 63 that are spaced upward away from the central portion 57 of the panel 50. Each cut 62 may extend downward from the first distal end 58 of the panel 50 to be connected with a respective one of the first series of apertures 63. The first series of apertures 63 may be generally aligned with one another in a line parallel to the distal ends 58 and 59, and generally transverse to the side edges 54 and 56.

The pattern of cuts further may include a second series of generally parallel cuts 64, and the pattern of apertures may include a second series of apertures 65 that are spaced downward away from the central portion 57 of the panel 50. Each cut 64 may extend upward from the second distal end 59 to be connected with a respective one of the second series of apertures 65. The second series of apertures 65 may be aligned with one another in a line generally parallel to the distal ends 58 and 59, and transverse to the side edges 54 and 56.

The pattern of cuts further may include a third series of generally parallel cuts 68. Each cut 68 may be located between one of the cuts of the first and second series of cuts 62, 64. In other words, the first, second, and third series of generally parallel cuts 62, 64, and 68 may be interposed relative to one another. Each of the third series of generally parallel cuts 68 may extend between a respective, one of a third series of apertures 69 and a respective one of a fourth series of apertures 70. Each of the third series of apertures 69 may be inwardly spaced away from the first distal end 58 toward the central portion 57. The third series of apertures 69 may define a row of spaced apart apertures 69 extending along a direction generally parallel to the first distal end 58 and transverse to the side edges 54 and 56 of the panel 50. Similarly, the fourth series of apertures 70 may be inwardly spaced away from the second distal end 59 toward the central portion 57. The fourth series of apertures 70 may define another row of spaced apart apertures 70 extending along a line generally parallel to the second distal end 59 and transverse to the side edges 54 and 56.

The pattern of gaps 66, 72 may include a first series of gaps 66 and a second series of gaps 72. Each of the first and second series of gaps 66, 72 may extend along a direction that is generally traverse to the longitudinal direction of the panel 50. The first and second series of gaps 66, 72 may form three rows of gaps that extend along a direction generally parallel to the distal ends 58 and 59 and a direction generally transverse to the side edges 54 and 56 of the panel 50. The first series of gaps 66 may be located at a position that is spaced inward from the distal ends 58, 59 of the panel 50 toward the central portion 57, respectively. The first series of gaps 66 also may be connected to the first series of cuts 62 and the second series of cuts 64. The second series of gaps 72 may be located in the central portion 57 of the panel 50. The second series of gaps 72 also may be connected to the third series of cuts 68. In the illustrated embodiment, each of the second series of gaps 72 is connected at a midpoint of each of the third series of cuts 68.

As will be understood by one of skill in the art, the expandable panel 50 may include any variety of additional reinforcements or cut-out features for mitigating the effects of stress, and thereby increasing the load-bearing capabilities of the panel 50. For instance, the expandable panel 50 may include reinforcing plates or reinforcing ribs located at points of relatively high stress. The expandable panel 50 also may include rounded edges, filleted interior corners, drilled apertures, or any other feature known for use in preventing fracture at points of high stress propagation, or impeding the formation of fold lines that may impede the structural integrity of the panel 50. In one embodiment, the expandable panel 50 may include stress-mitigating structures located adjacent to or around the pattern of cuts 60, the pattern of apertures 63, 65, 69, 70, and/or the pattern of gaps 66, 72. For example, in one embodiment, the expandable panel 50 may be affixed to another expandable panel 50 in a layered configuration for the purpose of providing additional load-bearing functionality. The expandable panel 50 also may be manufactured to have any particularly suitable size or shape, such as a relatively larger or smaller panel than illustrated, and may include a greater or lesser number of spaced generally parallel cuts 60, depending on the expected use and loading. For instance, the thickness of the panel 50 can be selectively increased at certain locations (e.g., adjacent to or around the pattern of cuts 60, the pattern of apertures 63, 65, 69, 70, and/or the pattern of gaps 66, 72) to improve the structural integrity of the panel 50. Moreover, the shapes and orientations of the spaced generally parallel cuts 60 may be optimized based on various stress profiles, as desired.

Figure 2A:
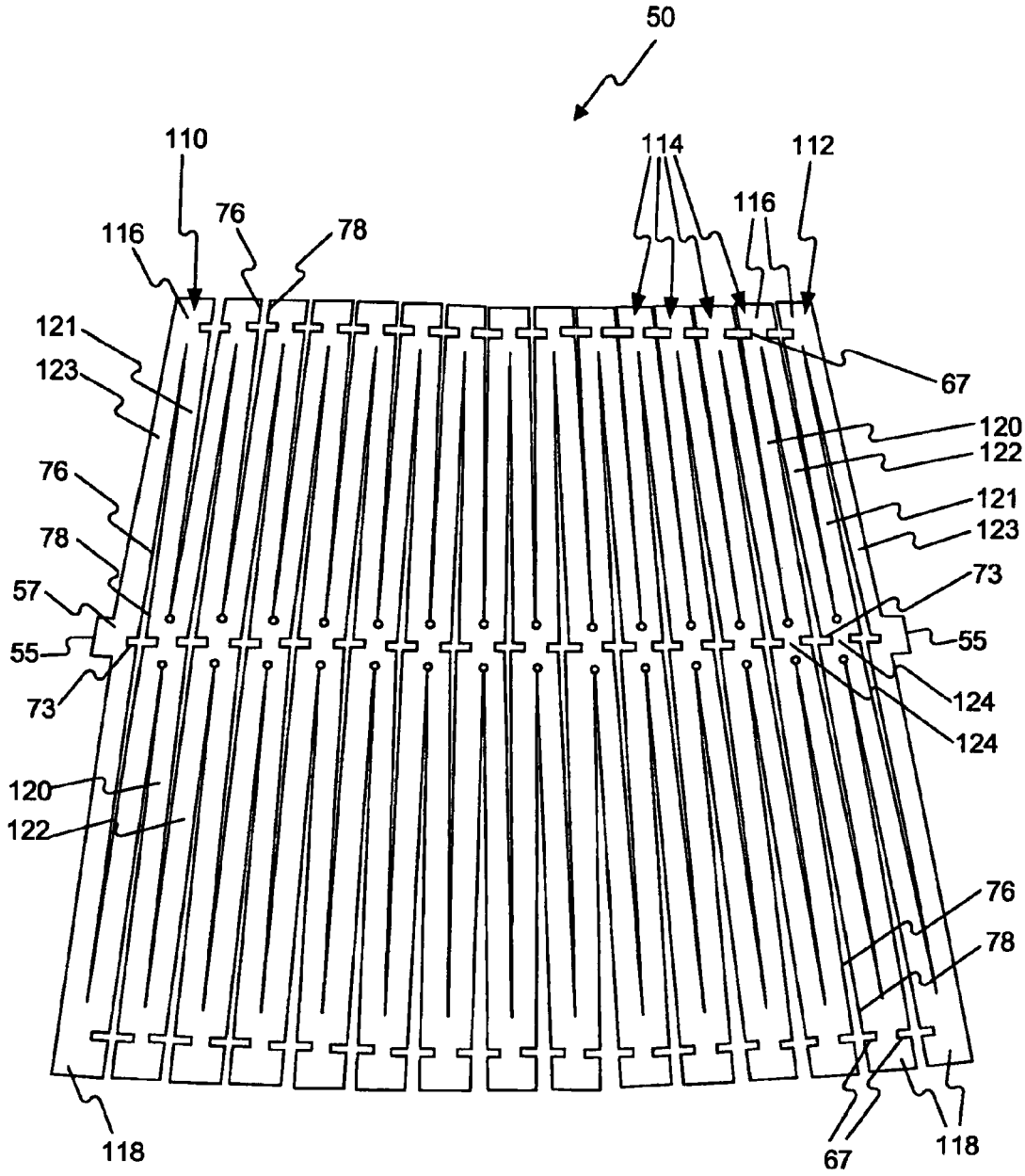
FIG. 2A is a front view depicting the expandable panel of FIG. 1 in a partially expanded position, displaying the pluralities of segments.

FIG. 2A illustrates an exemplary embodiment of the panel 50 after it has been moved to a partially expanded position. In particular, given the patterns of cuts, apertures, and gaps described with respect to FIG. 1, the exemplary expandable panel 50 may include a first side segment 110, a second side segment 112, and one or more inner segments 114 disposed therebetween. Each of the segments 110, 112, and 114 may include a first distal end joint 116 and a second distal end joint 118. Each of the first distal end joints 116 and second distal end joints 118 may include at least one groove 67 that is formed by an end portion of a respective one of the first series of gaps 66. Each of the first and second side segments 110 and 112 may include an inner leg 121 extending from a respective first distal end joint 116 to a respective second distal end joint 118, and an outer leg 123 extending from a respective first distal end joint 116 to a respective second distal end joint 118. Each of the inner segments 114 may include a first leg 120 extending from a respective first distal end joint 116 to a respective second distal end joint 118, and a second leg 122 extending from a respective first distal end joint 116 to a respective second distal end joint 118. Each of the inner and outer legs 121, 123 and first and second legs 120, 122 may include a midpoint portion 124. Each of the midpoint portions 124 may be disposed along the central portion 57 and may have formed therein a groove 73 that is formed by an end portion of a respective one of the second series of gaps 72.

According to the embodiment of FIG. 2A, the outer leg 123 and inner leg 121 of the first side segment 110 may be joined at their ends by the corresponding first distal end joint 116 and a second distal end joint 118, respectively. The outer leg 123 and inner leg 121 of the second side segment 112 may be joined at their ends by the corresponding first distal end joint 116 and second distal end joint 118, respectively. The first leg 120 and the second leg 122 of each inner segment 114 may be joined at their ends by first and second distal end joints 116, 118, respectively.

Moreover, the inner leg 121 of the first side segment 110 may be joined to the first leg 120 of an adjacent inner segment 114 by their respective midpoint portions 124. Similarly, the second leg 122 of the adjacent inner segment 114 may be joined to the first leg 120 of a still further adjacent inner segment 114 by their respective midpoint portions 124.

Finally, the second leg 122 of the inner segment that is adjacent to the second side segment 112 may be joined to the inner leg 121 thereof by their respective midpoint portions 124. This pattern of joints can be applied to virtually any number of segments.

Each of the cuts 60 of the expandable panel 50, and thus, each of the first and second legs 120, 122, and inner and outer legs 121, 123, may form at least a part of a first panel surface 76 and at least a part of a second panel surface 78. When the expandable panel 50 is in a nonexpanded position, as depicted in FIG. 2A, the first panel surfaces 76 may substantially face the adjacent second panel surfaces 78.

Figure 2B:
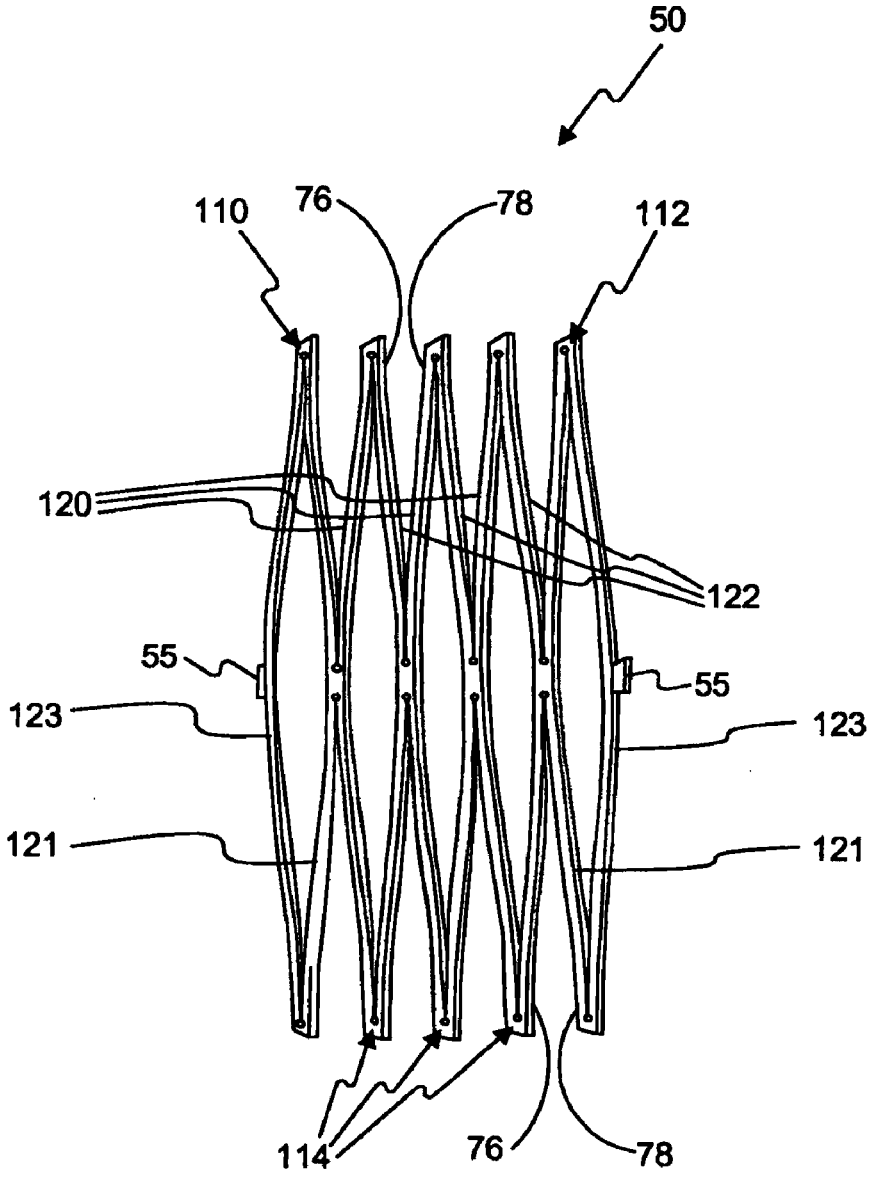
FIG. 2B is a front view depicting the expandable panel of FIG. 1 in an expanded position, displaying the pluralities of segments.

FIG. 2B depicts an exemplary embodiment of the panel 50 in an expanded position. The panel 50 may be expanded by pulling the first side segment 110 and the second side segment 112 away from each other. During assembly, the left side edge 56 of the first side segment 110 may be pulled away from the right side edge 54 of the second side segment 112 along a direction transverse to the longitudinal direction of the cuts 60. For instance, the panel 50 may be expanded by pulling the tab portions 55 in opposite directions transverse to the direction of cuts 60. Alternatively, the inner segments 114 may be sequentially pulled away from the first side segment 110, the second side segment 112, and each other inner segment 114. Accordingly, the panel 50 may expand and separate along each of the cuts 60. Because of the location and aligned orientation of the various apertures 63, 65, 69, and 70, and of the gaps 66 and 72, the first side segment 110, the second side segment 112, and the at least one inner segment 114 may each bow outward. And when the segments 110, 112, 114 bow outward, the midpoints of the two legs of each segment may separate from each other. Because the two legs of each segment are joined at their ends by respective first and second distal end joints 116, 118, and because the midpoints of the two legs of each segment bend or bow in opposite directions, the first and second distal end joints 116, 118 may be subjected to bending, compression, and/or torsional forces. Similarly, because legs between adjacent sections are joined by their midpoint portions 124, and because adjacent legs are configured to bend in opposite directions, each of the midpoint portions 124 may be subjected to bending, compression, and/or torsional forces.

As illustrated in FIG. 2B, the panel 50 in its expanded position may resemble a generally stepped configuration. In other words, each segment may appear to be stepped, one upon another. Because adjacent segments 110, 112, and 114 may be connected only at their midpoint portions 124, the resulting structure may result in previously adjacent first distal end joints 116 and previously adjacent second distal end joints 118 being spaced apart. Still further, as the segments 110, 112, and 114 bow outward, each of the transversely adjacent legs is spread apart, so as to separate the first panel surfaces 76 and second panel surfaces 78. According to some embodiments, the overall effect of the expansion of the panel 50 also may include a twisting of segments 110, 112, and 114, such that the now spread apart first and second panel surfaces 76 and 78 form front and rear planes to which sheathing and/or other inserts may be attached. In one exemplary embodiment, the resulting expandable panel 50 may be referred to as a "double zig-zag," "accordion," or "stepped" variation of the exemplary expandable panel 50. In other exemplary embodiments, connectors, spacers, or the like may be inserted into the panel 50, such as into adjacently aligned gaps, to provide structural support and/or to maintain the panel 50 in its expanded position. These assembly steps may be performed in any suitable manner, such as by hand and without the use of heavy tools or machinery.

Figure 3A:
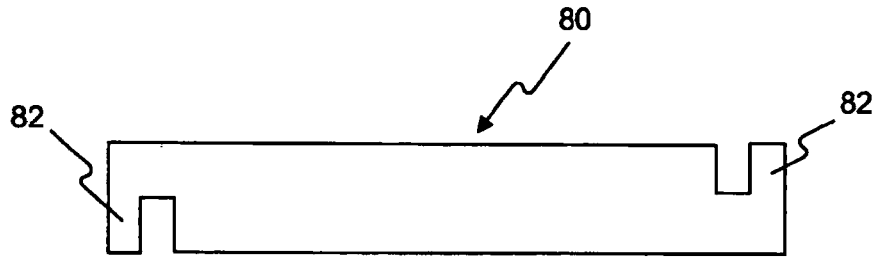
FIG. 3A is a front view of an embodiment of a connector for fixing the expandable panel of FIG. 1 in a preferably expanded position.
Figure 3B:
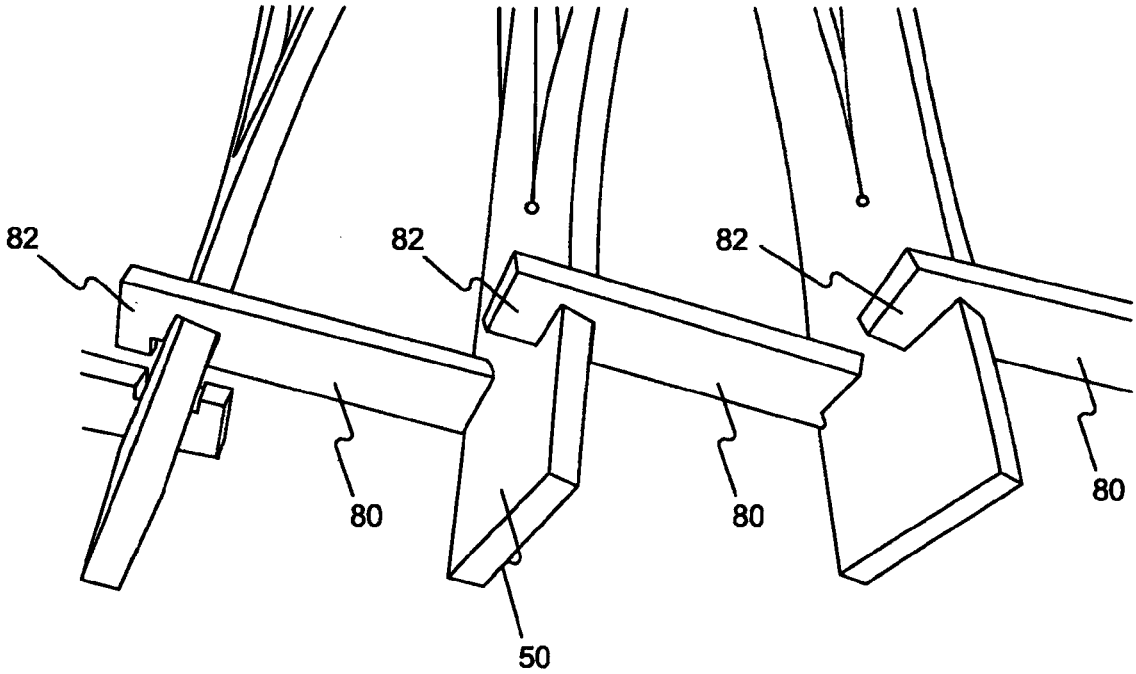
FIG. 3B is a perspective view of the expandable panel having a plurality of the connectors of FIG. 3A fixed therein.
Figure 3C:
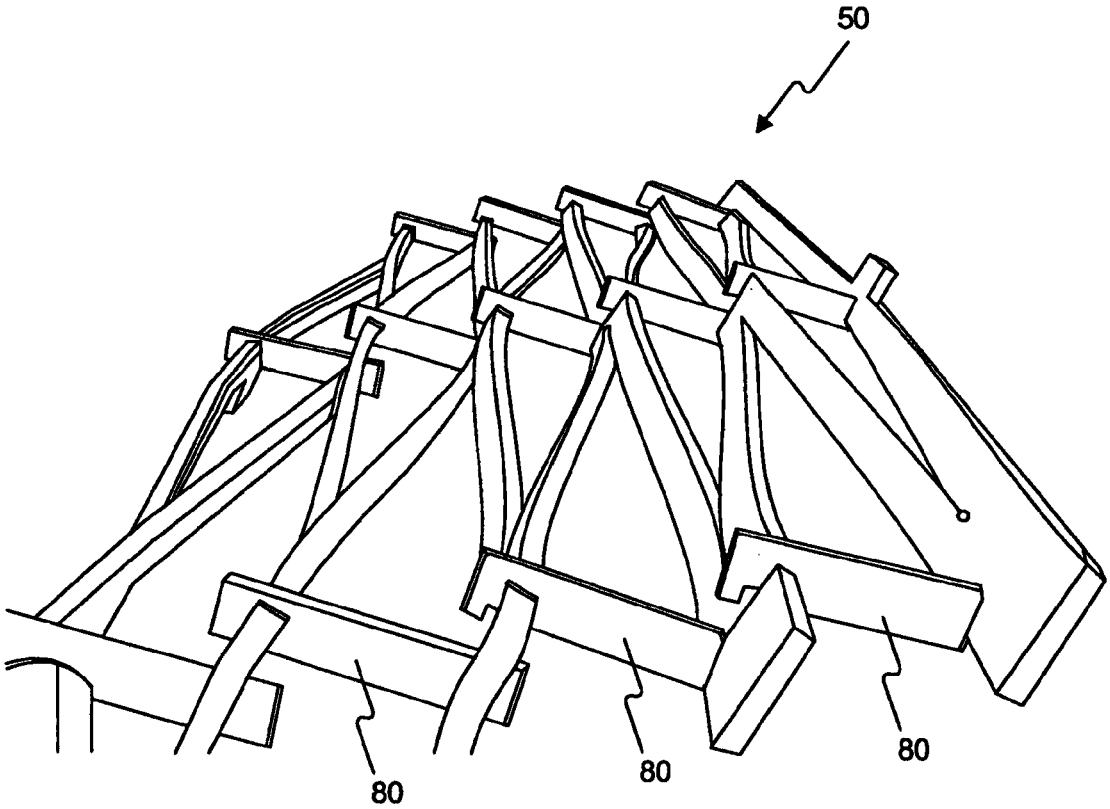
FIG. 3C is a perspective view of the expandable panel having a plurality of the connectors of FIG. 3A fixed therein.
Figure 4A:
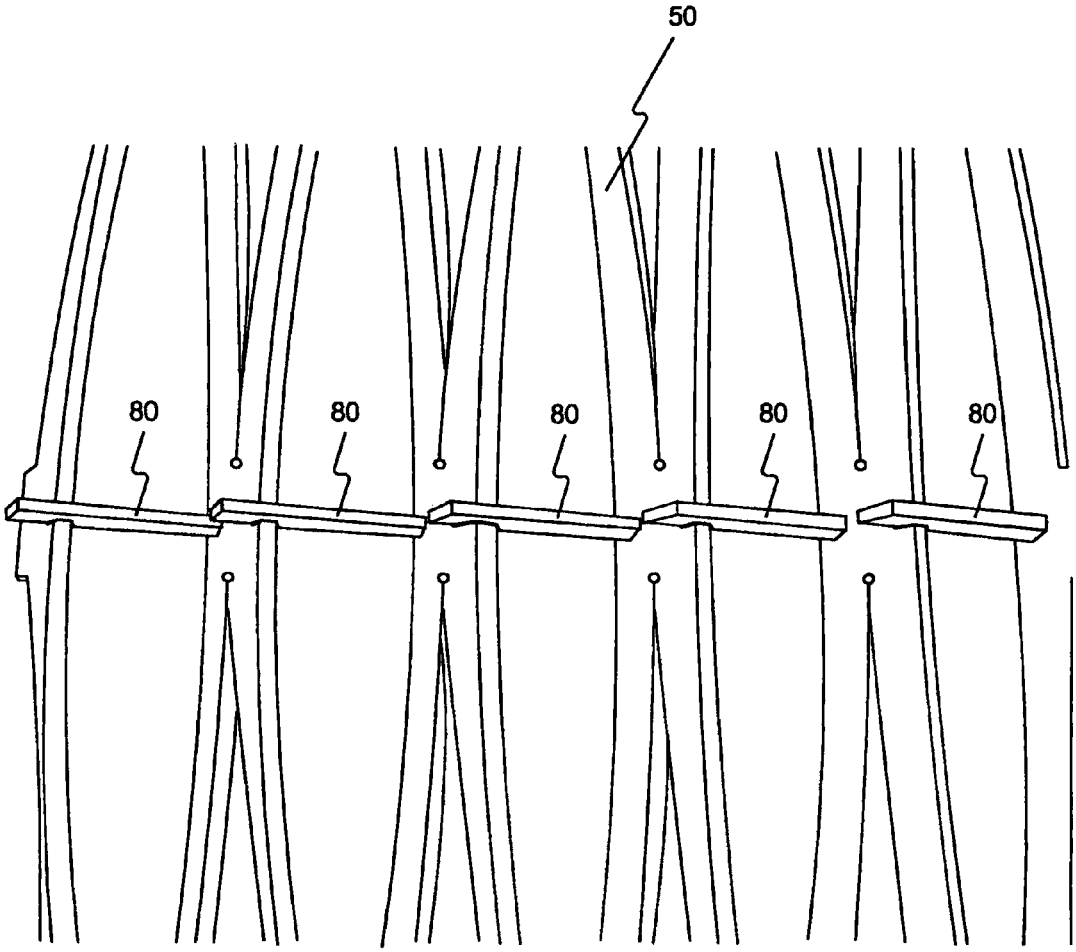
FIG. 4A is a front view of the expandable panel having a plurality of the connectors of FIG. 3A fixed therein.
Figure 4B:
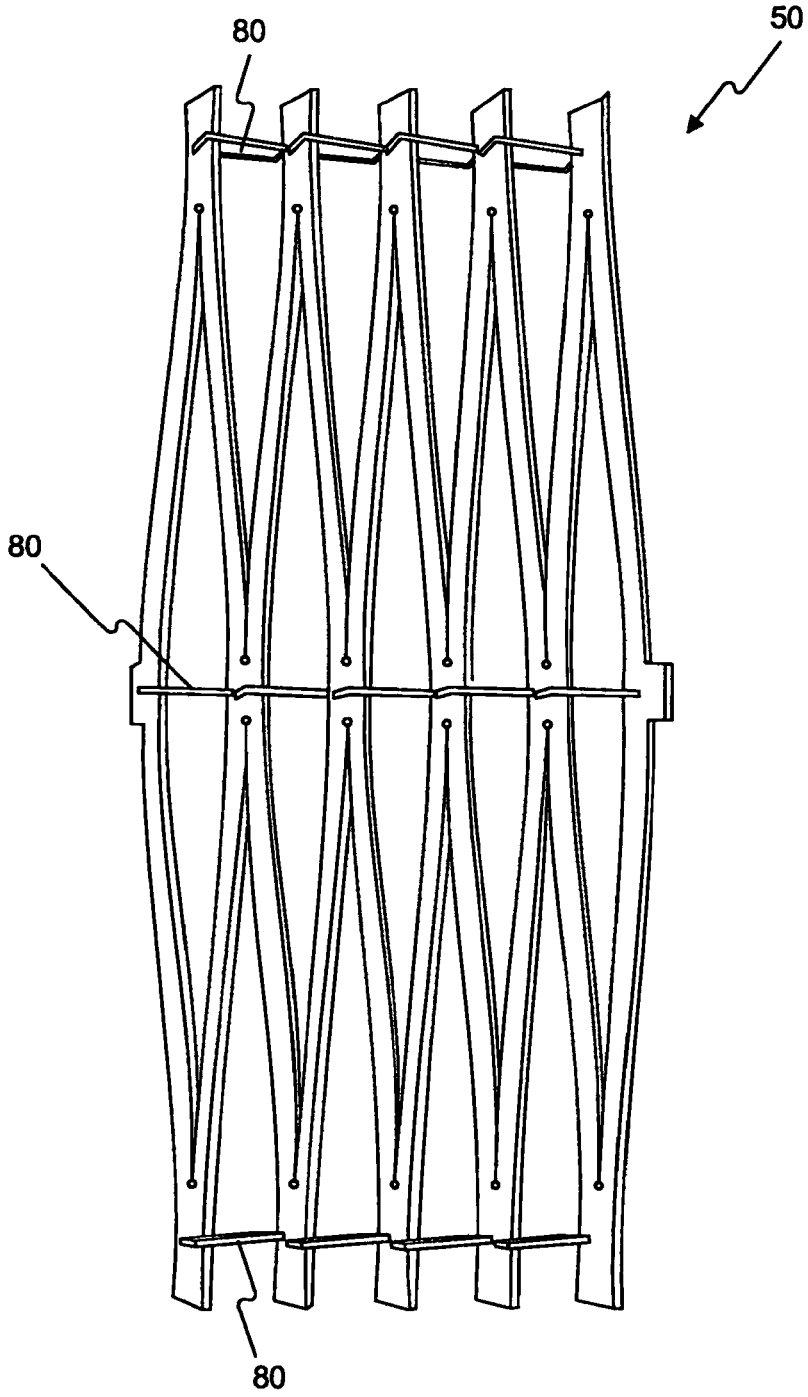
FIG. 4B is a front view of the expandable panel having a plurality of the connectors of FIG. 3A fixed therein.
Figure 5A:
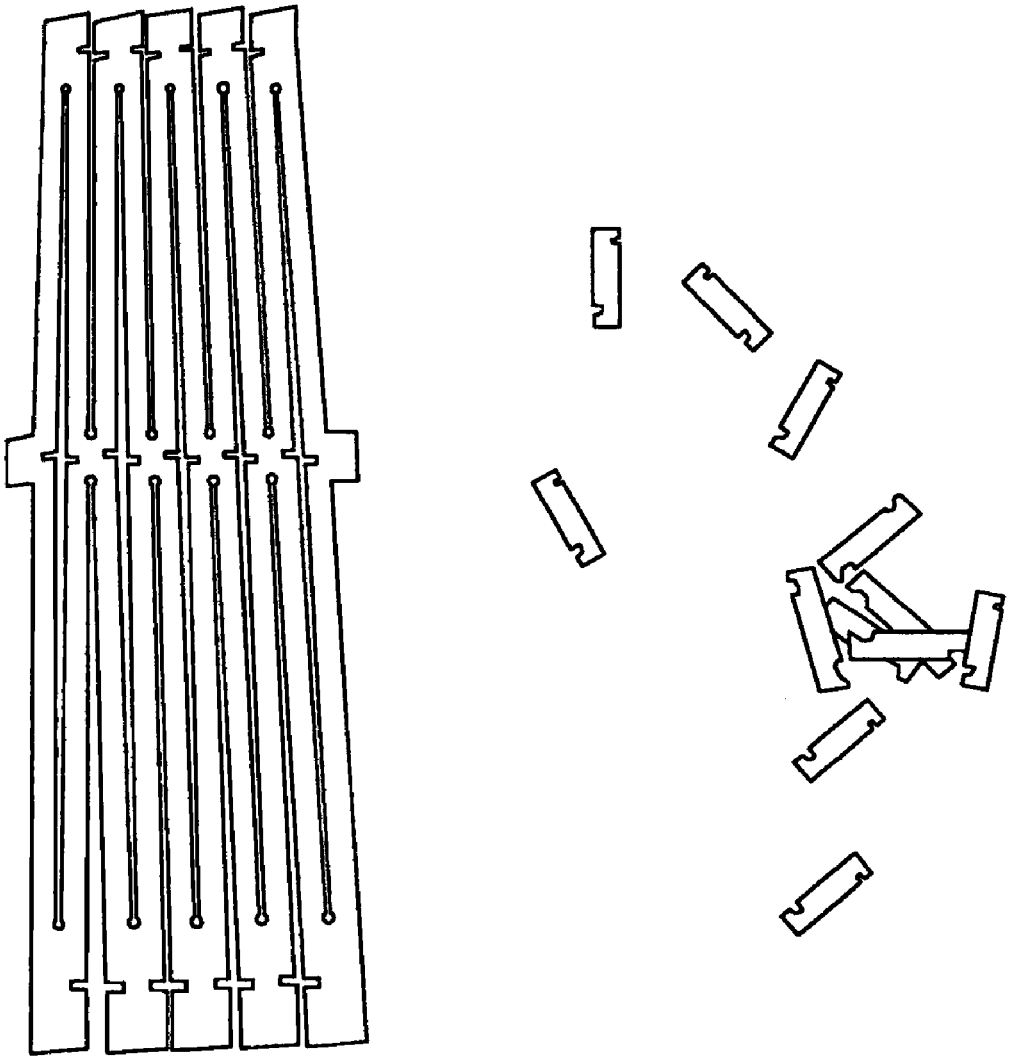
FIGS. 5A-5F depict a method of assembly of an expandable panel in accordance with the present invention.
Figure 5B:
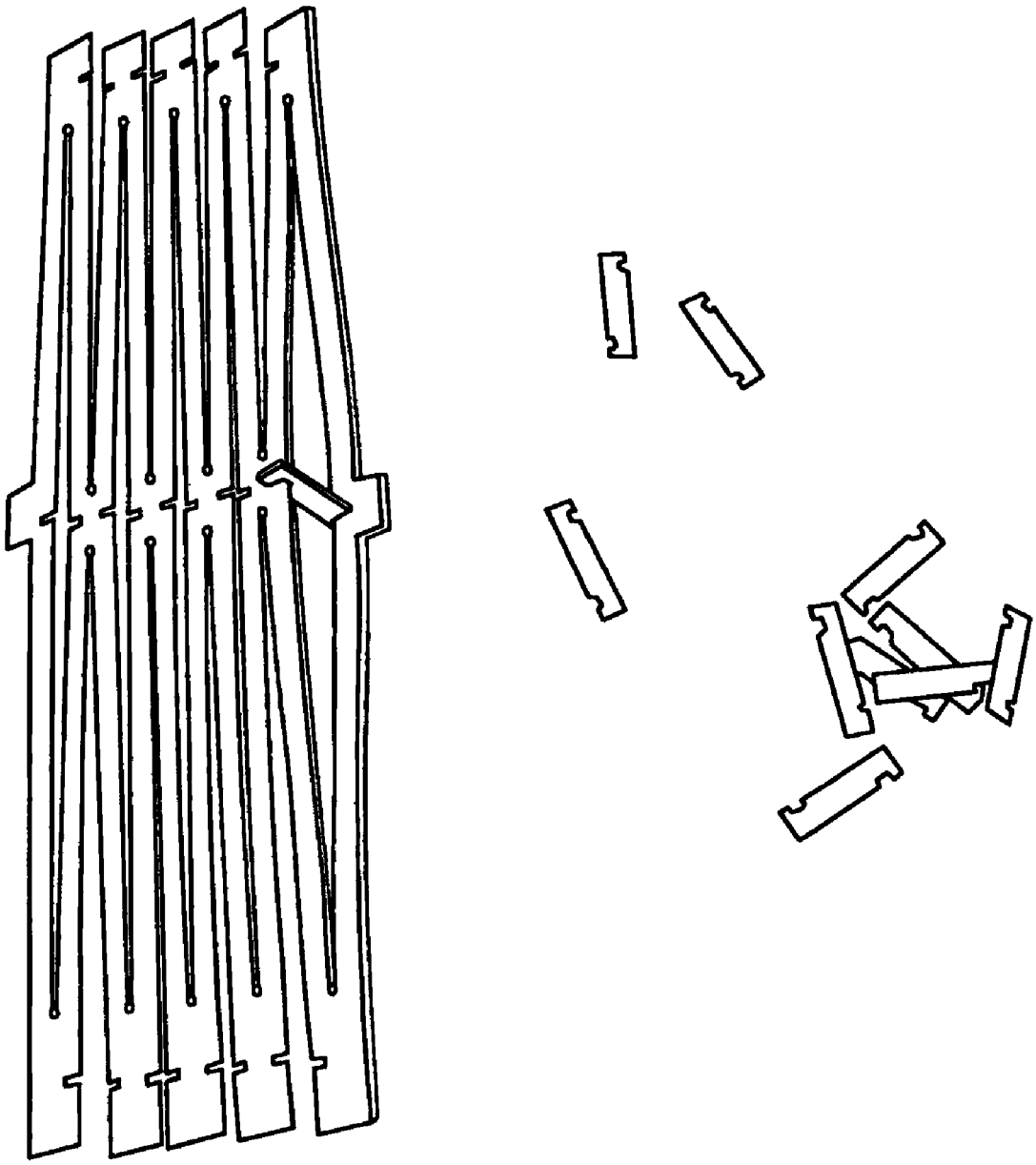
Figure 5C:
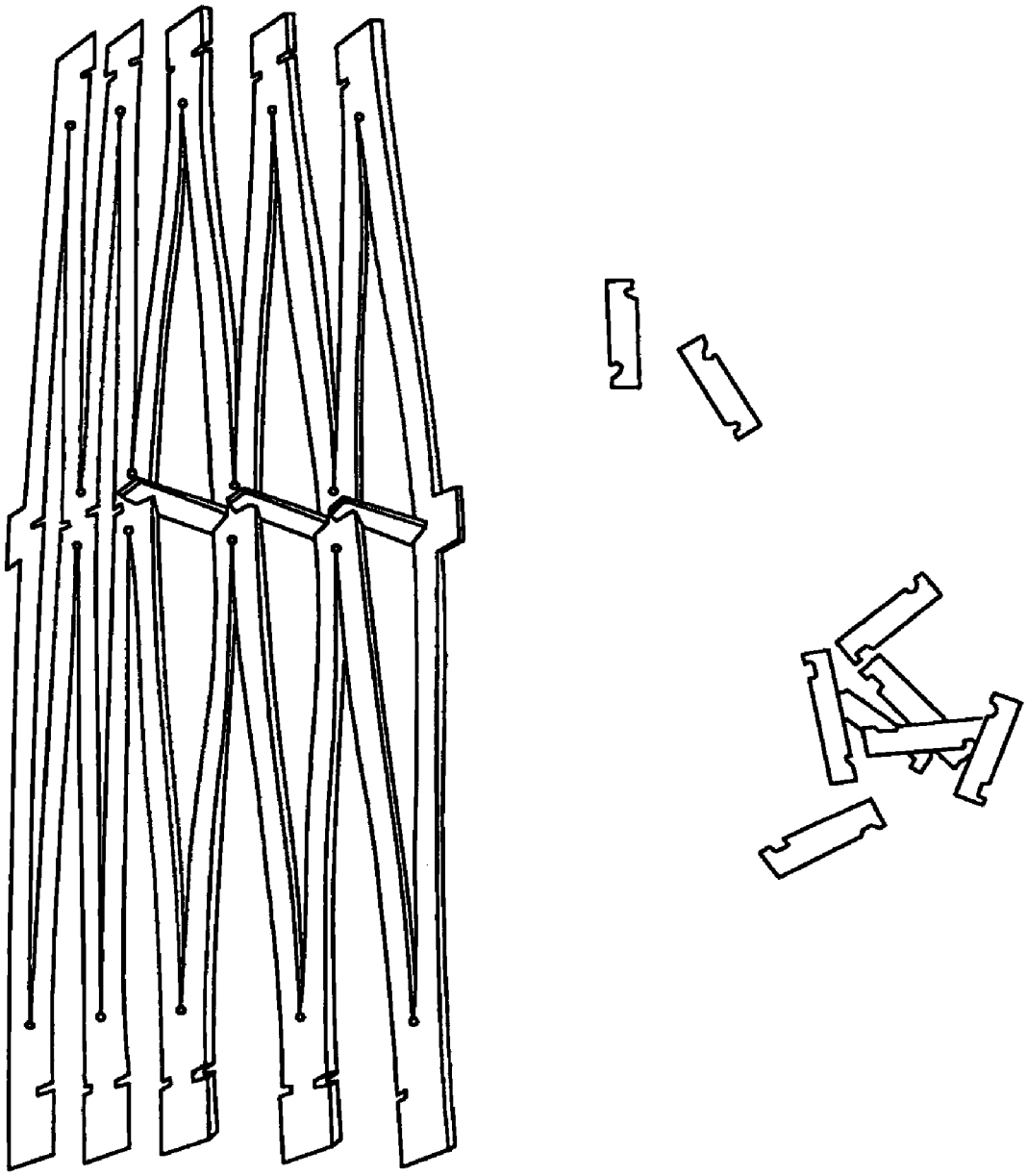
Figure 5D:
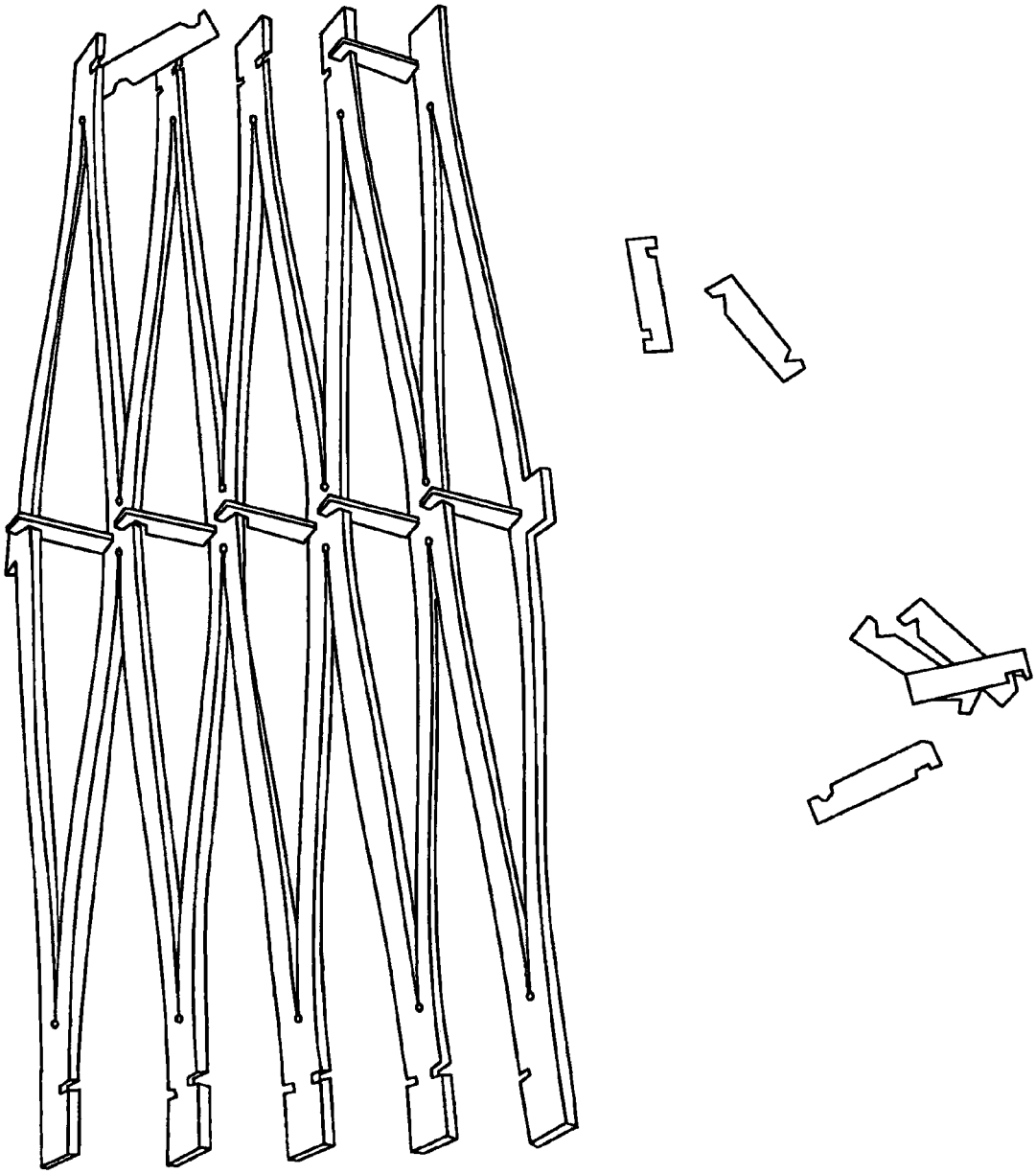
Figure 5E:
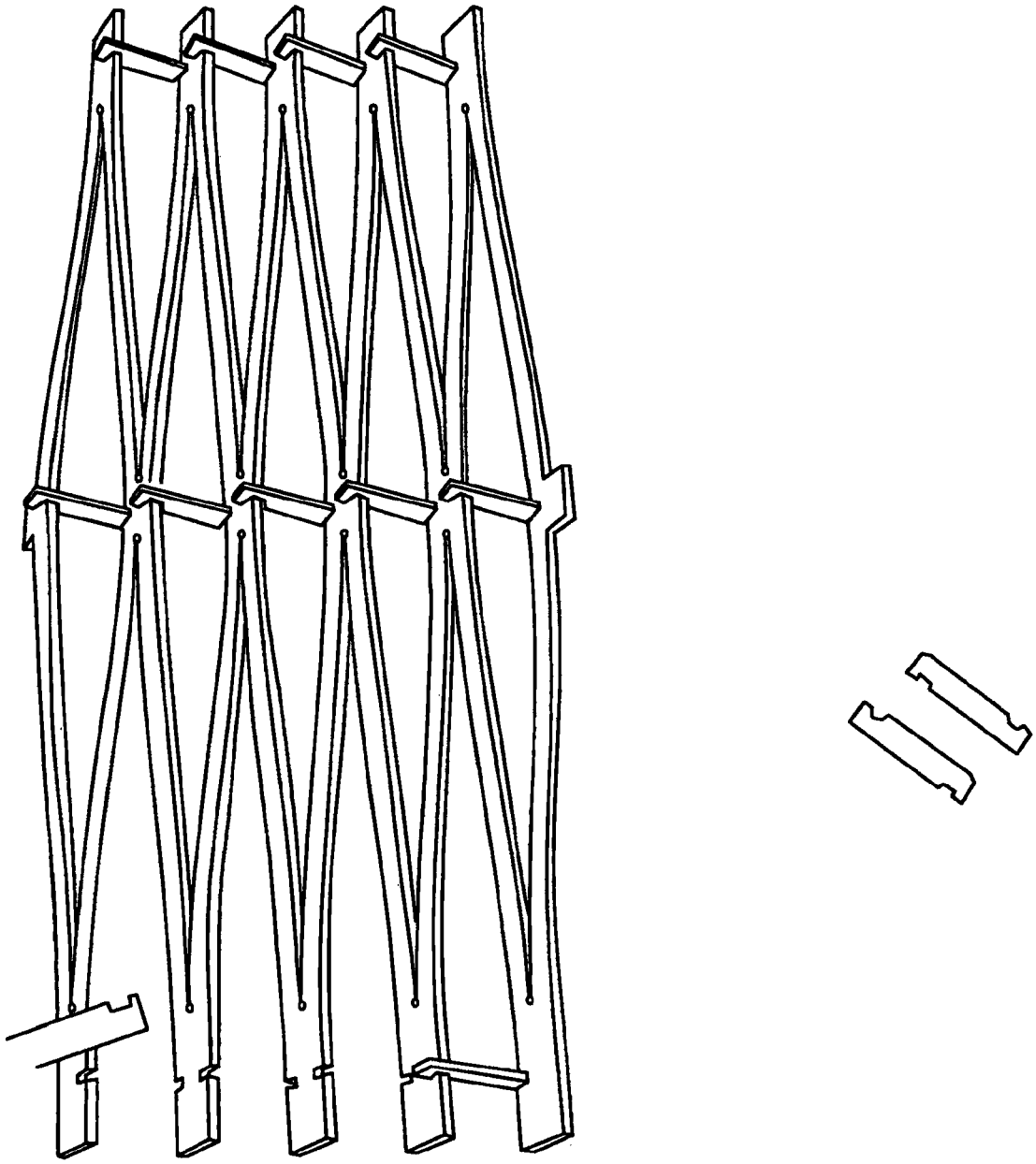
Figure 5F:
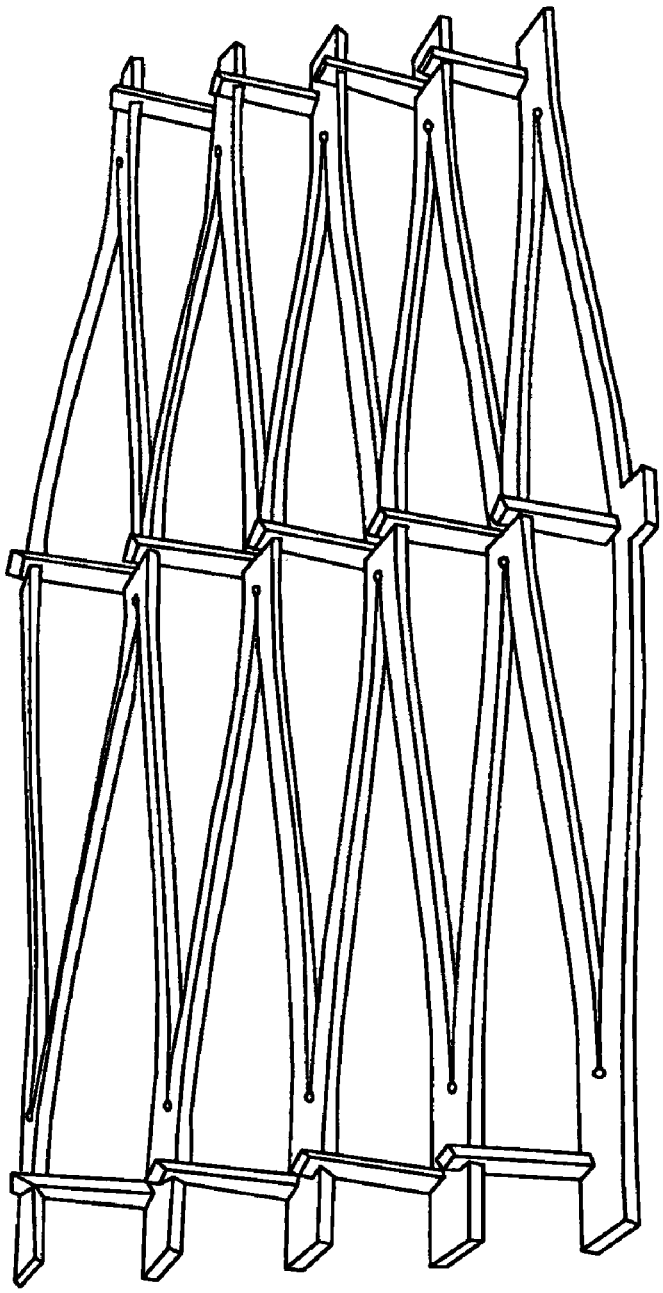

FIG. 3A depicts an exemplary embodiment of a connector 80 (alternatively referred to as a "spacer") that includes two L-shaped tabs 82. Each of the two L-shaped tabs 82 may be disposed on opposite ends and opposite faces of the connector 80. FIGS. 3B, 3C, 4A, and 4B depict additional embodiments of the connectors 80 as they are incorporated into the expandable panel 50. The connectors 80 may be fitted within different locations of the panel 50. For instance, the two L-shaped tabs 82 of a connector 80 each may be formed to fit within a respective groove 67, 73 defined by the first and second series of gaps 66, 72 in the panel 50. In one embodiment of the invention, the L-shaped tabs 82 and grooves 67, 73 may together form a mating engagement without the use of screws, fasteners, or the like. For instance, the L-shaped tabs 82 of the connectors 80 may be relatively locked into the grooves 67 and/or 73 of the panel 50. Thus, the connectors 80 may be configured to maintain the panel 50 in its expanded position and to provide rigidity and strength to the panel 50. As will be understood by one of skill in the art, each connector 80 may be made of any suitable material and configured in any suitable manner so long as it is able to withstand a plurality of compression and/or tension forces while maintaining the panel 50 in the expanded position.

FIGS. 5A-5F depict a method of assembling an exemplary expandable panel 50. Specifically, a method is depicted for expanding the panel 50 into the exemplary expanded configuration illustrated in FIG. 4B. For instance, the panel 50 may be assembled by inserting one or more connectors 80 at a time into two adjacent grooves of the grooves 67 and/or 73 until the panel 50 is fully expanded. As will be understood by one of skill in the art, specific methods for assembly relating to the sequencing of assembly, and particular methods of inserting connectors 80 into mating and/or locking engagement with the expandable panel 50 will become apparent upon practice of the invention. For instance, in one embodiment, connectors 80 may be installed into adjacent grooves 67 and then into adjacent grooves 73. Alternatively, connectors 80 may be installed into adjacent grooves 73 and then into adjacent grooves 67. In some embodiments, the connectors 80 may be further secured to gaps of panel 50 by adhesives, such as glue or solder, or by other mechanisms, such as dowel pins, hooks, or the like.

Figure 6A:
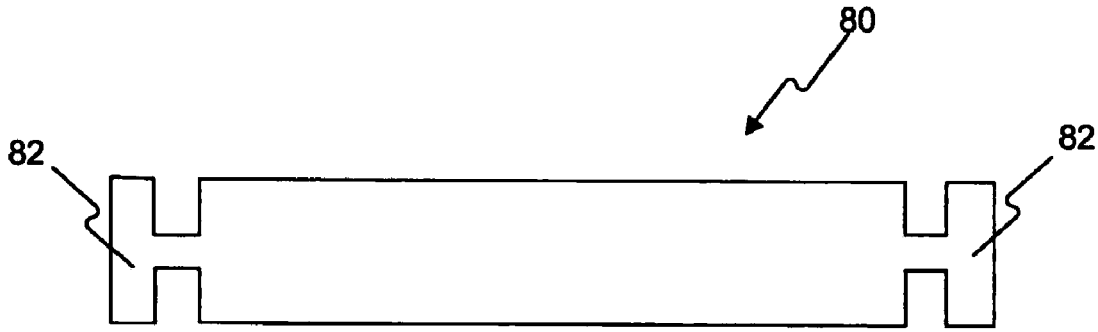
FIG. 6A is a front view of an alternative embodiment of a connector for fixing the expandable panel in an expanded position.
Figure 6B:
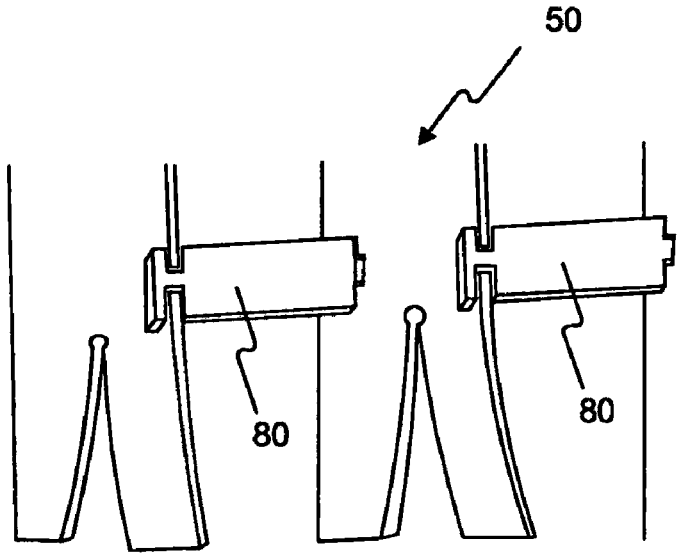
FIG. 6B is a front view of the expandable panel having a plurality of the connectors of FIG. 6A fixed therein.

FIG. 6A depicts another exemplary embodiment of a connector 80 that has T- or H-shaped tabs 82. FIG. 6B depicts an embodiment of the expandable panel 50 in which the panel 50 may be expanded by the embodiment of connectors 80 depicted in FIG. 6A.

Figure 7A:
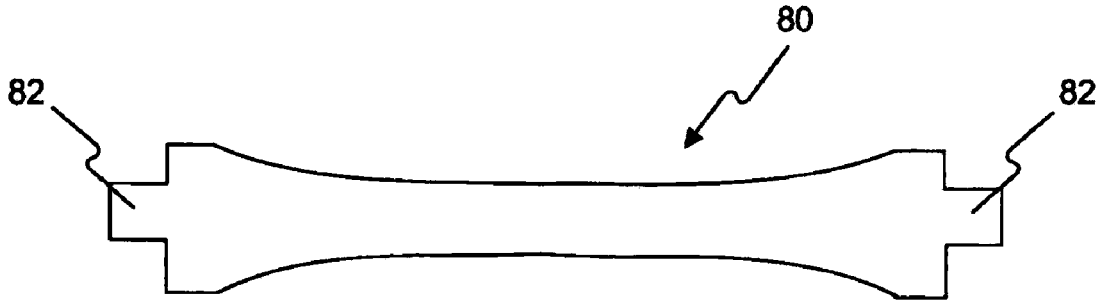
FIG. 7A is a front view of another alternative embodiment of a connector for fixing the expandable panel in an expanded position.
Figure 7B:
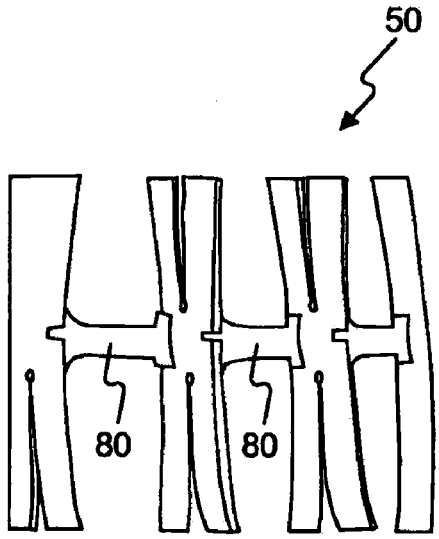
FIG. 7B is a front view of the expandable panel having a plurality of the connectors of FIG. 7A fixed therein.

FIG. 7A depicts yet another exemplary embodiment of a connector 80 that has protruding tabs 82. FIG. 7B depicts an embodiment of the expandable panel 50 in which the panel 50 may be expanded by the embodiment of connectors 80 depicted in FIG. 7A.

Figure 8A:
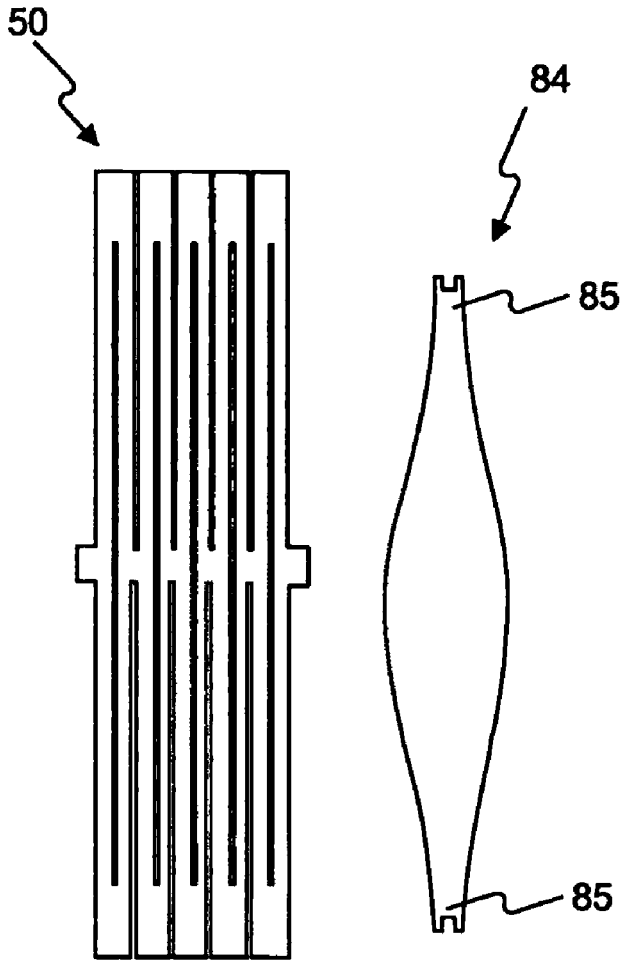
FIG. 8A is a front view depicting the expandable panel in a nonexpanded position, along with a single skin panel.

FIG. 8A depicts another embodiment of the expandable panel 50 in its nonexpanded position. FIG. 8A also depicts a single detachable skin panel 84 having U-shaped tabs 85. The skin panel 84 may be formed in any suitable shape so long as it is compatible with openings formed in an expanded panel 50. In the embodiment of FIG. 8A, the skin panel 84 may be substantially in the shape of a vesica piscis. The skin panel 84 also may be made of any suitable material known in the art. In one embodiment, skin panel 84 may be a relatively rigid panel made of wood, plastic, or metal. Alternatively, the skin panel 84 may be made of glass or another transparent material. In any of these exemplary embodiments, the U-shaped tabs 85 may be used to hold the expandable panel 50 in its expanded position. Specifically, the U-shaped tabs 85 may interlock (e.g., by tongue and groove mechanism) surfaces of the panel 50, such as the first and second panel surfaces 76 and 78, the first, second, third, or fourth apertures 63, 65, 69, 70, and/or the grooves 67, 73. In another embodiment, skin panel 84 may be a relatively flexible panel made of plastic or cloth, such as canvas. In this embodiment, a flexible skin panel 84 may be secured to expandable panel 50 by any suitable means, such as hooks, ties, adhesives, or the like. In certain embodiments, skin panel 84 may include aesthetic designs, such as pictures, manufacturers' logos, advertisements, and/or other indicia.

Figure 8B:
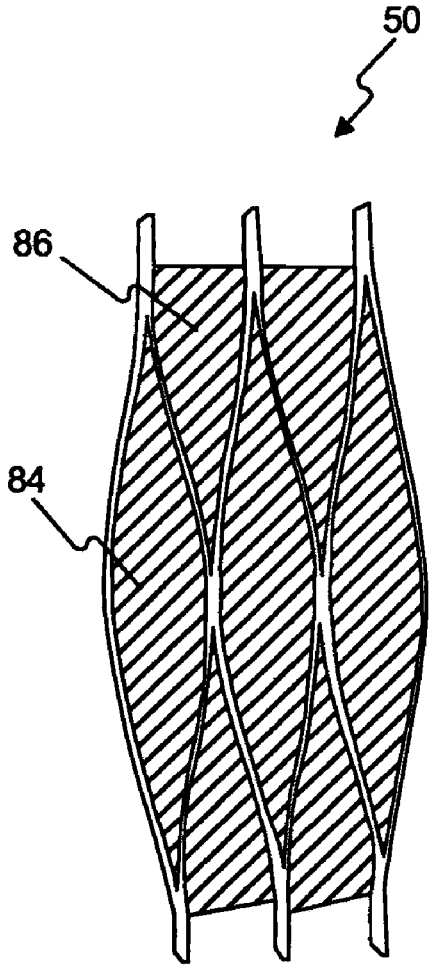
FIG. 8B is a front view depicting the expandable panel in an expanded position, with a plurality of skin panels affixed therein.

FIG. 8B depicts the expandable panel 50 as expanded by a relatively rigid embodiment of the skin panels 84. Moreover, the expandable panel 50 further includes alternative relatively rigid skin panels 86 that may be specially configured to be accommodated in partial openings of the panel 50. In this embodiment, because the skin panels 84 and 86 are relatively rigid, they may both expand and provide structural support to panel 50. Furthermore, because the skin panels 84, 86 may be formed in a suitable geometric configuration, they may be nested together in adjacent locations of a sheet of stock material, prior to manufacture, in order to minimize material waste and to ease production.

Figure 9:
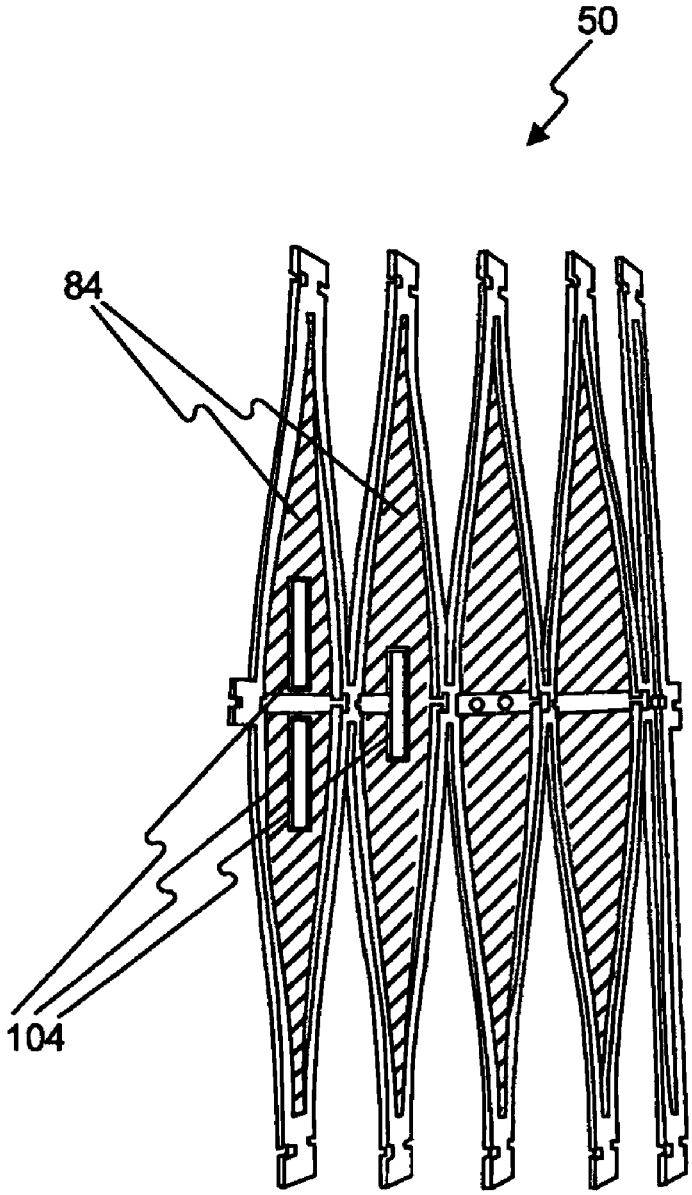
FIG. 9 is a perspective view of the expandable panel in an expanded position, with a plurality of skin panels having apertures.

FIG. 9 depicts an embodiment of expandable panel 50 having disposed therein alternative embodiments of the skin panels 84. In particular, the skin panels 84 may include one or more apertures 104. According to one embodiment, apertures 104 may be purely aesthetic in nature. In another embodiment, apertures 104 may function to accommodate wires, pipes, insulation, plumbing, or any other structures or materials preferably extended through an interior or exterior wall. In a further embodiment, scrap material cut from the apertures 104 may be used to manufacture components, such as the connectors 80. The apertures 104 also may allow for interweaving of components, such as connectors 80, through the skin panels 84.

Figure 10A:
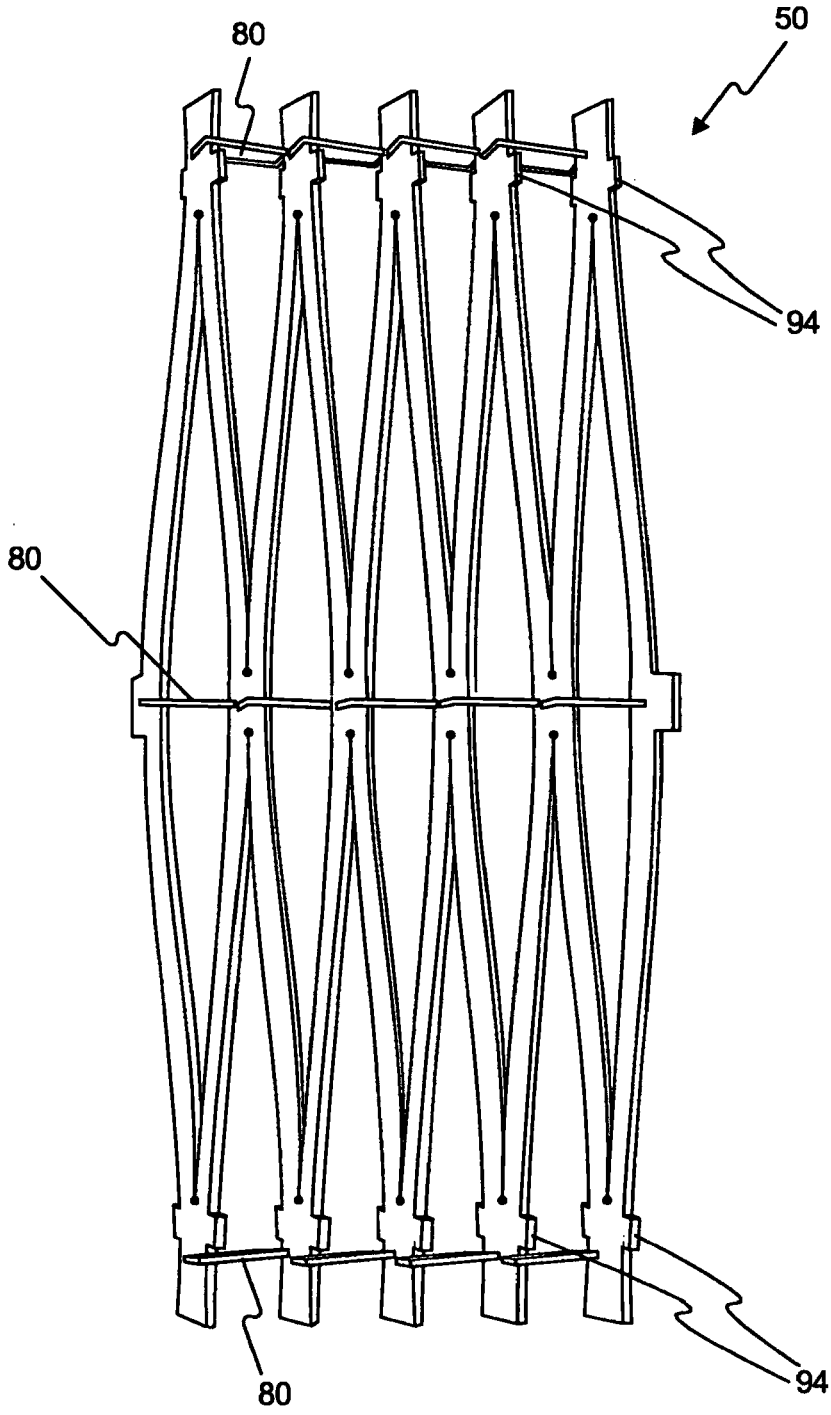
FIG. 10A is a perspective view of an expandable panel in accordance with the present invention in the expanded position and having tabs for supporting sheathing.

FIG. 10A depicts another exemplary embodiment wherein an expanded panel 50 is provided with one or more tabs 94 (alternatively referred to as "protrusions"). The tabs 94 may be used for attaching sheathing to the panel 50. The tabs 94 may be cut from the same material as that of the panel 50. For instance, the tabs 94 may extend from portions of the panel 50, such as the first panel surface 76 or second panel surface 78. The tabs 94 also may be disposed in locations of the panel 50 corresponding to mechanisms for attaching the sheathing. As a result of the change in geometry caused by the tabs 94, the pattern of cuts 60, the pattern of apertures 63, 65, 69, 70, and the pattern of gaps 66, 72 may be altered. For example, the apertures resulting between legs of adjacent segments may be wider in view of the space required for the tabs 94 to extend from the adjacent first panel surfaces 76 and second panel surfaces 78.

Figure 10B:
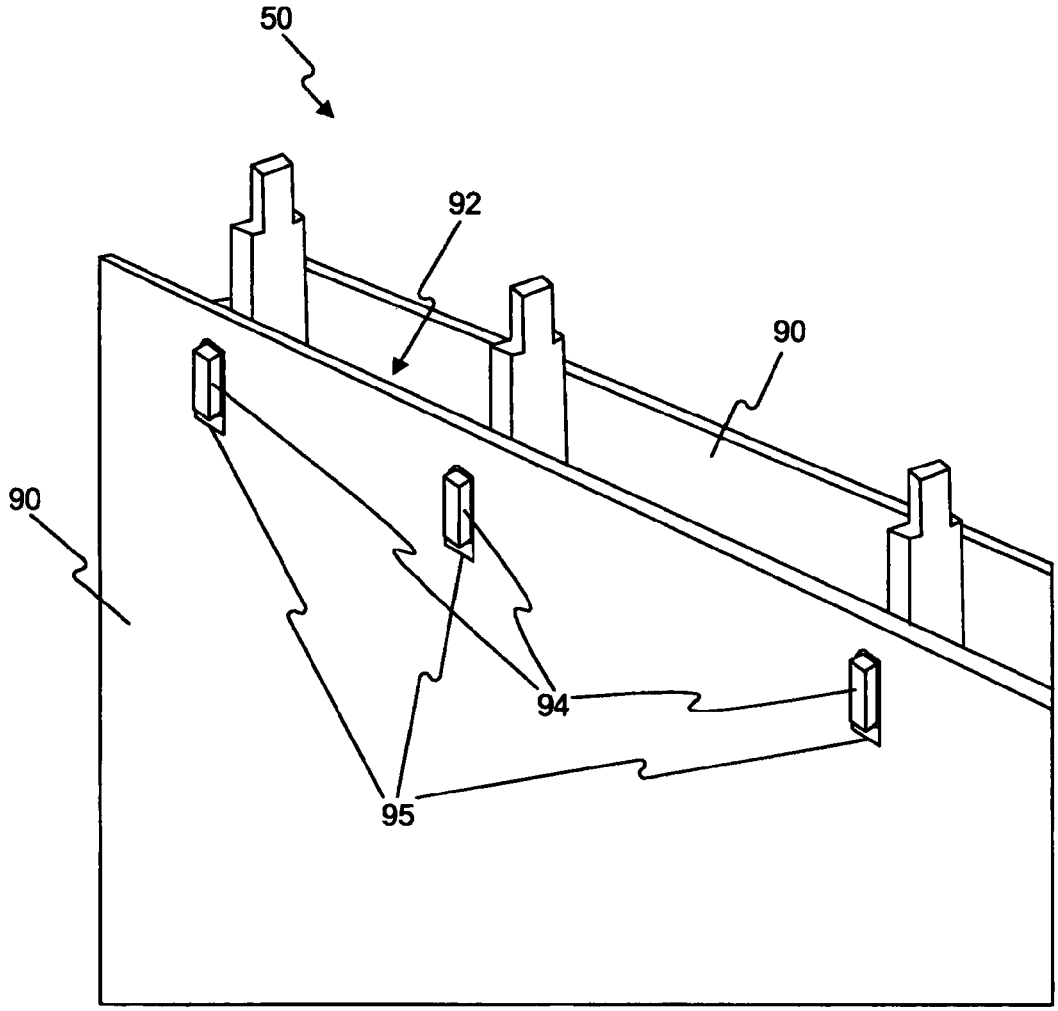
FIG. 10B is a perspective view of an expandable panel in accordance with the present invention in the expanded position and sandwiched between sheathing.

FIG. 10B depicts the exemplary embodiment wherein the expanded panel 50 is provided between sheathing 90. In this embodiment, sheathing 90 may be mounted to the expanded panel 50 by inserting the plurality of tabs 94 of the panel 50 through correspondingly disposed apertures 95 in sheathing 90. In lieu of tabs 94, the panel 50 may include another type of hook, dowel pin, clip, or other mechanism by which sheathing 90 may be sufficiently supported. For instance, in one embodiment, sheathing 90 may be mounted to the panel 50 by the tab portions 55 illustrated in FIGS. 1 and 2.

Sheathing consistent with the present invention may be manufactured from one or more of any suitable type of material. In one embodiment, sheathing 90 may include one or more of plywood, drywall, sheet rock, gypsum board, metal, cloth, foam, insulation, honeycomb, steel, or any composite material. In another embodiment, sheathing 90 may be manufactured from a transparent or translucent material, including but not limited to glass, frosted glass, and plastics such as acrylic. By this embodiment, elements of the expanded panel 50 may be angled or louvered in consideration of the directional orientation of the panel 50 relative to the sun. Accordingly, sunlight into a corresponding structure may be at least partially controlled, as desired.

Alternatively, the embodiment of FIG. 10B may be particularly suitable for constructing concrete load-bearing walls. For example, after attachment of suitably disposable sheathing 90 to the expanded panel 50, cement may be poured into a gap 92 defined between two panels of sheathing 90 and allowed to set. In one embodiment, the interior faces of sheathing 90 may be embossed or otherwise three-dimensionally disposed with indicia, such as patterns, corporate names, logos, advertisements, or specifications. Accordingly, concrete set therein may include such indicia upon removal of the sheathing 90. If desired, segments of the panel 50 may function as built-in reinforcement for the concrete form, if so designed. Moreover, sheathing 90 may be left in place around concrete forms rather than used purely as a preform structure. Sheathing 90 also may be reusable for other cast concrete applications.

In yet another embodiment, insulation may be incorporated into gap 92 by one of several embodiments. For example, insulation may be a spray-in foam variety, such as Icynene®, which expands to fill the gap 92. Insulation may alternatively include loose fill insulation, which is installed to fill specific voids between the expandable panel 50 and sheathing 90. In one preferred embodiment, insulation may be custom, batt insulation, which is preformed to infill the particular shape created upon expansion of the expandable panel 50. Insulation may also include sheets of insulation which are installed, such as by adhesive, to the outer or inner face of sheathing 90. By such embodiments, installation of insulation may be substantially easier and more cost effective in terms of reduced man-hours.

Figure 11A:
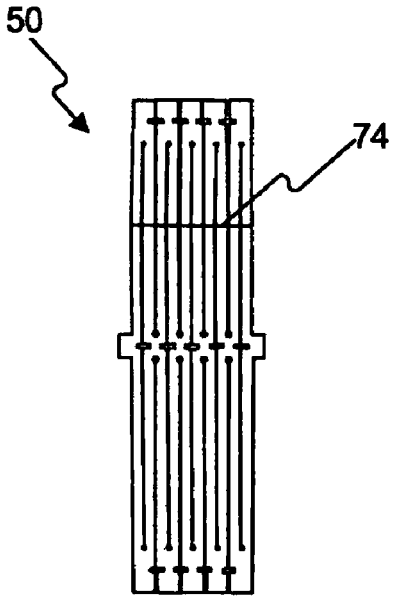
FIG. 11A is a front view of an expandable panel in accordance with the present invention, being in the nonexpanded position and having a generally horizontal crease.
Figure 11B:
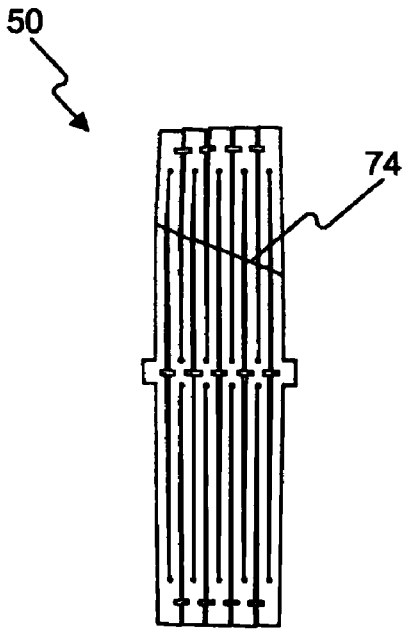
FIG. 11B is a front view of an expandable panel in accordance with the present invention, being in the nonexpanded position and having a generally diagonal crease.

FIG. 11A depicts yet another exemplary embodiment of the expandable panel 50 that has a horizontal crease (alternatively referred to as a "fold line") 74 intermediate the central portion 57 and the first distal end 58. FIG. 11B depicts yet another exemplary embodiment of the expandable panel 50 wherein the crease 74 may be diagonal instead of horizontal. Horizontal or diagonal creases 74 may allow the expandable panel 50 to be expanded into a desired overhanging panel configuration. In one embodiment, the horizontal and/or diagonal creases 74 may be staggered from one segment of the panel 50 to another in order to generate a desired form of the expanded panel 50.

Figure 11C:
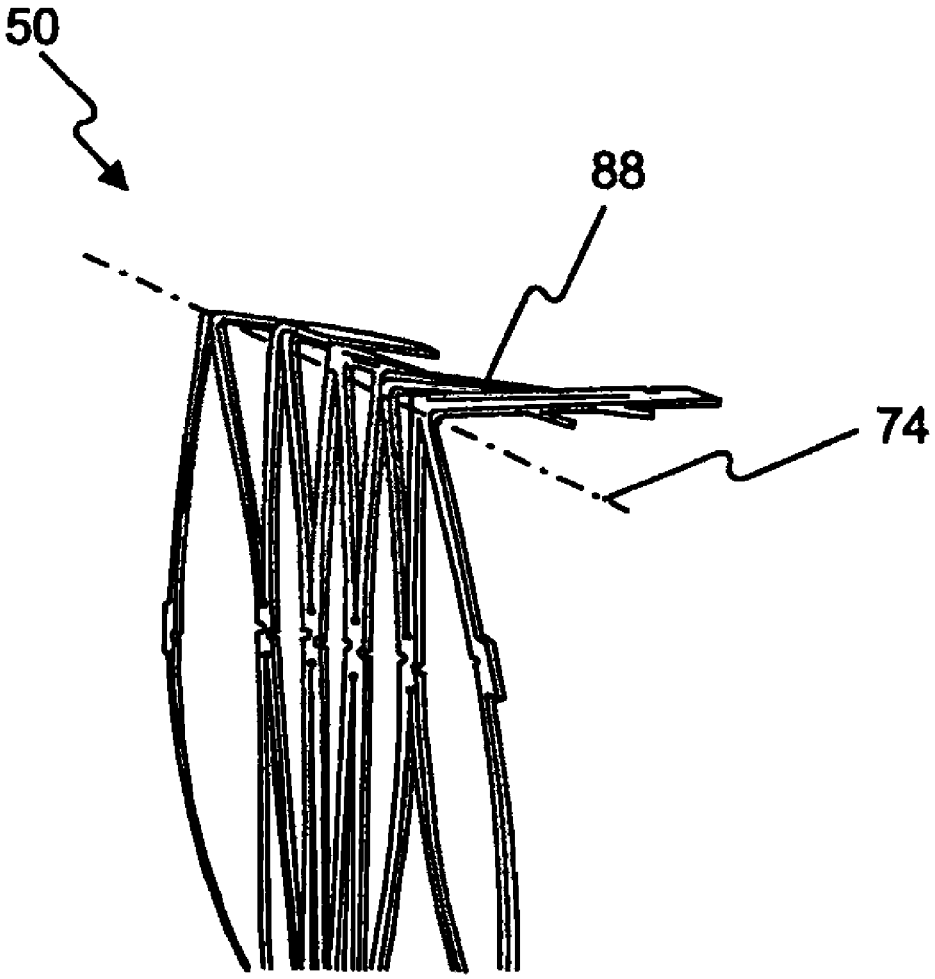
FIG. 11C is a perspective view of an expandable panel in accordance with the present invention, being in the expanded position, and having a crease and roof support members that are bent about the crease.

FIG. 11C depicts an embodiment of the expandable panel 50 in which an upper portion of the panel 50 has been bent, such as along a crease 74, to define a plurality of generally right-angle roof support members 88. As shown in FIG. 11C, the roof support members 88 may be expanded in a manner consistent with expansion of the rest of the panel 50. As will be described below, the roof support members 88 may include fixing means at distal ends of each segment for the purpose of being joined to another expandable panel 50. Alternatively, the roof support members 88 may be configured to accept any other conventional roof truss members or flooring.

Figure 12A:
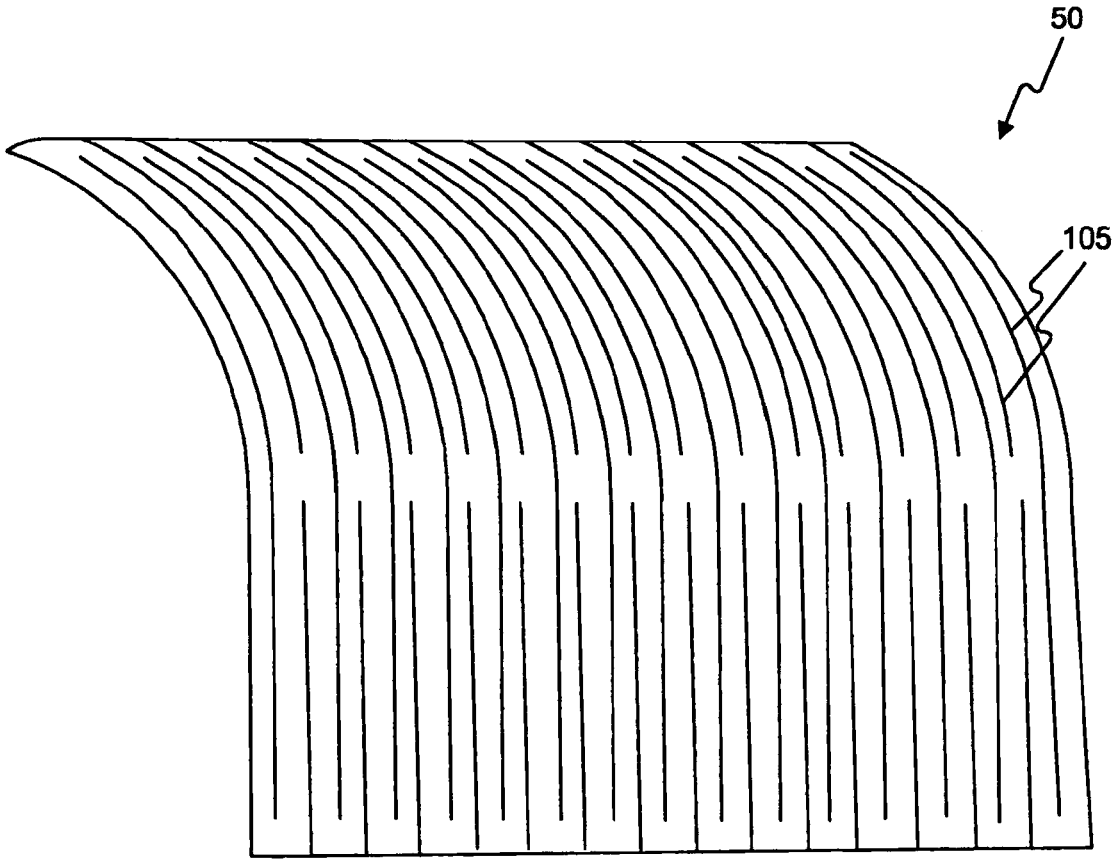
FIG. 12A is a front view of an alternative embodiment of an expandable panel in accordance with the present invention, being in the nonexpanded position and having a plurality of curved cuts.
Figure 12B:
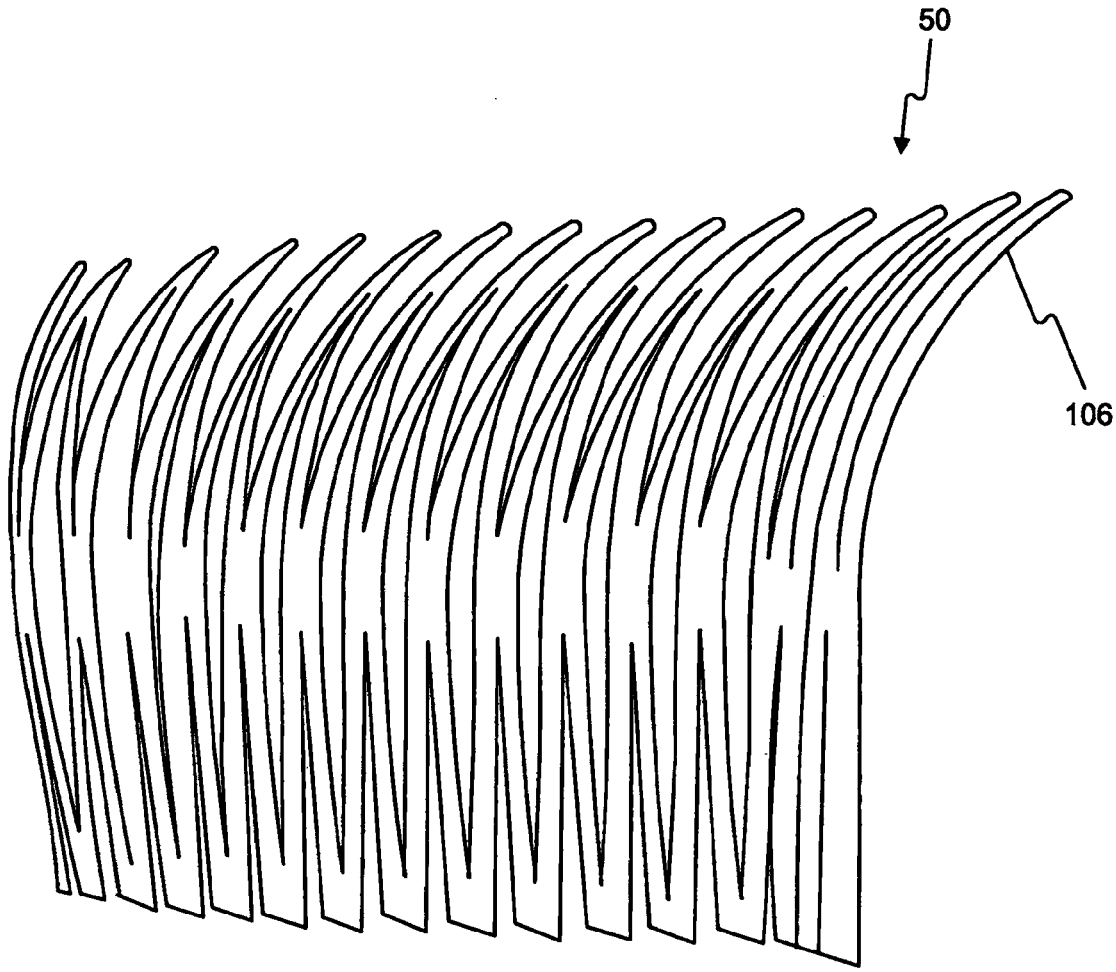
FIG. 12B is a perspective view of the alternative embodiment of FIG. 12A, being in the expanded position and forming an arched canopy.

As an alternative to bending a portion of the expandable panel 50 about a crease, the panel 50 may be manufactured to naturally form an arched canopy or roof support portion. For example, as depicted in FIG. 12A, the expandable panel 50 may be manufactured to include a curved shape having curved cuts 105. The overall shape of the expandable panel 50 and the curved cuts 105 may be particularly designed using a computer. The actual curved cuts 105 may be manufactured using conventional machines, such as computer numerical controlled ("CNC") milling machines, or more preferably by advanced manufacturing techniques such as water-jet machining or laser cutting. Accordingly, such an expandable panel 50 may be expanded to create an arched canopy 106, as shown in FIG. 12B.

Figure 13A:
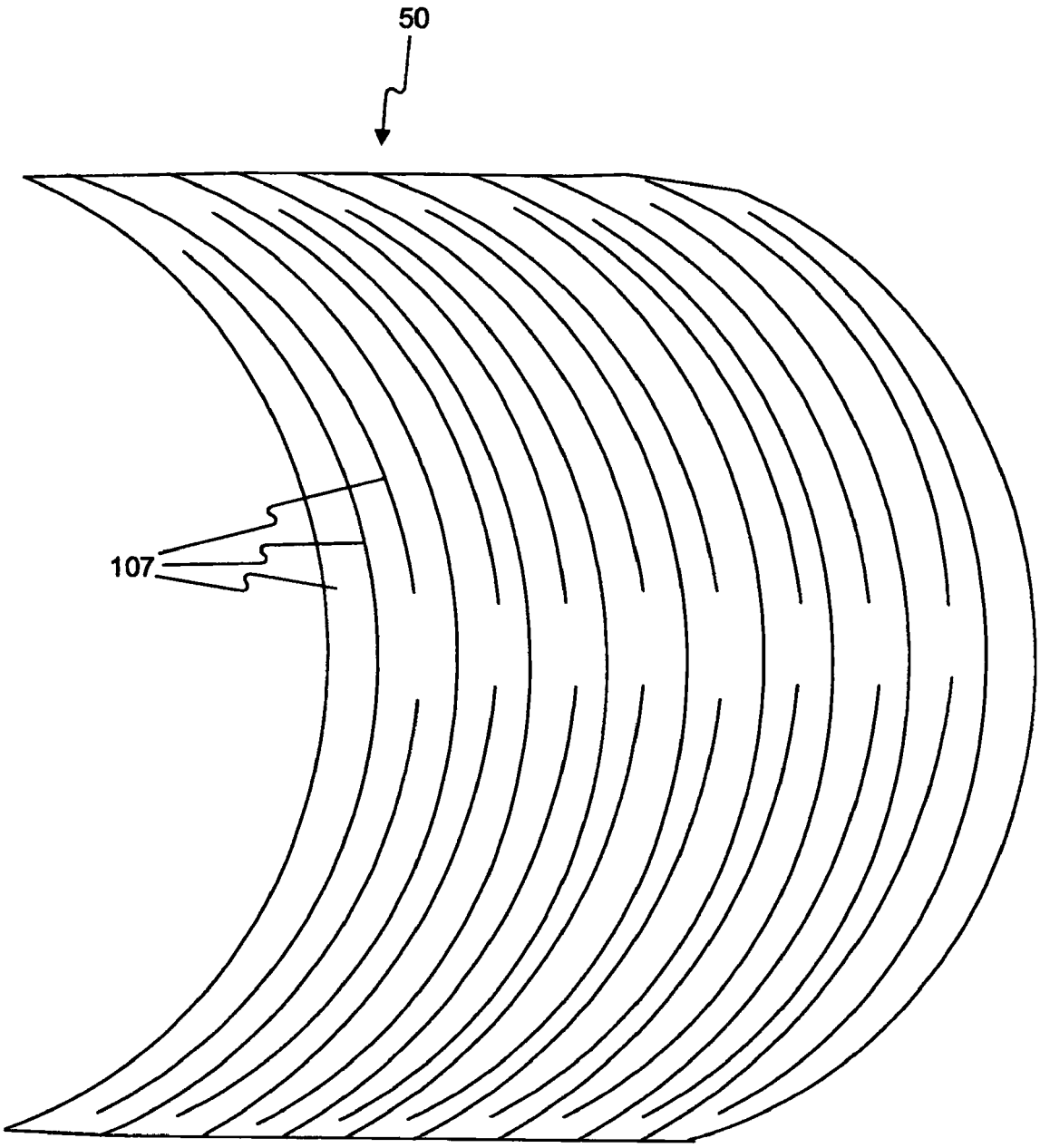
FIG. 13A is a front view of an alternative embodiment of an expandable panel in accordance with the present invention, being in the nonexpanded position and having a plurality of arched cuts.
Figure 13B:
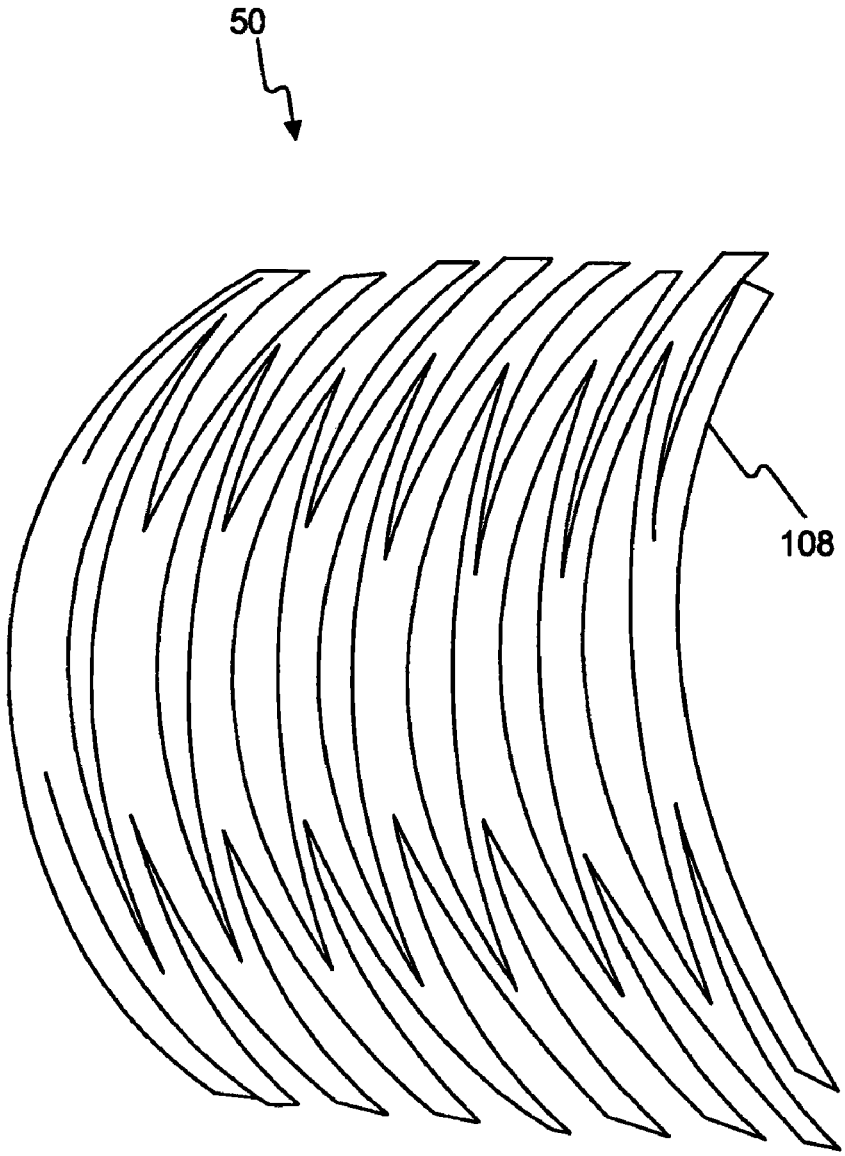
FIG. 13B is a perspective view of the alternative embodiment of FIG. 13A, being in the expanded position and forming an arch support.

FIG. 13A depicts yet another embodiment of the expandable panel 50 that includes a generally arch-shaped panel having a plurality of arched cuts 107. Accordingly, such an expandable panel 50 may be expanded to create an arch support 108, as shown in FIG. 13B. In one embodiment, the arch support 108 may be disposed in a horizontal orientation to function as a roof support, such as a barrel vault. As will be appreciated by one of skill in the art, such variations in shape of the expandable panel 50 and the plurality of spaced cuts 60, 105, or 107 therein may be altered to create the desired architectural, aesthetic, and/or load-bearing structures.

Figure 14A:
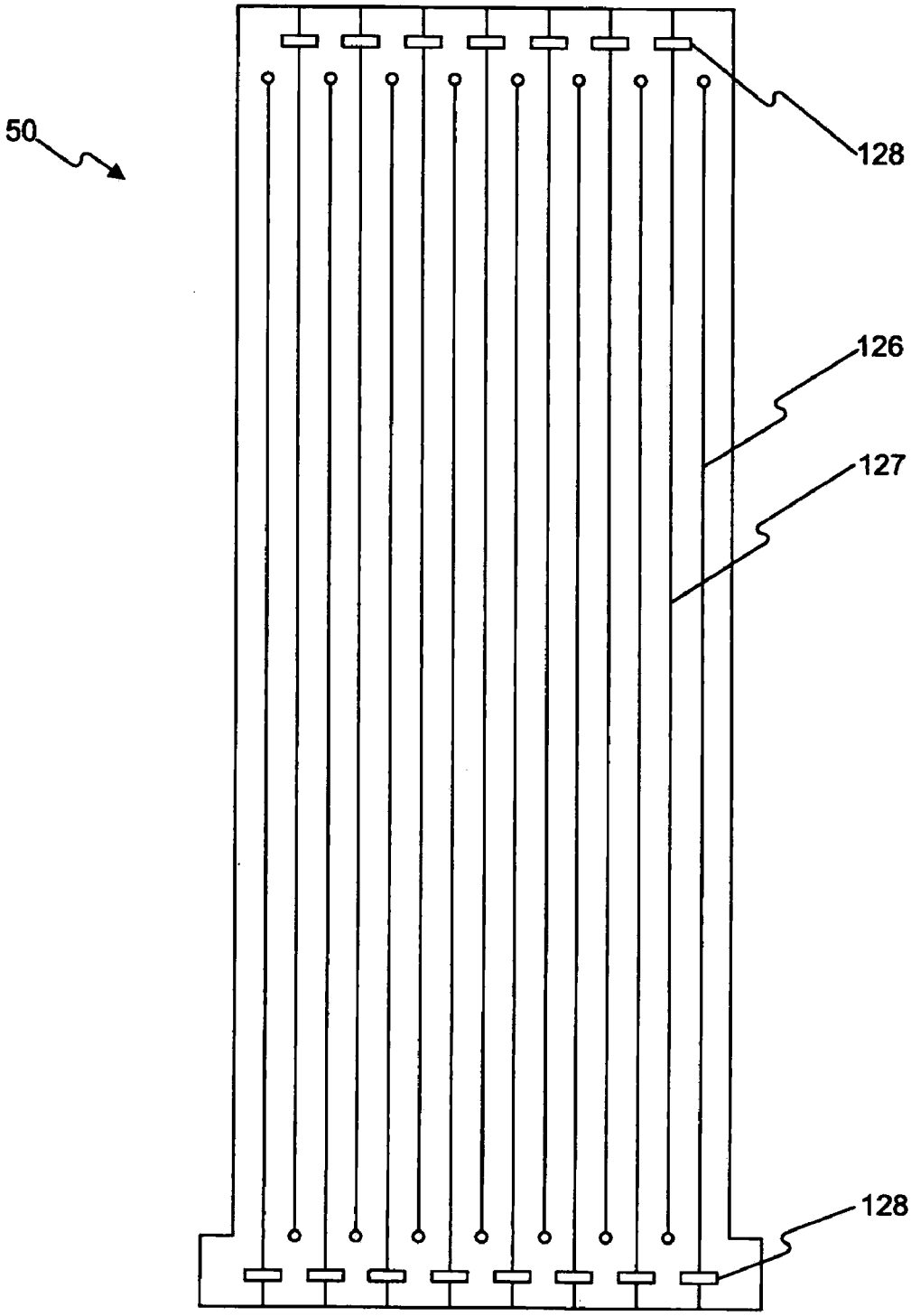
FIGS. 14A-14C are front views of alternative embodiments of expandable panels in accordance with the present invention in nonexpanded positions.
Figure 14B:
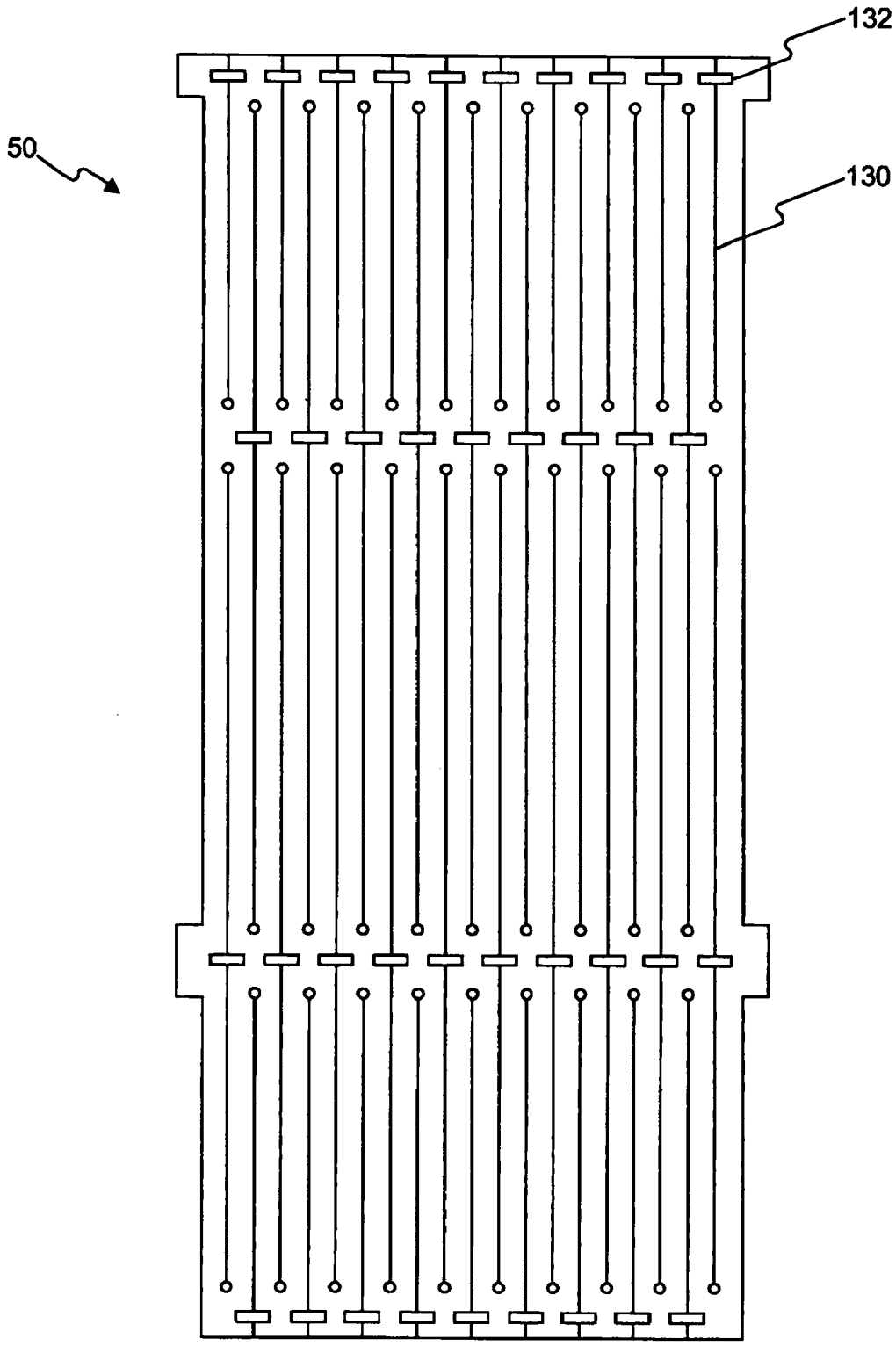
Figure 14C:
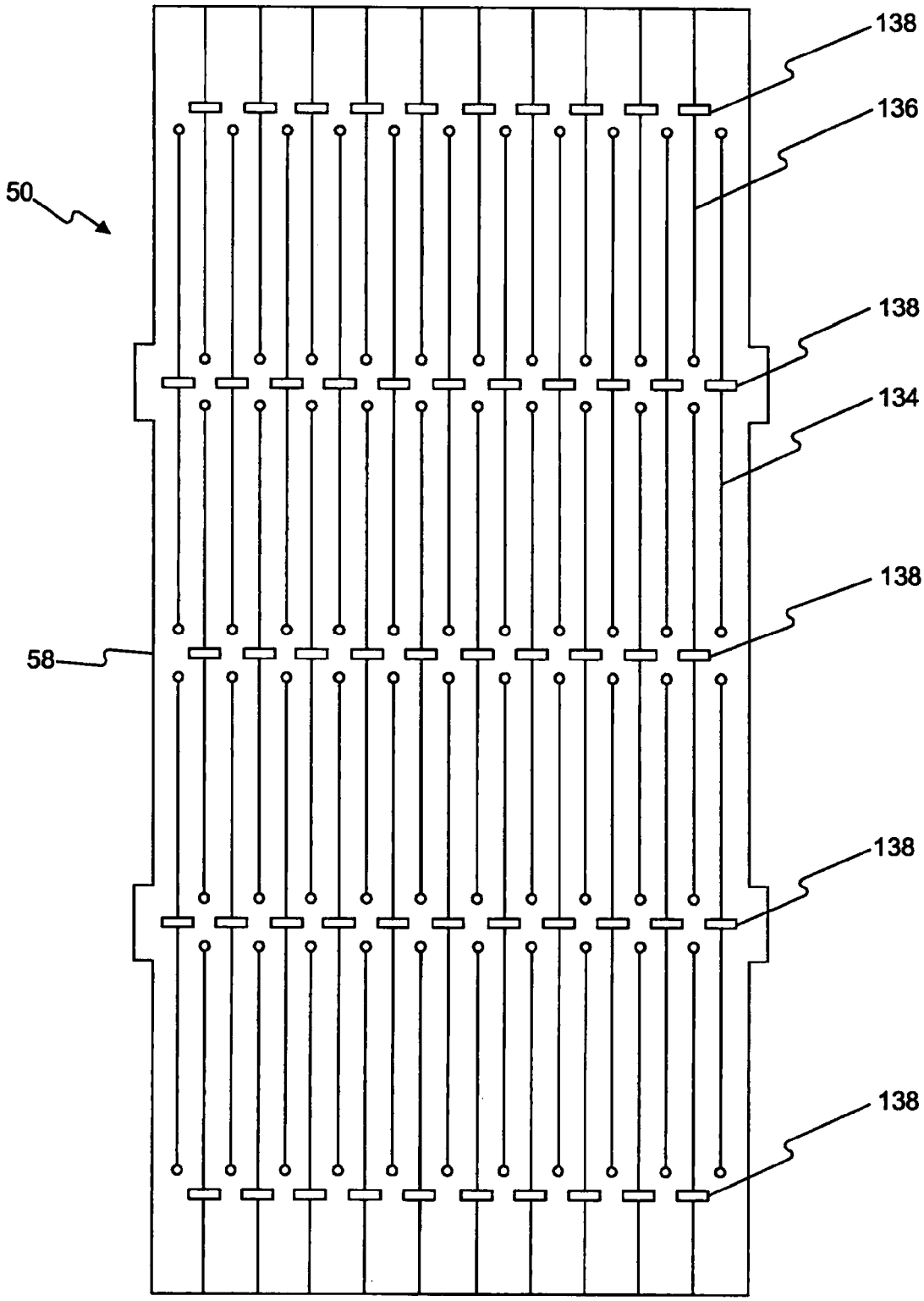

FIGS. 14A-C depict still further alternative embodiments of the expandable panel 50. For example, FIG. 14A illustrates an embodiment of the expandable panel 50 in which only two alternating series of generally parallel cuts 126, 127 may be disposed in the panel 50. Moreover, only two series of gaps 128 may be incorporated, with one line of gaps 128 being disposed at each distal end of the panel 50. Accordingly, as will be appreciated by one of skill in the art, the resulting expanded panel may be a simply alternating, stepped panel, which may be held in its expanded position by a line of connectors at each of its distal ends. This embodiment may be referred to as a "single zig-zag" expandable panel.

FIG. 14B illustrates an embodiment of the expandable panel 50 in which an additional series of generally parallel cuts 130 may be included, relative to the expandable panel 50 illustrated in FIG. 1. The expandable panel 50 also may include an additional series of gaps 132. In this embodiment, the resulting expanded panel may be similar in nature to the expanded panel of FIG. 2B but may effectively include an additional half of the panel 50 protruding from one of its distal ends. Thus, the so-called "triple zig-zag" expandable panel 50 may either be longer than those of previous embodiments, or it may have shorter parallel cuts and segments.

FIG. 14C illustrates an embodiment of the expandable panel 50 in which the expandable panel of FIG. 1 may be essentially doubled (i.e., mirrored about a distal end, such as the first distal end 58, of the panel). Therefore, the expandable panel may include two additional series of generally parallel cuts 134, 136, as well as five overall lines of gaps 138. The resulting "quadruple zig-zag" expandable panel 50 may be either longer than those of previous embodiments, or it may have shorter parallel cuts and segments. These and other variations on the particularly disclosed expanded panels 50 will become apparent to one of ordinary skill in the art upon study of the present disclosure. That is, alternative arrangements of cuts, apertures, and segments are not limited to the embodiments recited herein, and are contemplated within the scope of the present invention.

Figure 15A:
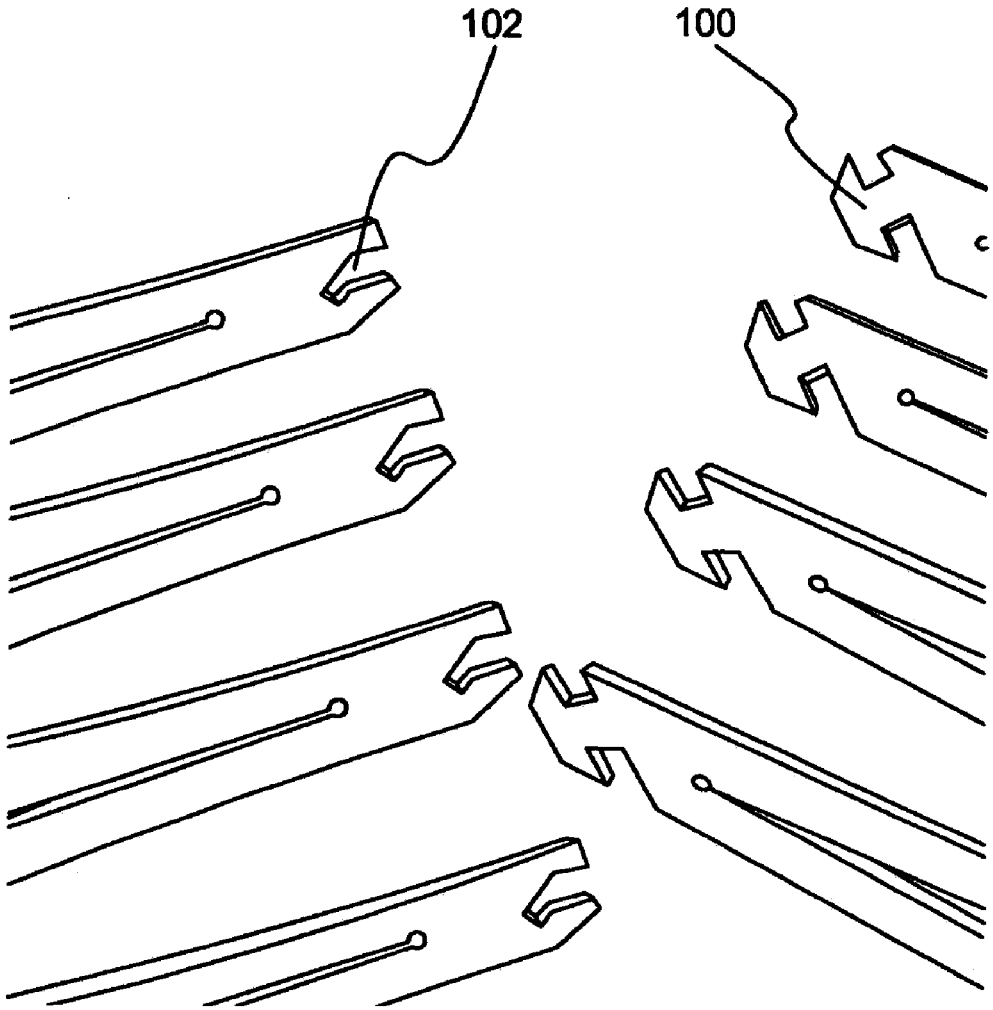
FIGS. 15A-15E are perspective views depicting fixing means in distal ends of the expandable panels used to fix expandable panels together.
Figure 15B:
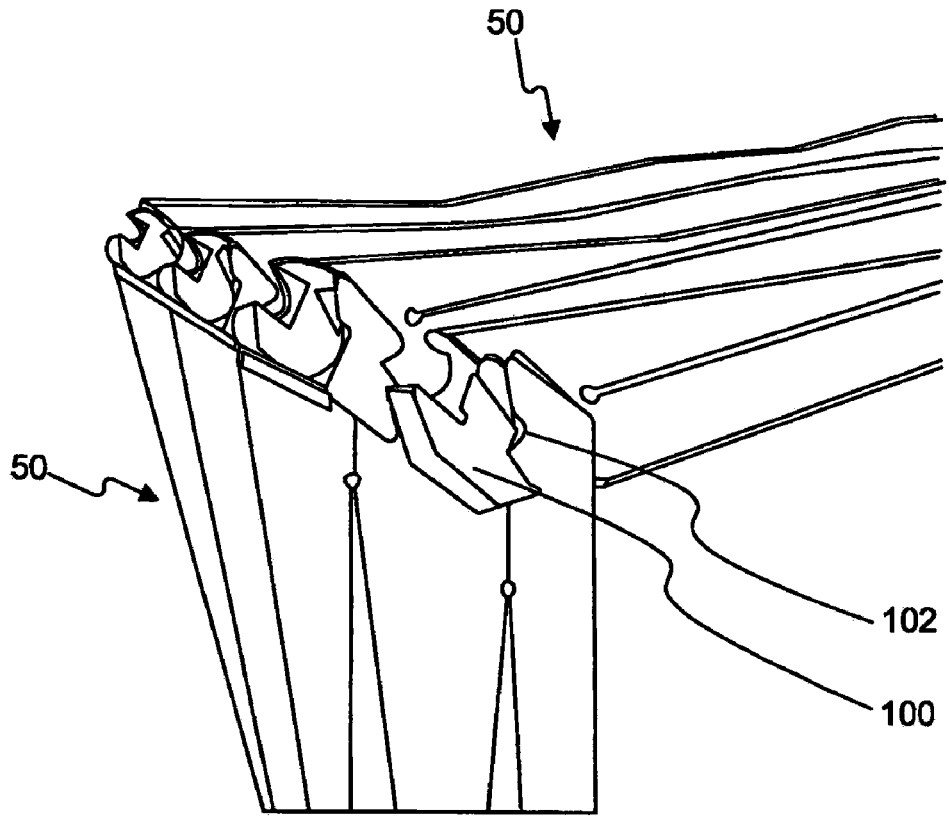
Figure 15C:
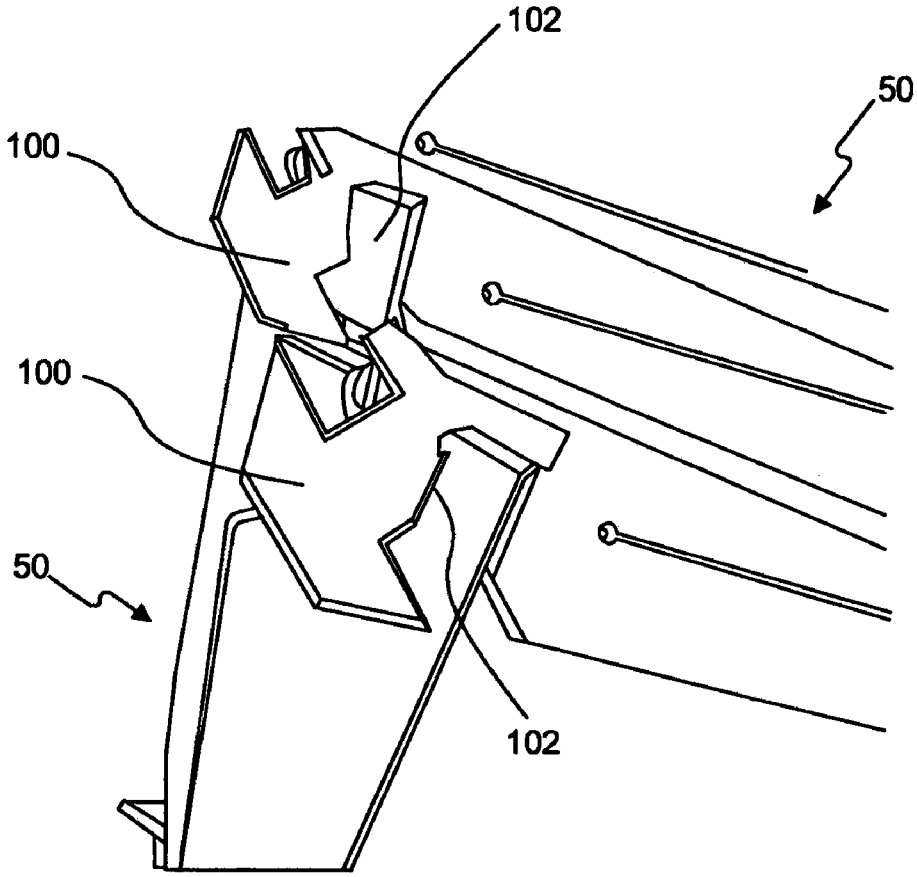
Figure 15D:
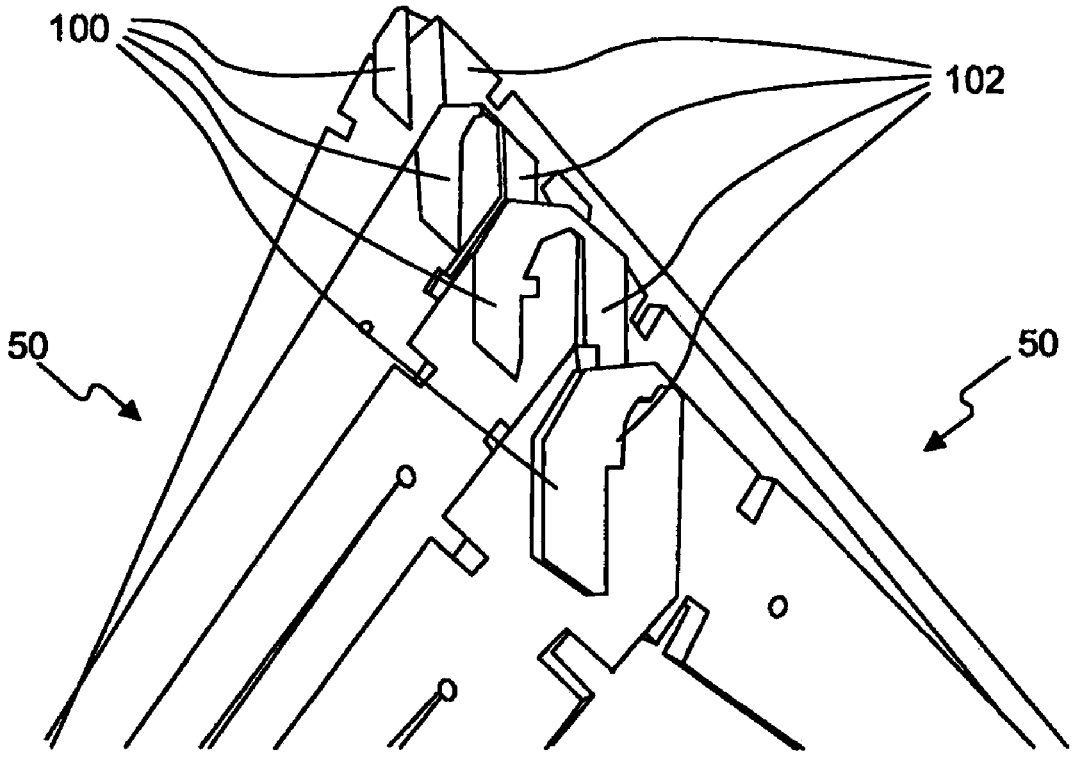
Figure 15E:
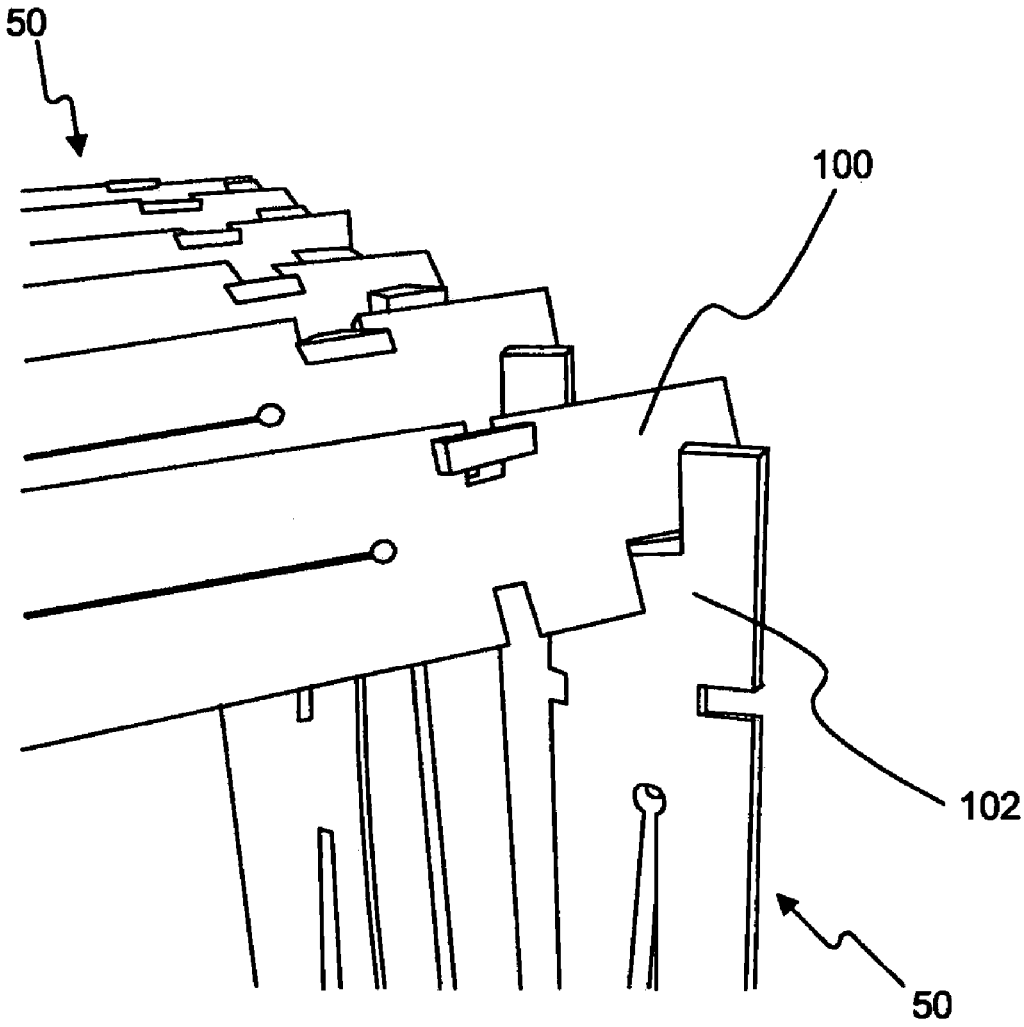

FIGS. 15A-E depict fixing means in distal ends of the expandable panels 50 for connecting expandable panels 50 together. Specifically, referring back to FIG. 2A, each first distal end joint 116 and/or second distal end joint 118 of each segment 110, 112, 114 may include a fixing means for connecting various modular expanded panels 50 together by their first and/or second distal ends 58, 59. As illustrated in FIG. 15A, each segment of the panel 50 may include at least one of a male connector 100 and a female receptor 102. As illustrated, the male connectors 100 and the female receptors 102 may be tongue and groove mechanisms that form mating engagements between the respective distal ends of the panels 50. FIGS. 15B-E illustrate embodiments in which the panels 50 are joined by the male connectors 100 and the female receptors 102. The panels 50 also may be joined to each other in various configurations by use of the tab portions 55. In these embodiments, already expanded and assembled panels 50 may be in modular form and therefore suitable for interconnection between themselves and other building components. Accordingly, the presently disclosed expandable panel 50 may become one component of a comprehensive and mass-produced modular building system.

The expandable panel 50, consistent with the present invention, may be manufactured from one or more of any suitable type of material. For example, expandable panels may be made out of plywood, such as birch, fir, meranti, or bamboo plywood. Plywood may be selected depending on various levels of quality, taking into consideration factors such as knots, gap widths between plys, glue quality, and supplier. Plywood may be selected having relatively thinner plys and high-quality glue in the interest of increased panel flexibility. Plywood that has a thickness of approximately 0.25" to 0.75" may be used depending on the nature of its use (e.g., interior versus exterior wall). In some embodiments, several sheets of thinner plywood may be layered to increase its load-bearing functionality. Moreover, plywood may be selected depending on grain orientation. In a preferred embodiment, plywood may be selected having wood grain running in a longitudinal axis of the expandable panel, in order to strengthen the panel against transverse bending.

Expandable panels also may be made from plastics such as polyethylene, polycarbonate, and the like. Expandable panels may, in some embodiments, be made from metals or metal alloys, including steel, stainless steel, and aluminum. In another embodiment, expandable panels may be made from composite materials, such as fiberglass, carbon fiber, or composites of plastics or wood. In a still further embodiment, expandable panels may be made from recycled materials of one or more of the aforementioned materials.

Methods for manufacturing expandable panels consistent with the present invention may include conventional and/or relatively advanced techniques. For example, any suitable technique may be selected depending on factors such as materials, costs, blank size, and time constraints. Expandable panels may be initially designed using a computer. For example, software operating on a computer, such as computer aided drafting ("CAD") software, may be used to create drawing files of preferable shapes for expandable panels. In some embodiments, CAD software may be used in combination with computer aided manufacturing ("CAM") software. Cutting paths and speeds may be input by a user on the computer or the cutting machine, or automatically generated by software operating on either device. In one embodiment, particularly designed cuts may be programmed using CAD modeling software. Resulting drawing files may be transferred to a cutting machine.

In one embodiment, expandable panel 50 may be manufactured by a CNC milling machine. By this embodiment, well-tested methods may be used to program and cut slots into the expandable panel 50. However, due to substantial material loss from a saw, sometimes as much as 0.5 inches, more advanced techniques may be desired. For example, in other embodiments, expandable panel 50 may be manufactured with a water jet-cutting machine or laser-cutting machine, both of which offer material loss approximately one-tenth (e.g., approximately 0.032" in certain water jet-cutting machines) of that experienced with CNC machines. Such precise manufacturing may be advantageous in embodiments of the present invention in which cuts and gaps approach relatively small dimensions. Moreover, reduced material loss may be desired when forming precise stress-propagation inhibiting features, such as at apertures 63, 65, 69, and 70. Expandable panel 50 also may be manufactured in mass-production by one or more radial dies.

Once manufactured and assembled, the exemplary expandable panel 50 may be oriented such that the cuts 60 extend either vertically or horizontally. For example, the expandable panel 50 may form a large wall section that extends from floor to ceiling. The expandable panel 50 may have formed therein spaces for elements such as windows and doors. In certain embodiments, the expandable panel 50 may be expanded by varying amounts at distinct locations along the length of the panel 50 to account for these features.

The characteristics and features of the presently disclosed exemplary expandable panel and assembly provide numerous advantages. For instance, in their unassembled (i.e., nonexpanded) position, numerous expandable panels 50 may be stacked in relatively lesser volume due to the initially flat sheet configuration of the panels 50. Accordingly, storage and shipping costs are reduced, and fewer trips are required for transporting building materials to the job site.

In addition, because the exemplary expandable panels 50 may be mass-produced in a machine shop or factory, and because they require little further assembly, relatively unskilled labor may be employed in the final stages of panel assembly and installation. For example, assembly may include a relatively simple method of snapping together panels and connectors without the need for material removal processes. Furthermore, use of the expandable panel 50 may be advantageous in applications requiring eventual un-installation since the panel 50 may be retracted and re-stored in its nonexpanded position. Therefore, the disclosed expandable panel 50 may be particularly well-suited for use in structures, such as emergency shelters, low-income housing, temporary barriers, signage, tents, stages, and pavilions. For example, a structure formed from the expandable panels 50 may be covered by a canvas tarpaulin or additional sheets of plywood with relative ease and cost-efficiency.

Moreover, because an assembly including the expandable panel 50 may be relatively flexible, a wall or other support including it may be particularly well-suited in applications subject to substantial vibrations, such as those in construction and earthquake zones. For example, upon selection of the appropriate materials and inclusion of particular stress-mitigating features, an earthquake-proof structure may be formed by assembly of one or more of the expandable panels 50.

Figure 16A:
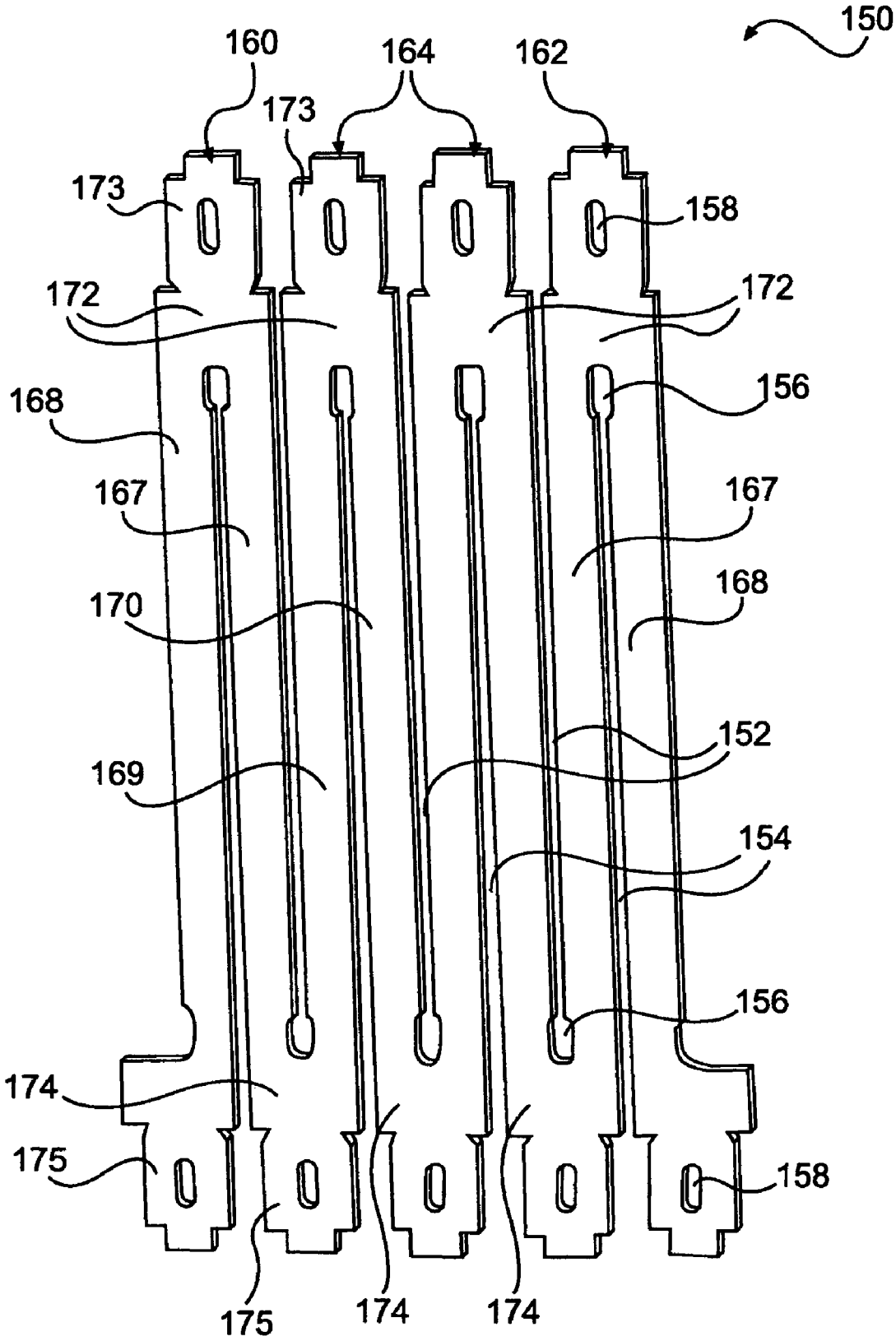
FIG. 16A is a perspective view depicting a nonexpanded panel member conducive to multi-tiered assembly and consistent with the present invention.
Figure 16B:
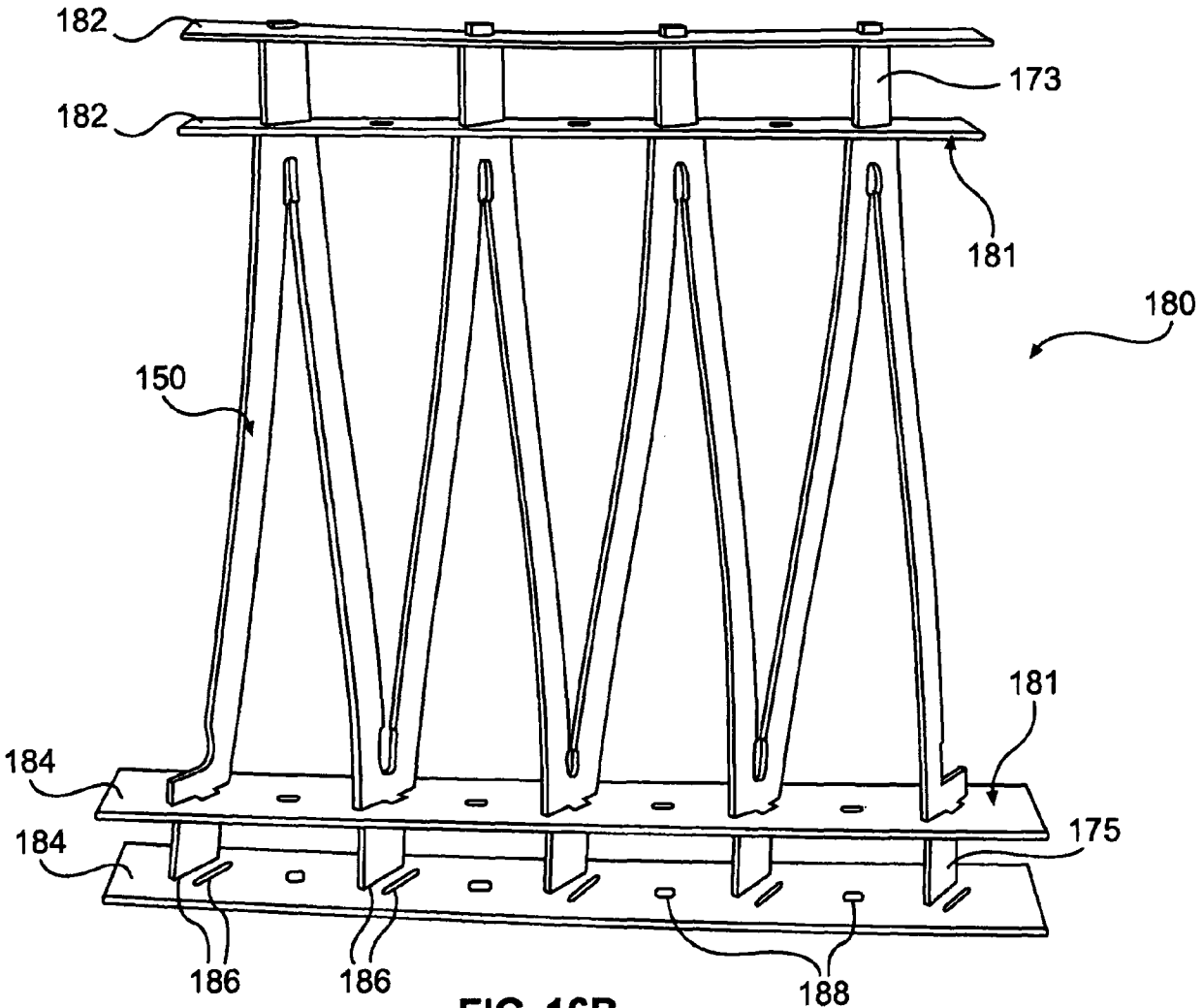
FIG. 16B is a perspective view of a panel assembly conducive to multi-tiered assembly and including a panel member and support structure consistent with the present invention.
Figure 16C:
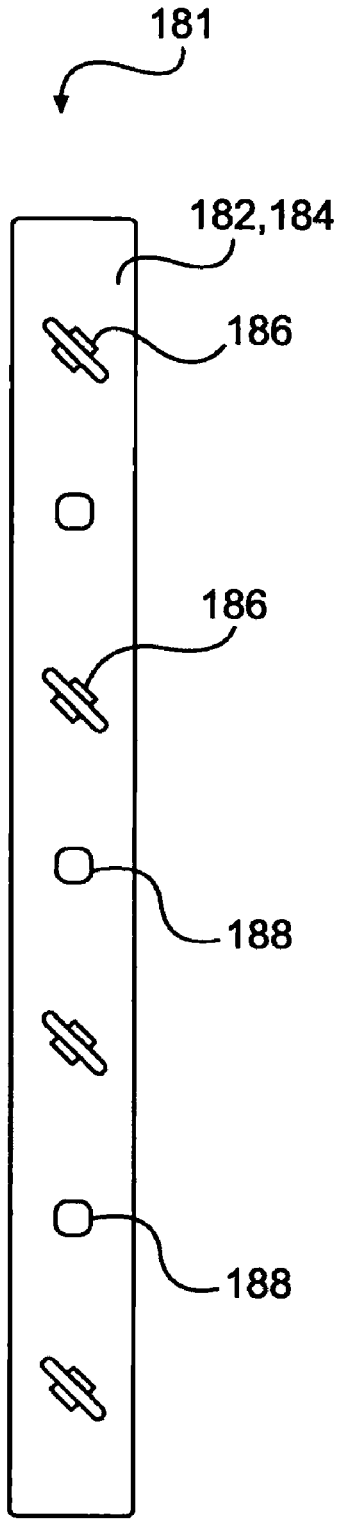
FIG. 16C is a top view of a support structure consistent with the present invention.
Figure 17B:
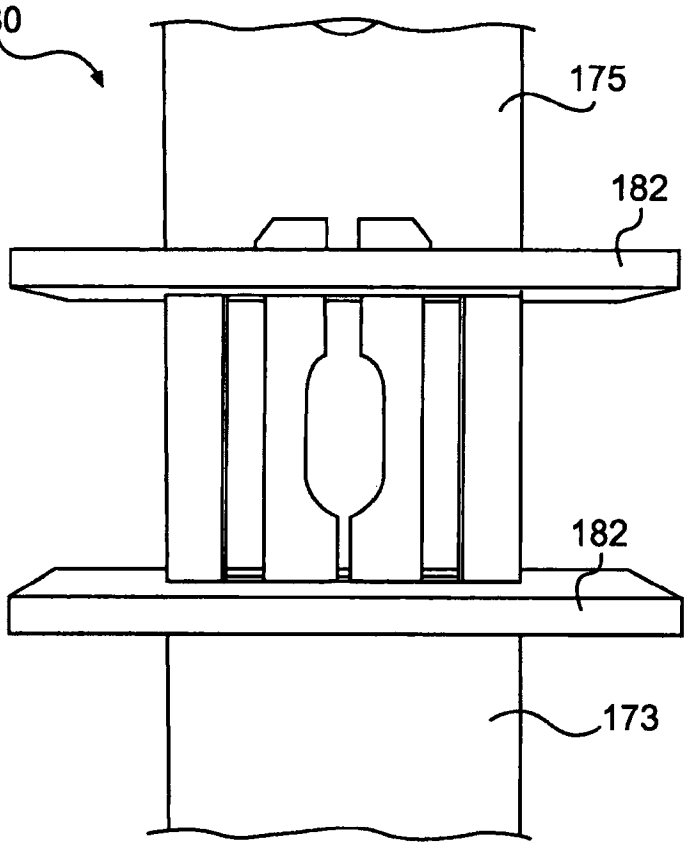
FIGS. 17A-B depict front views of one embodiment of tab connectors consistent with the present invention.
Figure 17A:
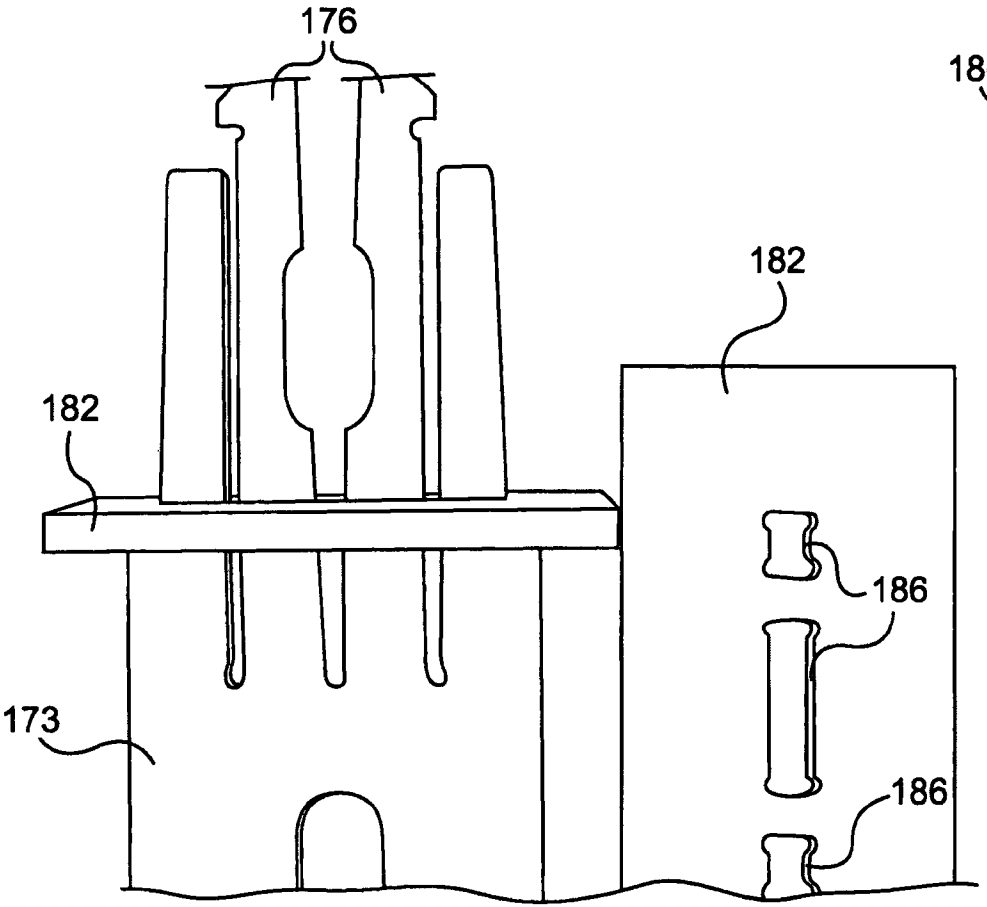

FIGS. 16A-16C illustrate a further embodiment of an expandable panel conducive to assembly in multi-tiered building applications. Specifically, FIG. 16A depicts a perspective view of a panel member 150, which is similar to the "single zig-zag" expandable panel described with respect to FIG. 14A. The panel member 150 may include a sheet of material having a substantially planar portion having front and rear surfaces, right and left side edges, and first and second distal ends. The panel member 150 may have formed therein a plurality of spaced, substantially parallel apertures through the panel portion from the front surface to the rear surface. Specifically, the panel member 150 may include a first pattern of cuts 152, a second pattern of cuts 154, a pattern of joint apertures 156, and a pattern of tab apertures 158. The first pattern of cuts 152 may extend from the first distal end to a row of the joint apertures 156 spaced inward from the second distal end. The second pattern of cuts 154 may extend from the second distal end to a row of the joint apertures 156 spaced inward from the first distal end.

The arrangement of cuts and apertures, as illustrated in FIG. 16A, may thereby define a pattern of legs, a pattern of tabs, and a pair of first and second panel surfaces facing each other. Specifically, the panel member 150 may include a first side segment 160, a second side segment 162, and one or more inner segments 164 disposed therebetween. Each of the first and second side segments 160, 162 may include an inner leg 167 and an outer leg 168. Each of inner segments 164 may include a first leg 169 and a second leg 170. Each of the segments 160, 162, 164 also may be associated with at least one first end joint 172 and at least one second end joint 174. The two legs of each segment may be joined to each other by one of the first and second end joints 172, 174. Moreover, each of the segments 160, 162, 164 may be joined to at least one other adjacent segment via an intermediate one of the first or second end joints 172, 174.

Each of the first end joints 172 may have, protruding therefrom, a first tab 173. Each of the second end joints 174 may have, protruding therefrom, a second tab 175. Accordingly, each of the segments 160, 162, 164 may be associated with at least one of the first tabs 173 and at least one of the second tabs 175. Likewise, each of the legs may be associated with one of the first tabs 173 and one of the second tabs 175. The first and second tabs 173, 175 may include a pattern of tab apertures 158. Specifically, each of the first and second tabs 173, 175 may include one through-hole configured to allow building materials, such as pipes and wires, to pass through the panel member 150.

The panel member 150 may be expanded by pulling the first side segment 160 and the second side segment 162 away from each other. Specifically, the panel member 150 may be pulled apart such that the two legs of each segment 160, 162, 164 bend or bow, thereby separating from each other and expanding the panel in a direction transverse to the pattern of cuts 152, 154 that define the legs. Because the two legs of each segment are joined at their ends by a respective one of the first and second end joints 172, 174, and because the two legs of each segment bend or bow in opposite directions, the first and second end joints 172, 174 may be subjected to bending, compression, and/or torsional forces.

FIG. 16B illustrates the panel member 150 of FIG. 16A when it is expanded and retained in its expanded position by a support structure 181 to form a panel assembly 180. Specifically, the panel assembly 180 is depicted as including the panel member 150 being held in its expanded position by the support structure 181 illustrated in FIG. 16C. FIG. 16C depicts one embodiment of the support structure 181 including one of a first and second end plates 182, 184. The first and second end plates 182, 184 may be substantially planar strips of material, which have been cut to a length consistent with the length of the panel member 150 in its expanded position.

Moreover, each of the first and second end plates 182, 184 may be provided with a plurality of spaced apart apertures 186 for accepting the first and second tabs 173, 175 of the panel member 150. The apertures 186 may be spaced apart at intervals consistent with the relative locations of the first and second tabs 173, 175, when the panel member 150 is expanded. The apertures 186 also may be sized and shaped to accommodate one or two of the tabs 173, 175. Each of the first and second end plates 182, 184 also may include a plurality of spaced apart apertures 188, which are configured to allow building materials that are running through the panel assembly 180, such as pipes and wires, to pass through the otherwise obstructing first and second end plates 182, 184.

FIGS. 17A-19B illustrate various embodiments of the first and second tabs 173, 175, and their mechanisms for engaging the first and second end plates 182, 184. For example, FIG.

17A illustrates one embodiment of a panel member 150 having a first tab 173 in which a plurality of cuts define a plurality of elongate resilient members 176. The elongate resilient members 176 are depicted as engaging the apertures 186 disposed in one of the first or second end plates 182, 184. In the embodiment illustrated in FIG. 17B, the first tab 173 of a first panel member is shown engaging two parallel, horizontal first end plates 182 from a first direction, while the second tab 175 of a second panel member is shown engaging the two first end plates 182 from an opposite direction. By this embodiment, the two panel members 150 are joined by the first end plates 182 to form a panel assembly 180, in which both of the panel members 150 are retained in their expanded positions, and joined to form a tiered building structure. It is contemplated that such an arrangement may be extrapolated to form any size or shape of building structure comprising an assembly of joined-together panel members and support structures.

Figure 18B:
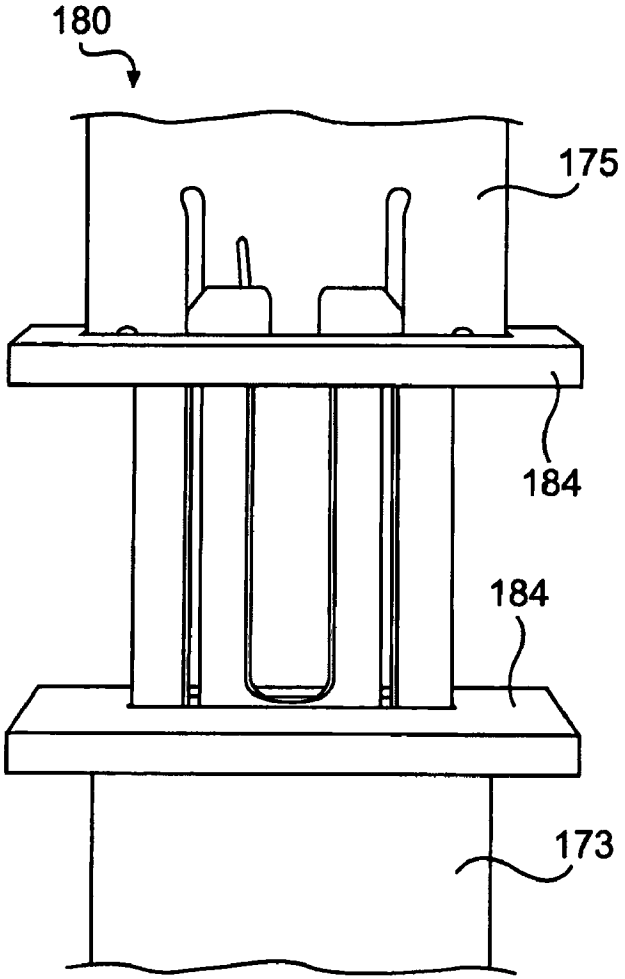
FIGS. 18A-B depict front views of another embodiment of tab connectors consistent with the present invention.
Figure 18A:
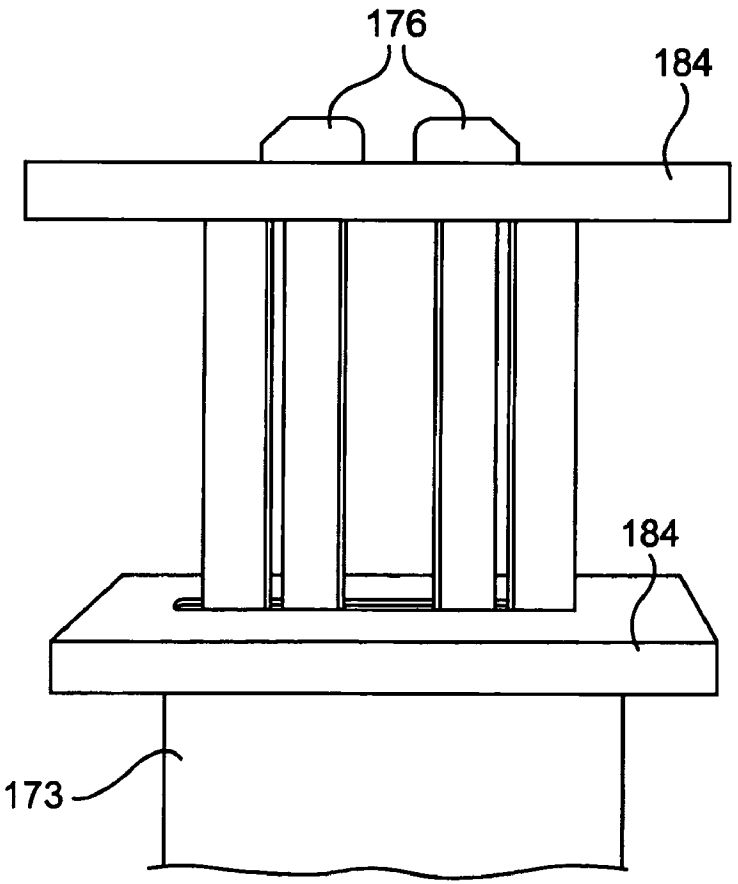

For example, FIGS. 18A-B illustrate another embodiment of elongate resilient members 176, in this case configured to engage the apertures 186 of two second end plates 184. In this embodiment, the second tab 175 of the first panel member is connected to the first tab 173 of a third panel member via the two second end plates 184.

Figure 19B:
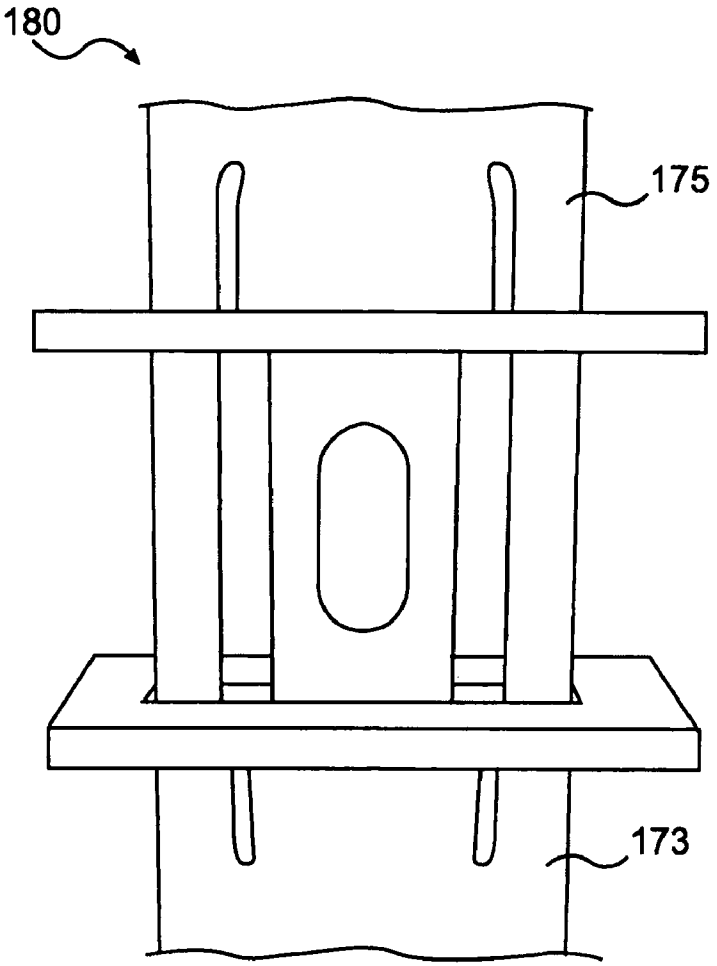
FIGS. 19A-B depict front views of yet another embodiment of tab connectors consistent with the present invention.
Figure 19A:
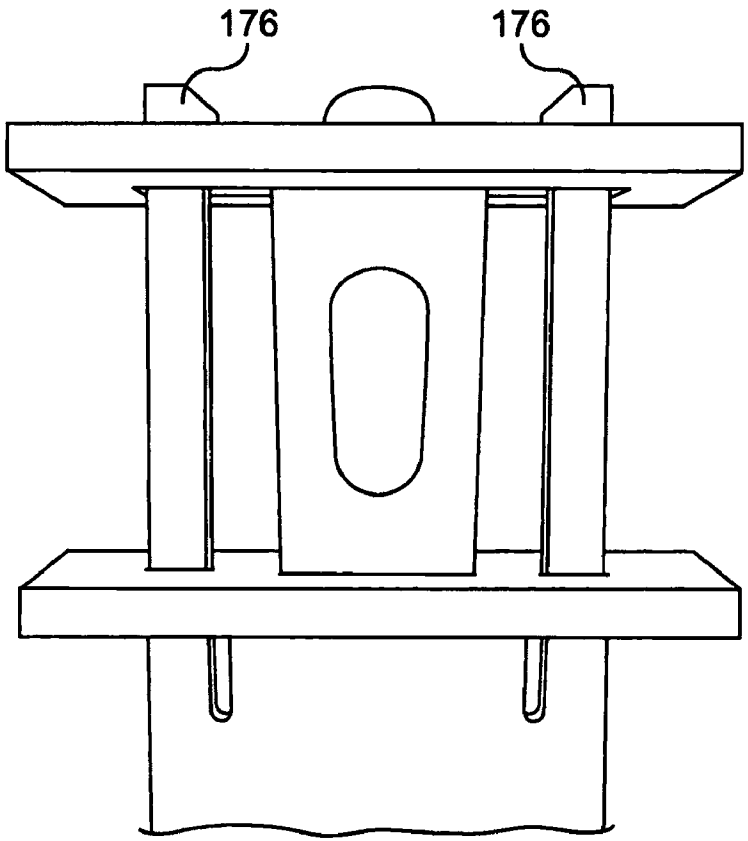

FIGS. 19A-19B illustrate yet another embodiment of elongate resilient members 176 configured to engage the apertures 186 of an end plate, thereby forming a panel assembly 180. As will be appreciated by one of skill in the art, any known configuration of locking mechanism may be used to positively engage the panel members 150 with the support structures to create a panel assembly 180, and are contemplated as being within the scope of this disclosure.

Figure 20:
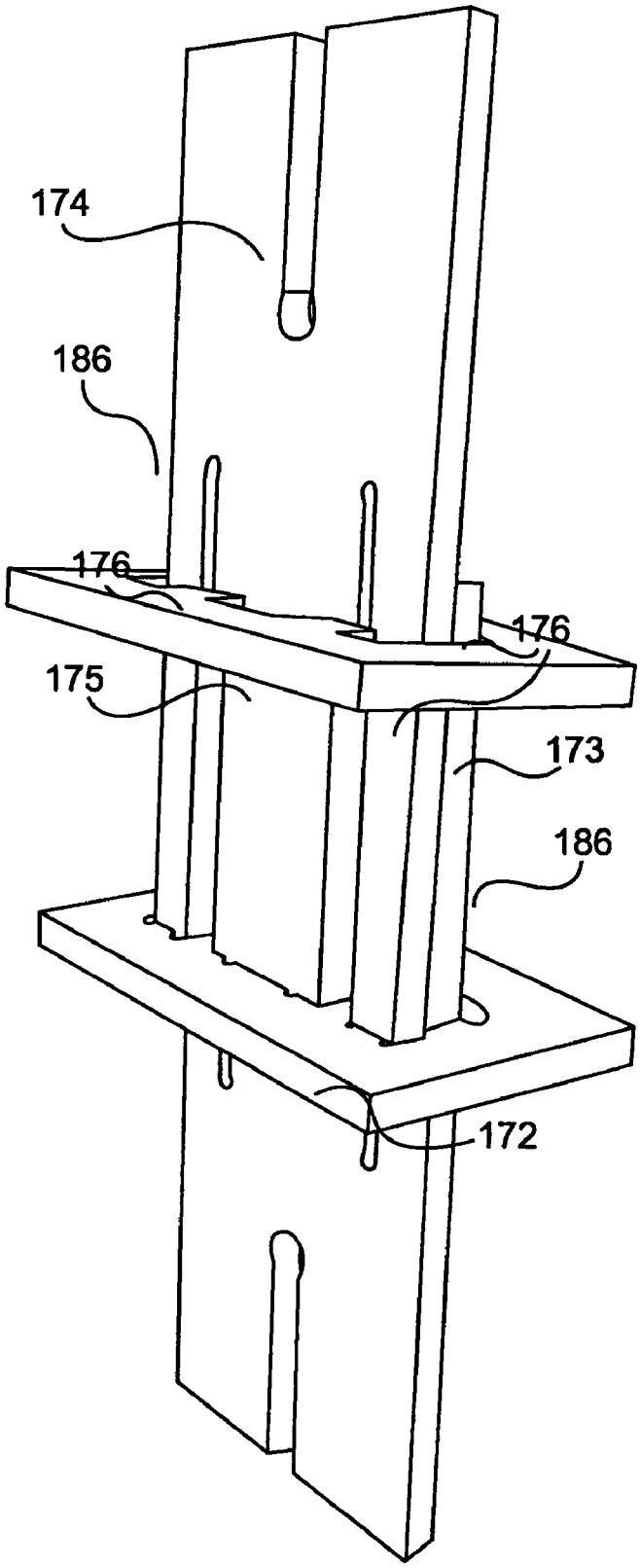
FIG. 20 is a perspective view depicting another embodiment of a tab connector consistent with the present invention.

FIG. 20 is a perspective view of one embodiment of the panel assembly 180 in which the elongate resilient members 176 of a first tab 173 and the elongate resilient members 176 of a second tab 175 are joined together by apertures 186 of a support structure 181 including two parallel horizontal end plates. Specifically, the elongate resilient members 176 of each tab are bent inward by an amount sufficient to allow their entry into the apertures 186. Upon engagement, the elongate resilient members 176 are allowed to bend back outward slightly to form a locking mechanism. As illustrated in FIG. 20, the first tab 173 and the second tab 175 each extend from the first end joint 172 and second end joint 174, respectively. Because the two legs joined by each of the first and second end joints 172, 174 bow, or bend, apart in a direction transverse to the direction in which the elongate resilient members 176 are deformed, each of the tab and joint portions may be subjected to bending, compression, and/or torsional forces.

Figure 21A:
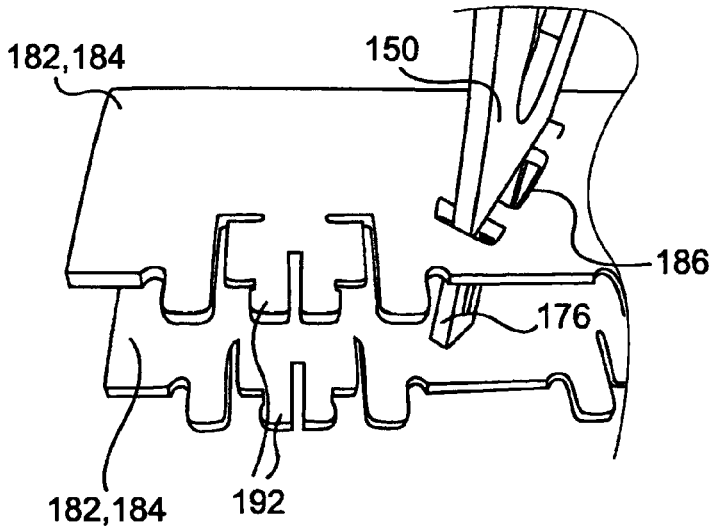
FIG. 21A is a perspective view depicting an embodiment of a sheathing connector consistent with the present invention.
Figure 21B:
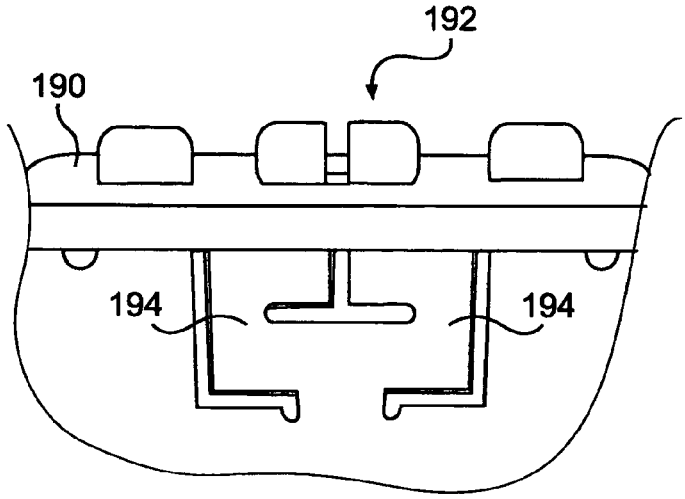
FIG. 21B is a top view of the sheathing connector of FIG. 21A engaged with sheathing.
Figure 21C:
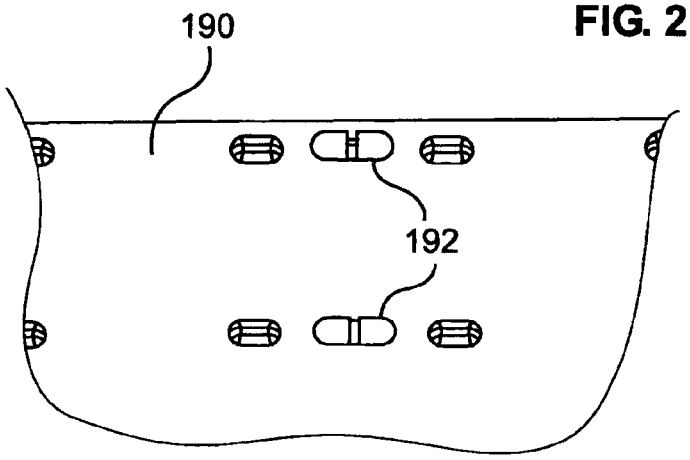
FIG. 21C is a side view of the sheathing connector of FIG. 21A engaged with sheathing.
Figure 22A:
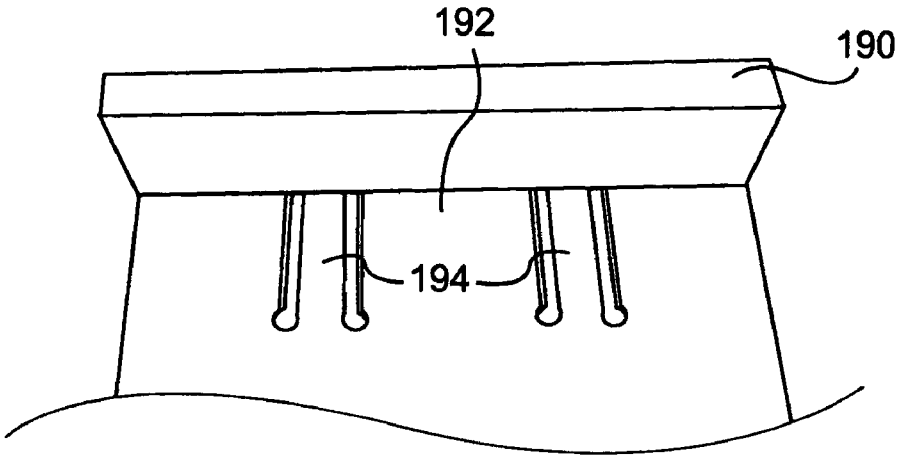
FIGS. 22A-F are top perspectives depicting various sheathing connectors consistent with the present invention.
Figure 22B:
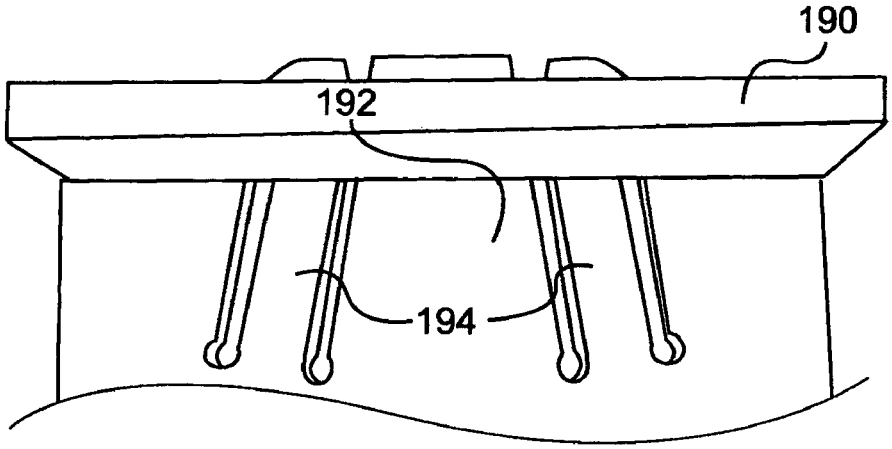
Figure 22C:
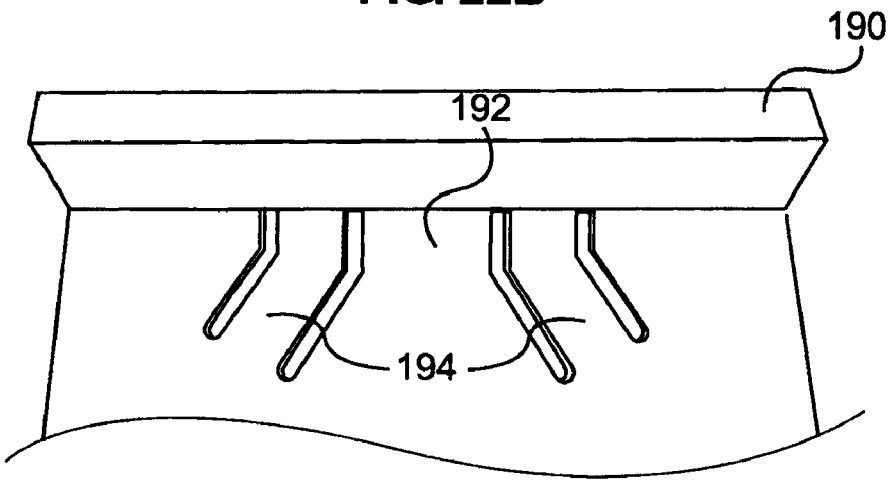
Figure 22D:
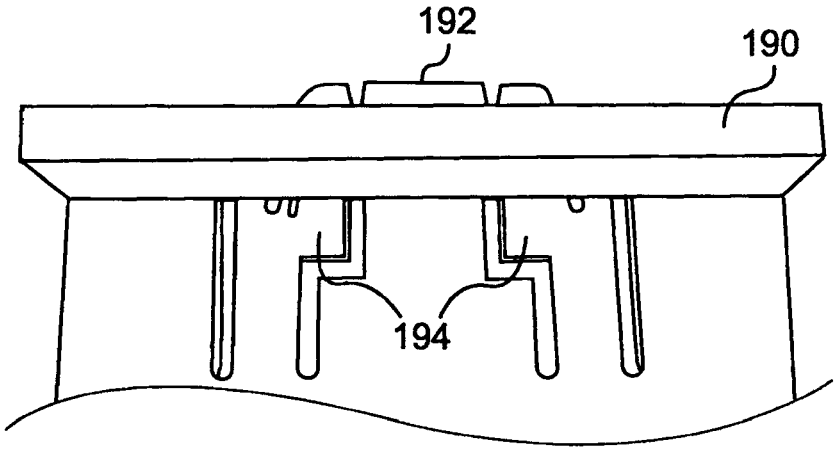
Figure 22E:
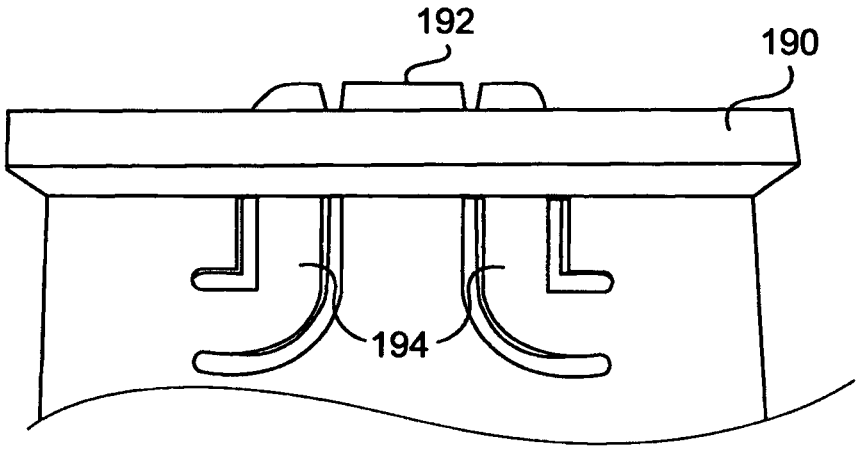
Figure 22F:
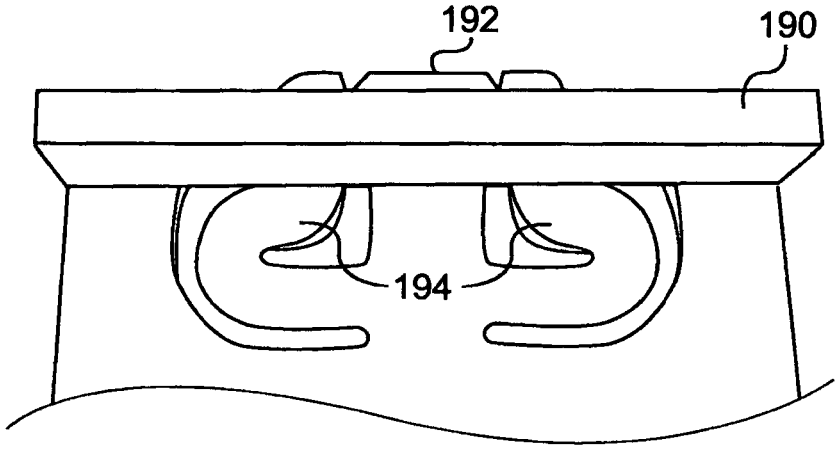

FIG. 21A is a perspective view of another embodiment of the panel assembly 180, in which a plurality of sheathing connectors are provided for affixing sheathing to the panel assembly 180. Specifically, a pair of horizontal first or second end plates 182, 184 is illustrated having apertures 186 for retaining the panel member 150 in its expanded position. Moreover, the horizontal end plates 182, 184 are illustrated as having a plurality of resilient clips 192 for engaging sheathing. FIG. 21B illustrates an embodiment of a resilient clip 192 engaged with sheathing 190 in greater detail. Specifically, the resilient clip 192 includes a pair of resilient members 194 configured to bend together by an amount sufficient to allow engagement with corresponding apertures in the sheathing. The resilient clips 192 are further configured to bias back away from each other so as to positively lock into the apertures of the sheathing 190. FIG. 21C depicts the resilient clips 192 from the outside of the panel assembly as engaged into sheathing 190. As will be appreciated by one of skill in the art, any suitable variety of resilient clip, or other locking mechanism, may be used for affixing the sheathing 190 to the support structure 181 (e.g., via first and/or second end plates 182, 184) and/or the panel members 150 of the panel assembly 180.

For example, FIGS. 22A-F are top perspective views depicting various sheathing connectors consistent with the present invention. These exemplary resilient clips 192 may each include various configurations of resilient members 194 configured to bend together by an amount sufficient to allow engagement with corresponding apertures in the sheathing 190. Selection of a particular configuration of slots and members of the resilient clip 192 may be based on the desired resilience of the clip. Specifically, varying geometry may affect the ease with which sheathing 190 may be pressed onto the clips. It may also affect the ability or inability of the sheathing 190 to detach from the panel assembly 180.

Figure 23:
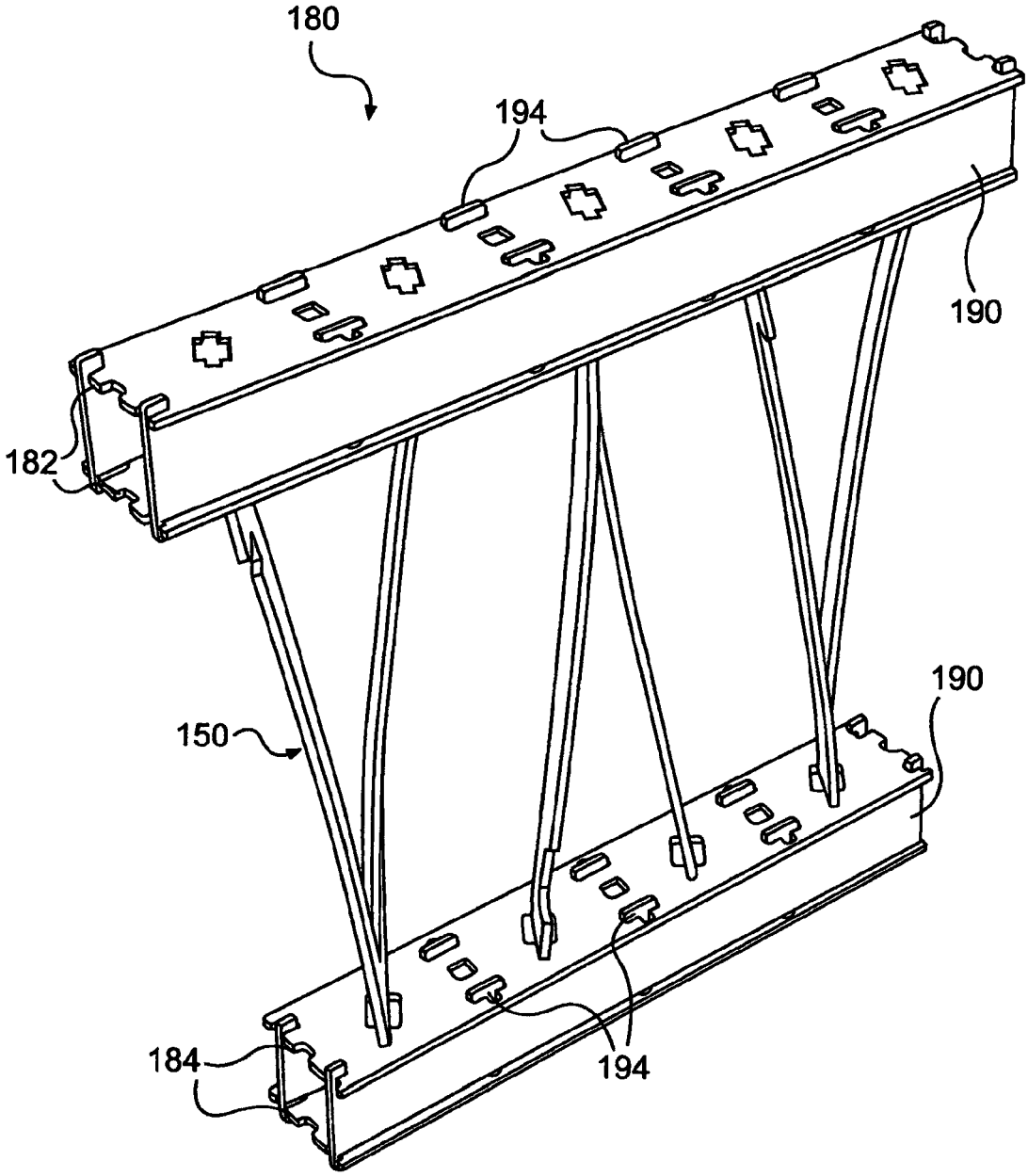
FIG. 23 is a perspective view depicting an embodiment of the panel assembly consistent with the present invention.
Figure 24A:
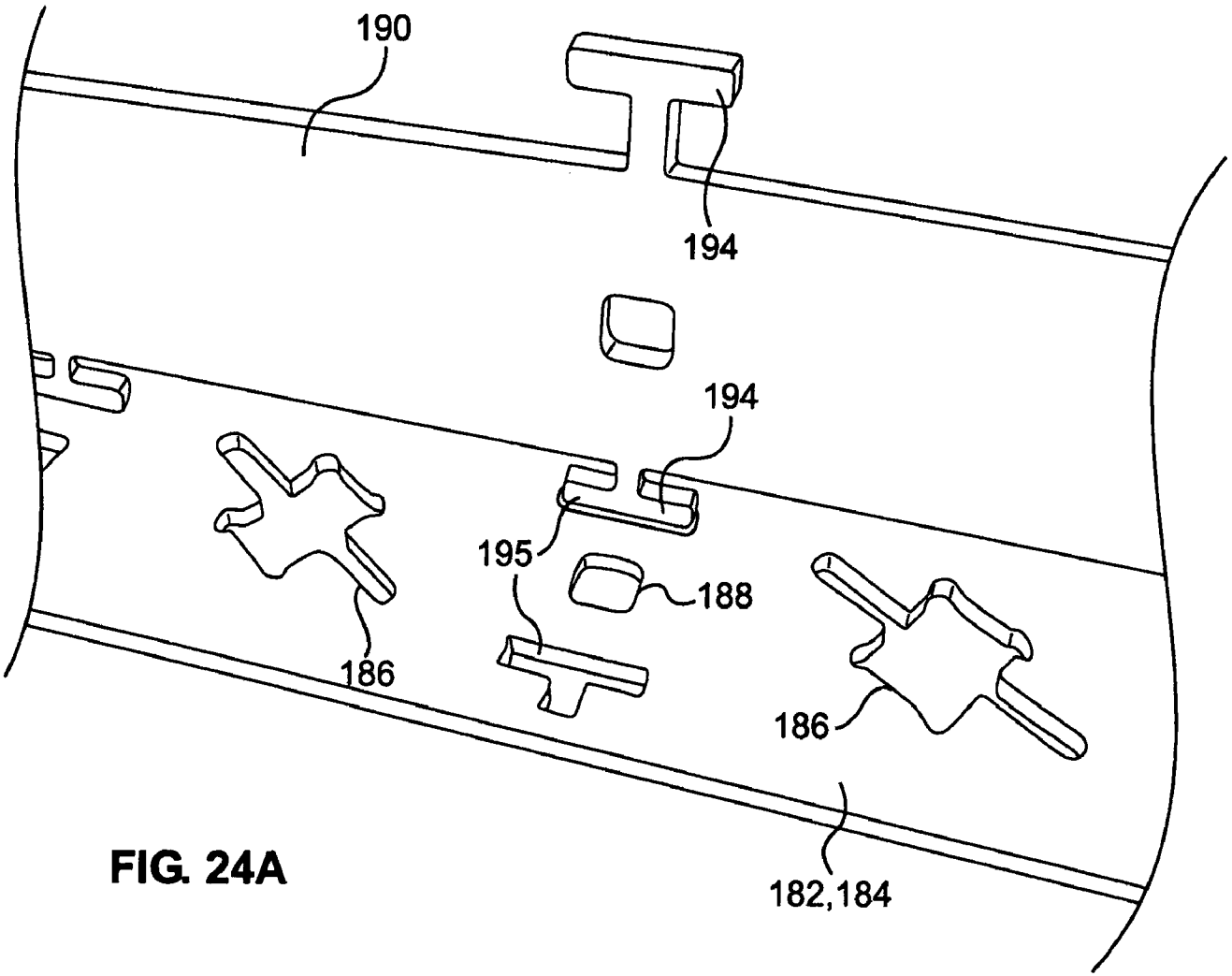
FIGS. 24A-B are perspective views depicting alternative embodiments of the panel assembly consistent with the present invention.
Figure 24B:
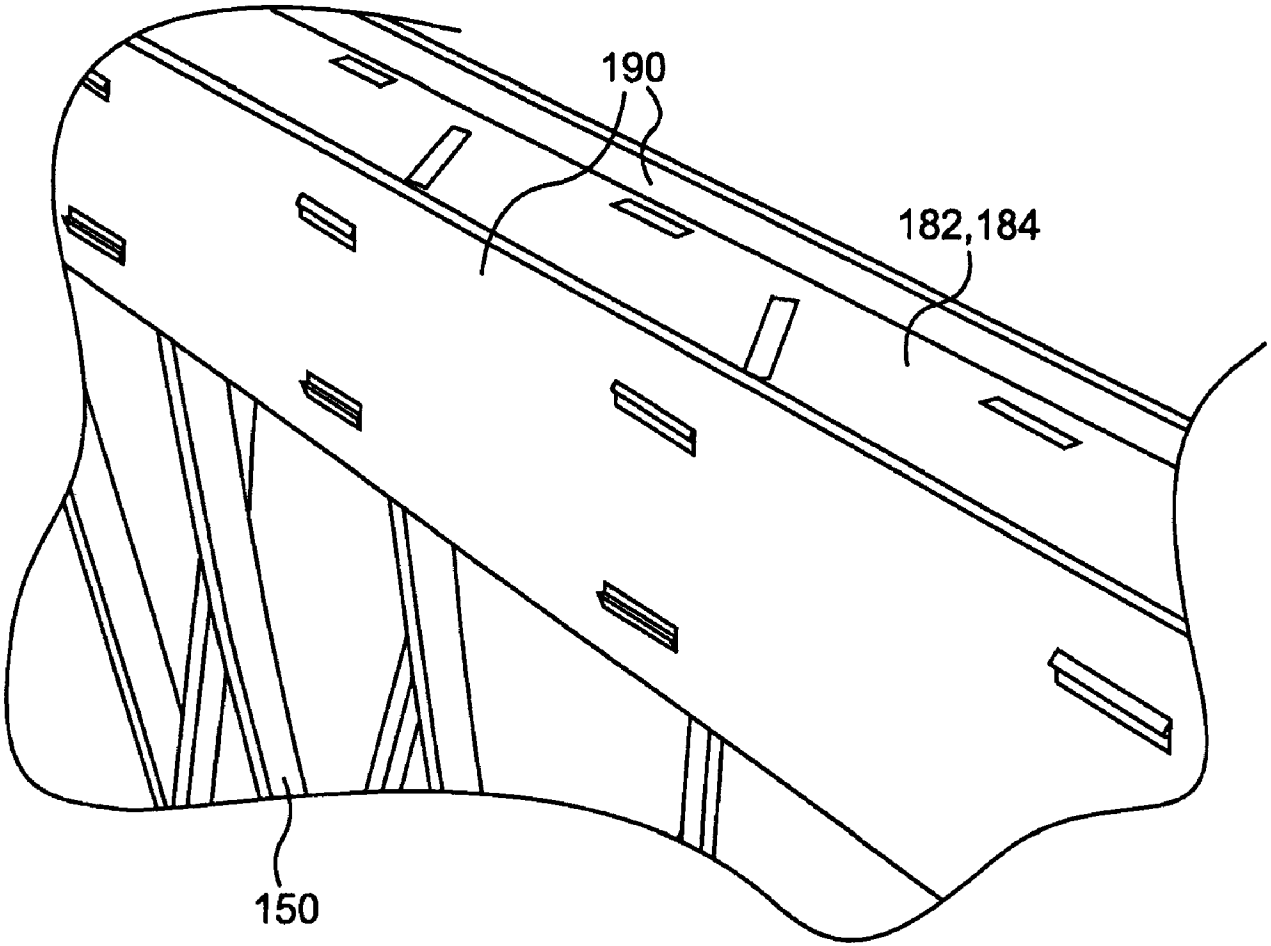

Alternative mechanisms and methods are contemplated for affixing sheathing to the panel assembly 180. For example, FIG. 23 illustrates an embodiment in which strips of the sheathing 190 are affixed to cover only the two gaps created between the pair of first end plates 182 and the pair of second end plates 184. Specifically, in this embodiment, the sheathing 190 may include tabs 194, which positively engage corresponding apertures in the first and second end plates 182, 184. FIG. 24A is a detail view of this embodiment, in which the first and second end plates 182, 184 include: the apertures 186 for accepting tabs of the panel members 150; the apertures 188 for accepting elongate building materials through the middle of the panel assembly 180; and the apertures 195 for accepting the tabs 194 of the sheathing 190. It is also contemplated that tabs of the first and second end plates 182, 184 may engage corresponding apertures of the sheathing 190, as illustrated in FIG. 24B.

Figure 25A:
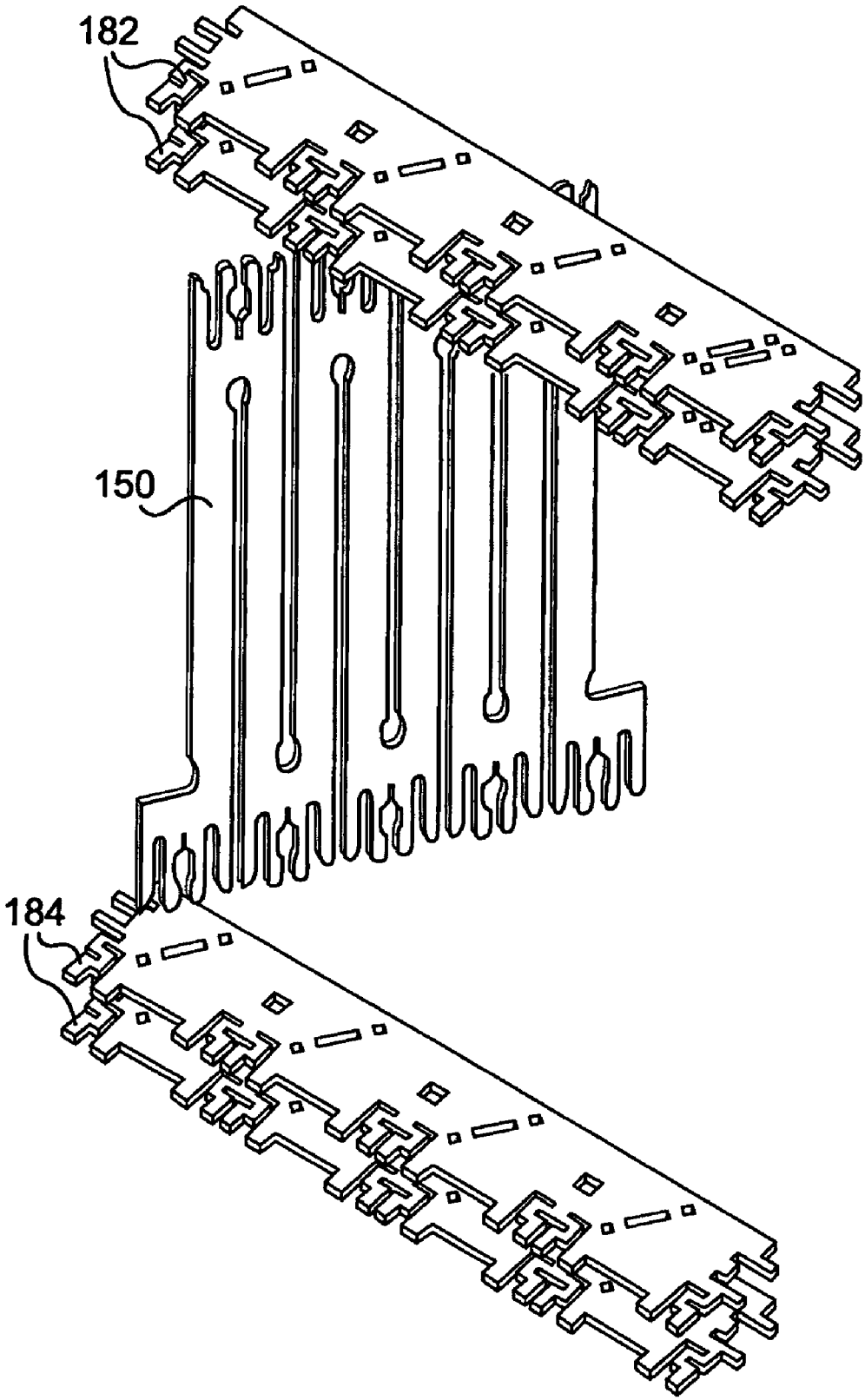
FIGS. 25A-T are perspective views depicting a method of assembling a multi-tiered building structure from a plurality of expandable panel members and support structures consistent with the present invention.
Figure 25B:
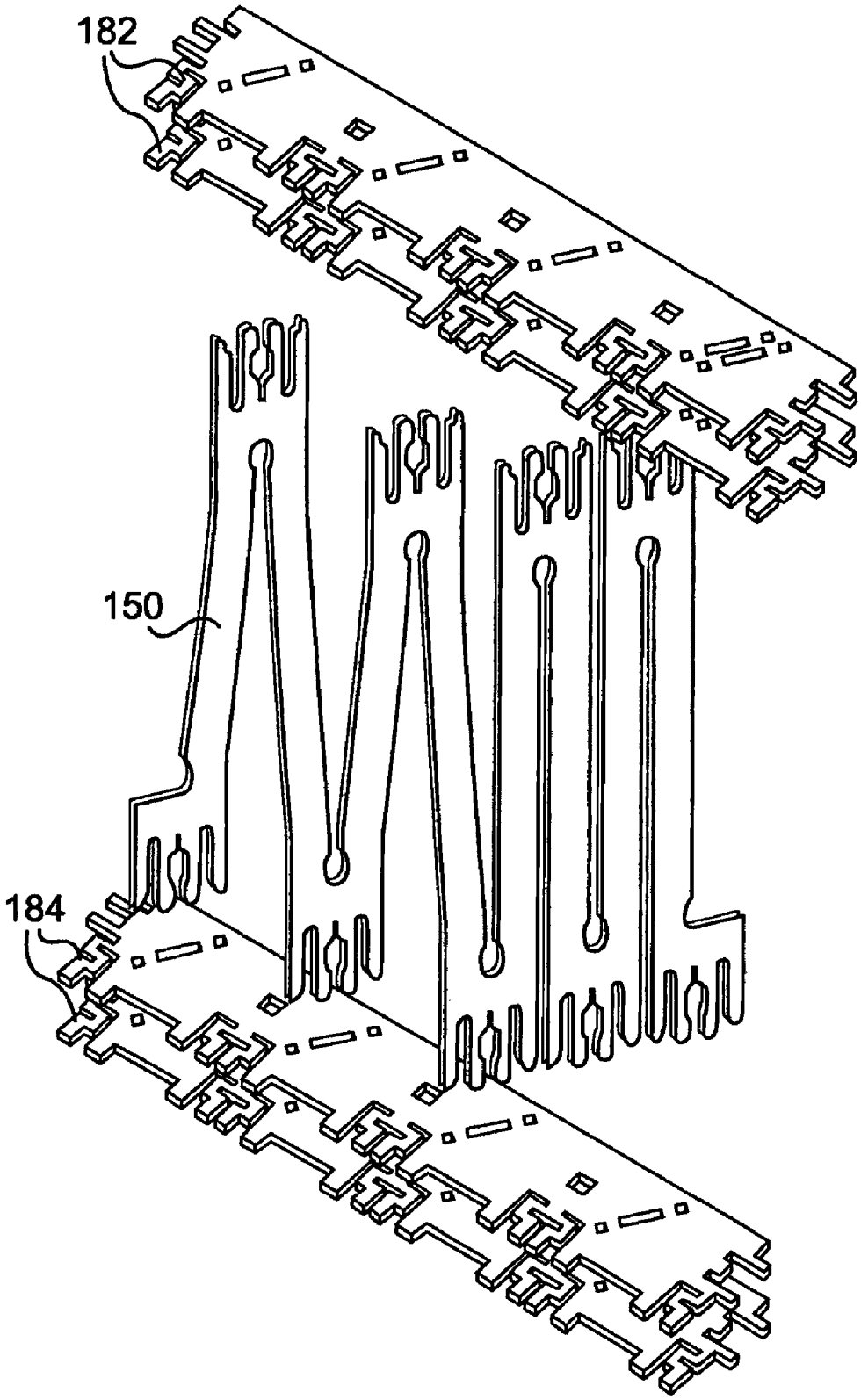
Figure 25C:
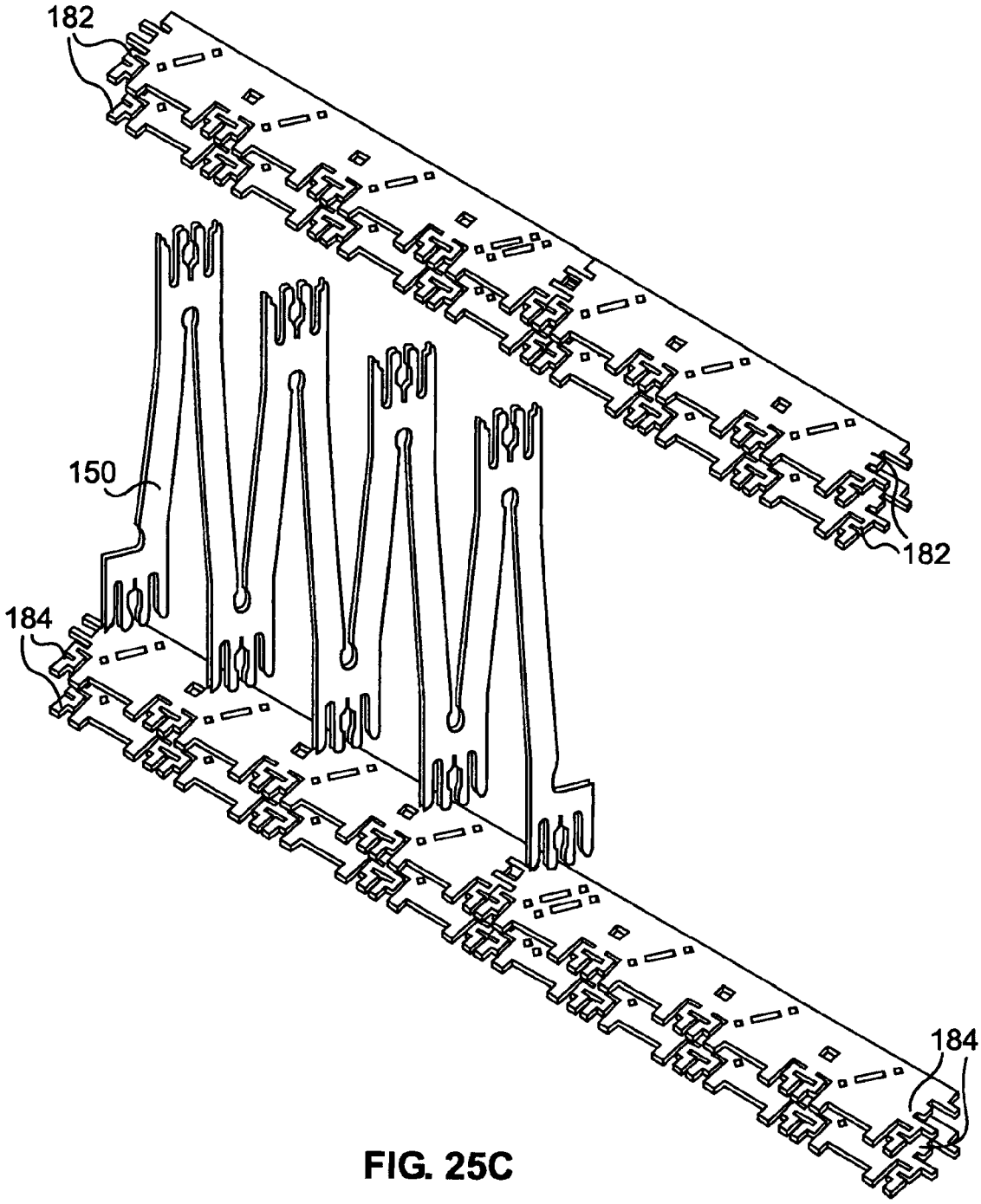
Figure 25D:
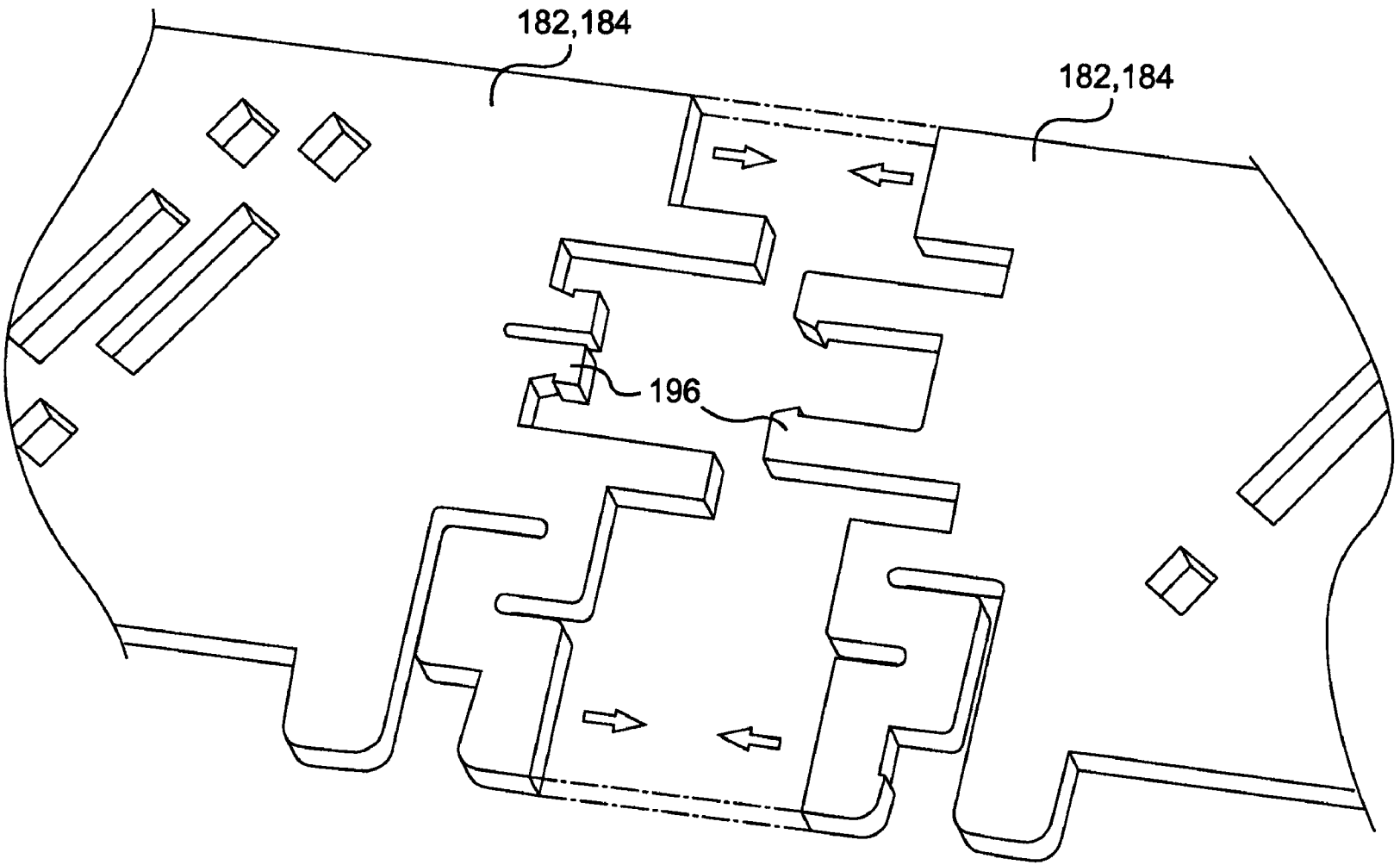
Figure 25E:
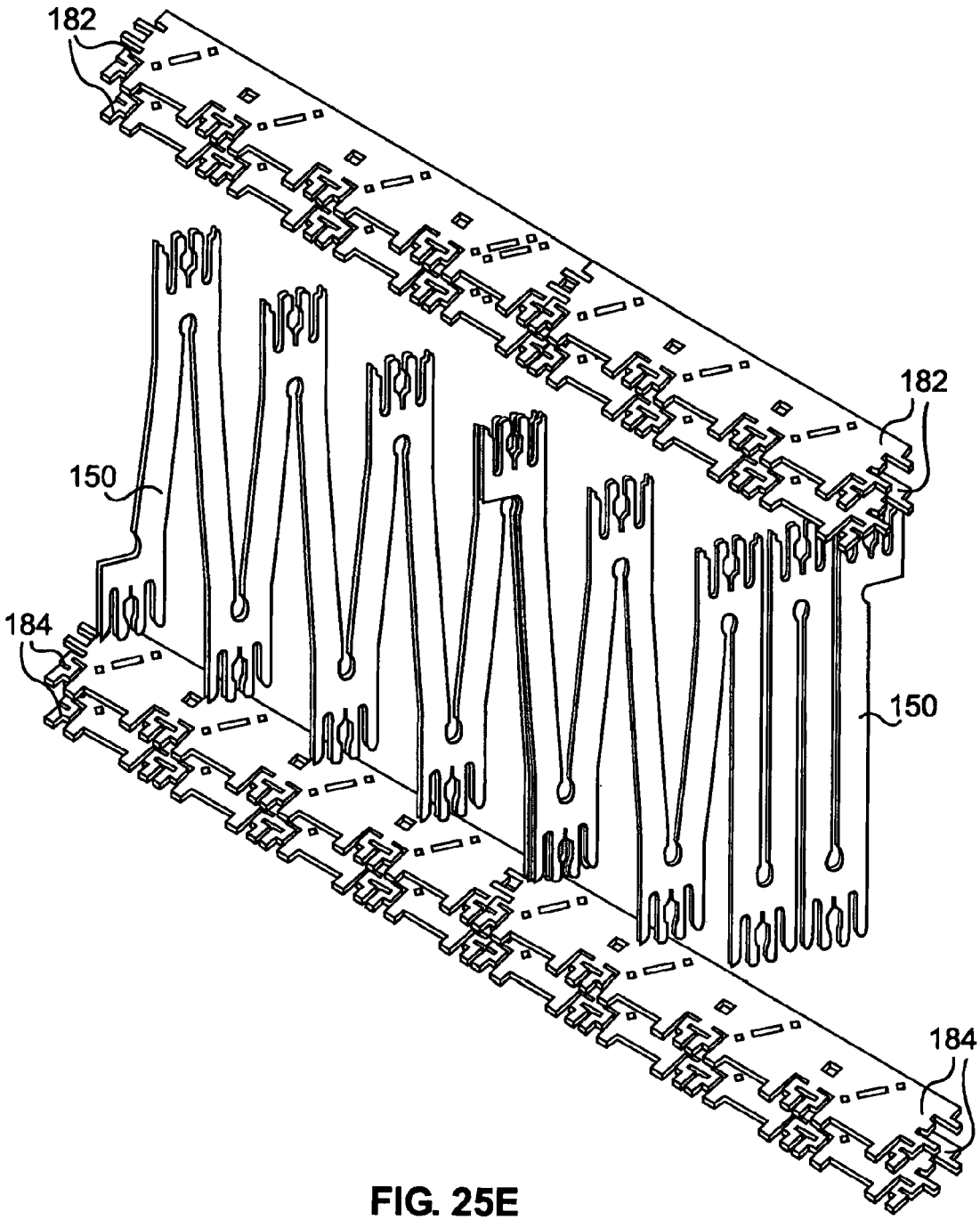
Figure 25F:
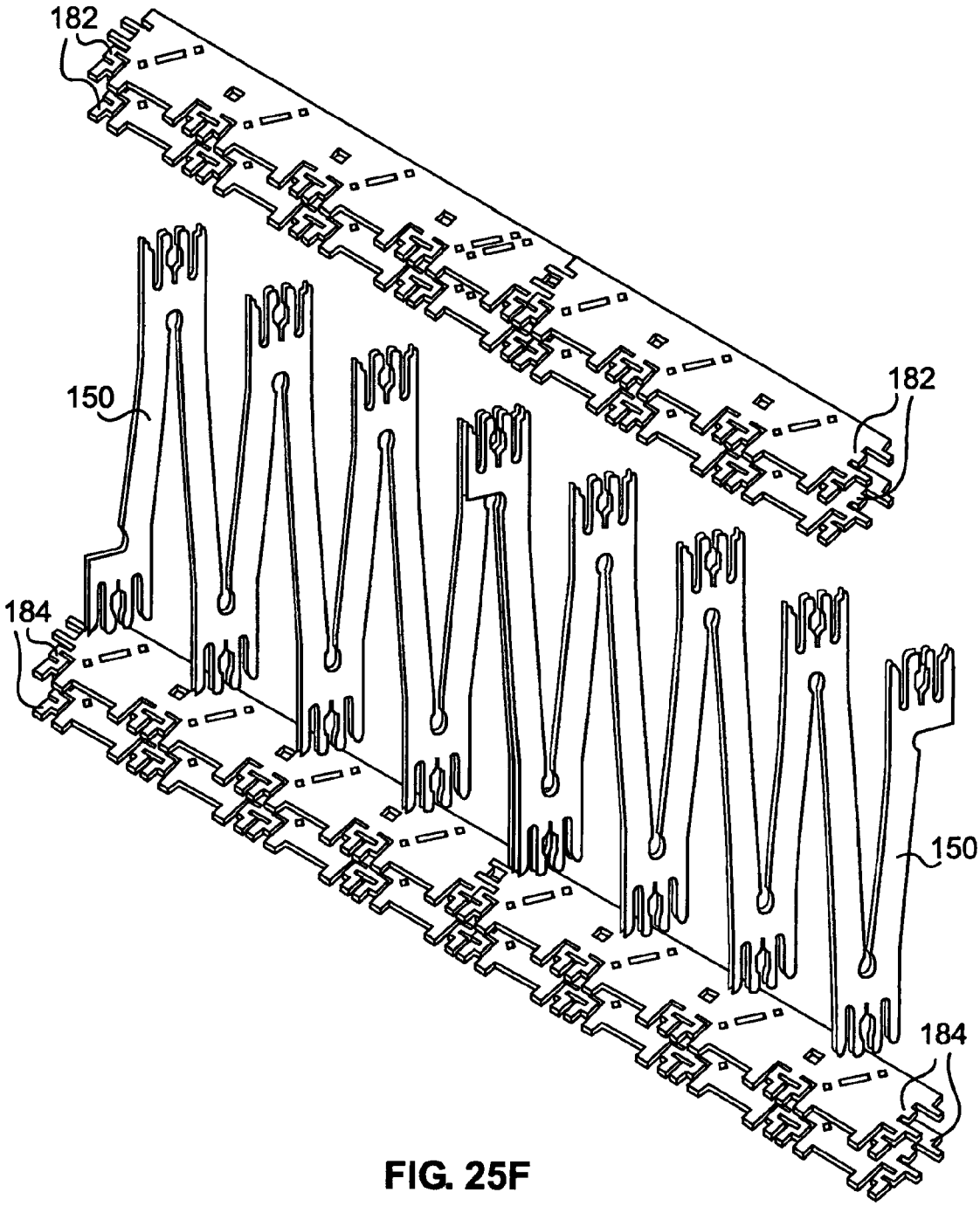
Figure 25G:
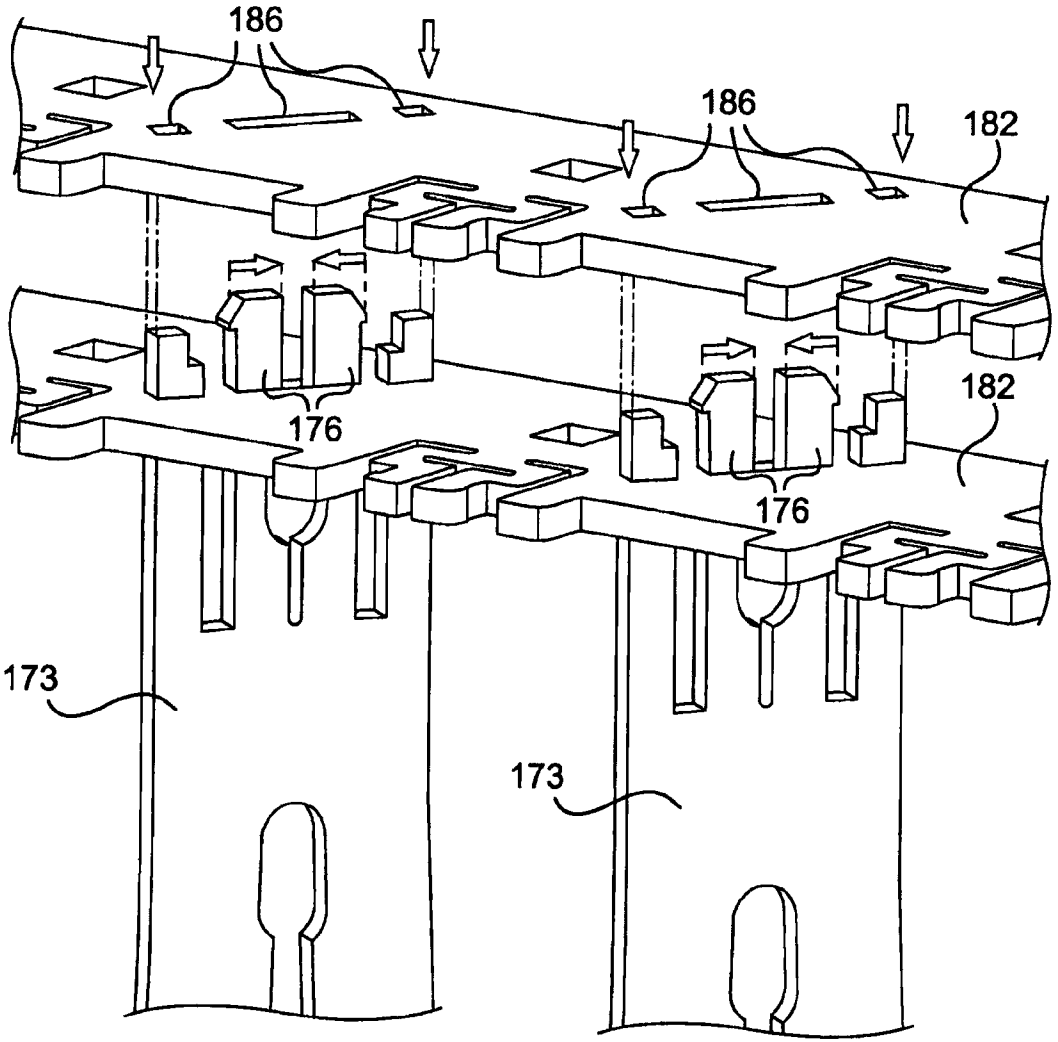
Figure 25H:
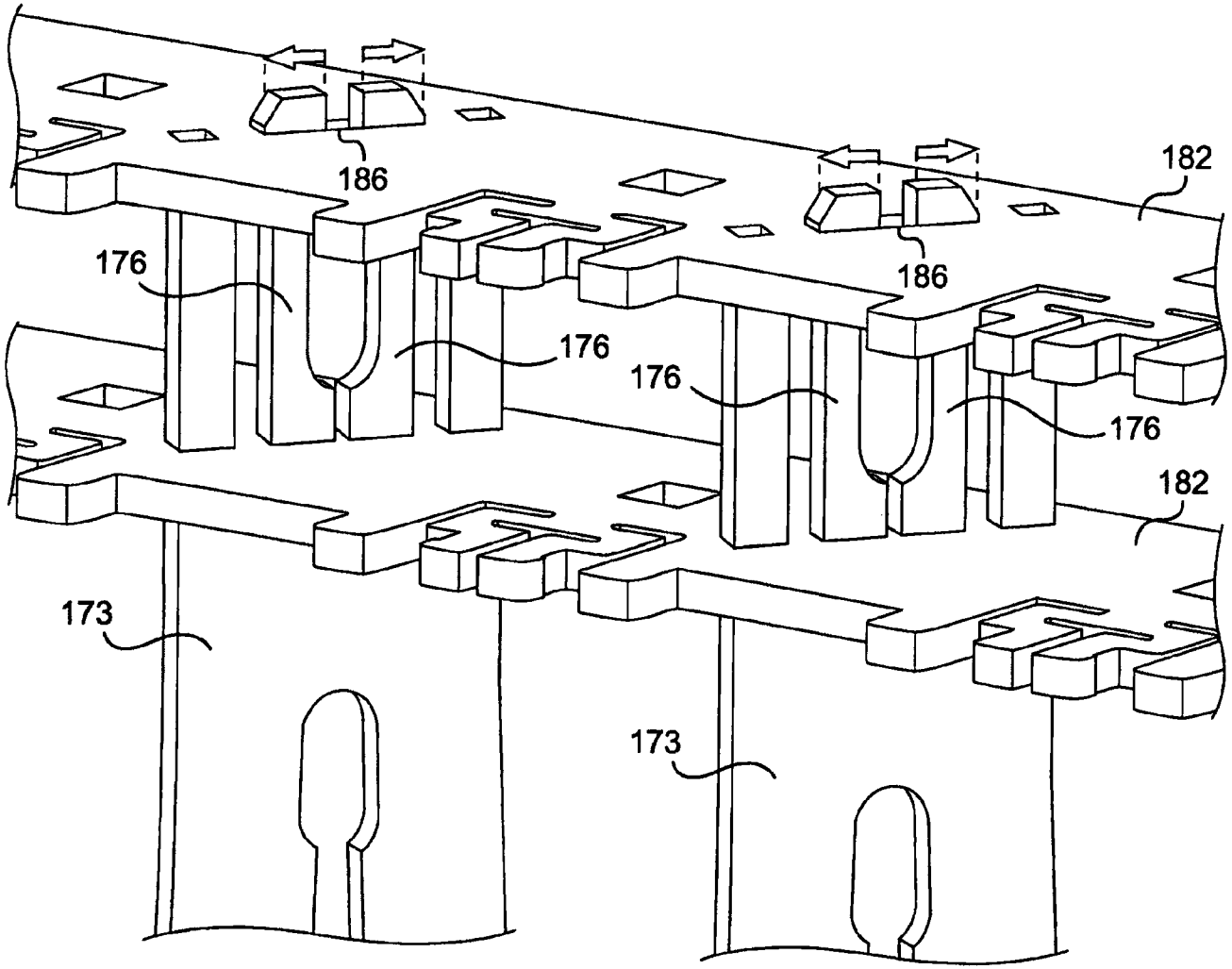
Figure 25I:
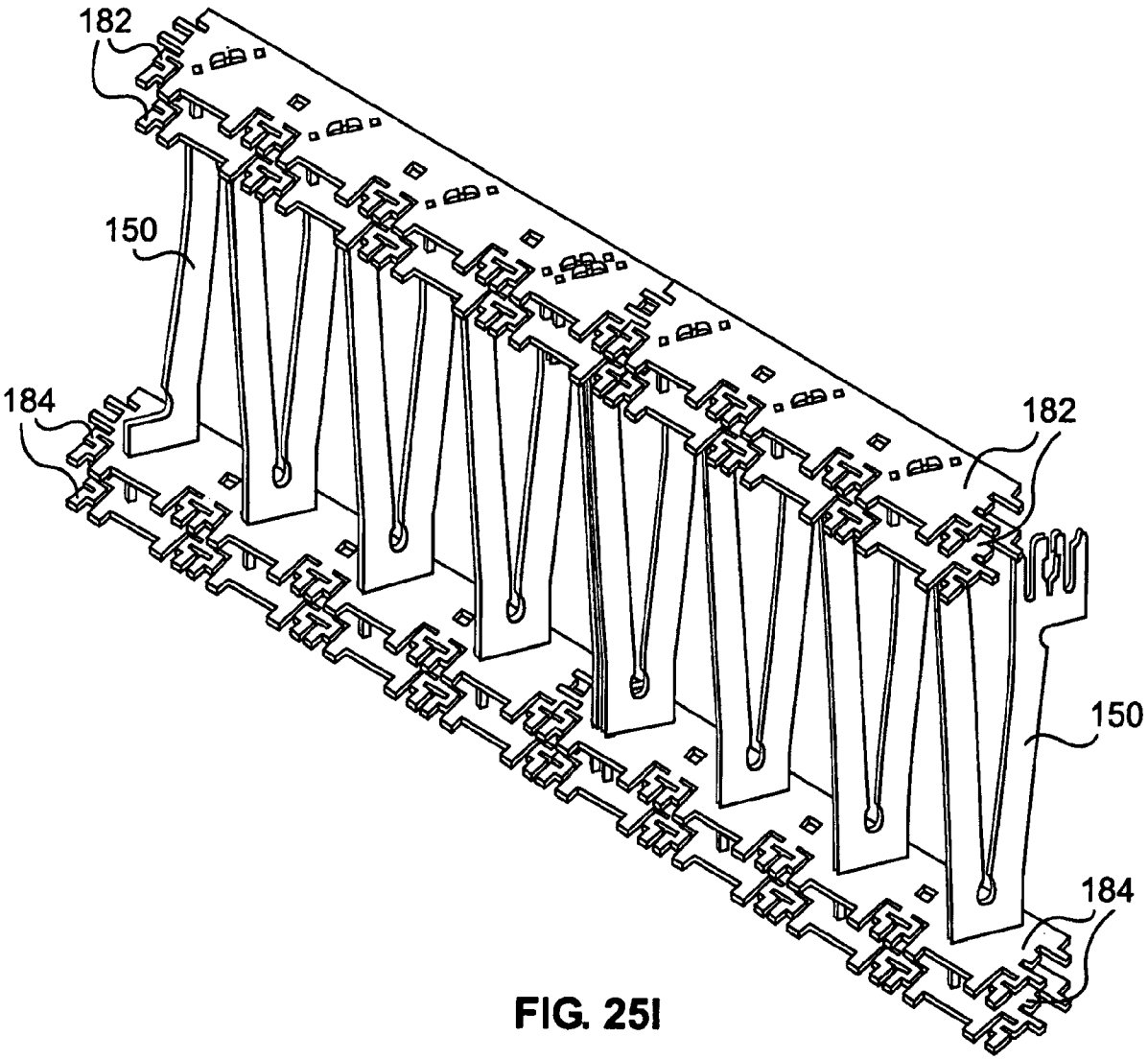
Figure 25J:
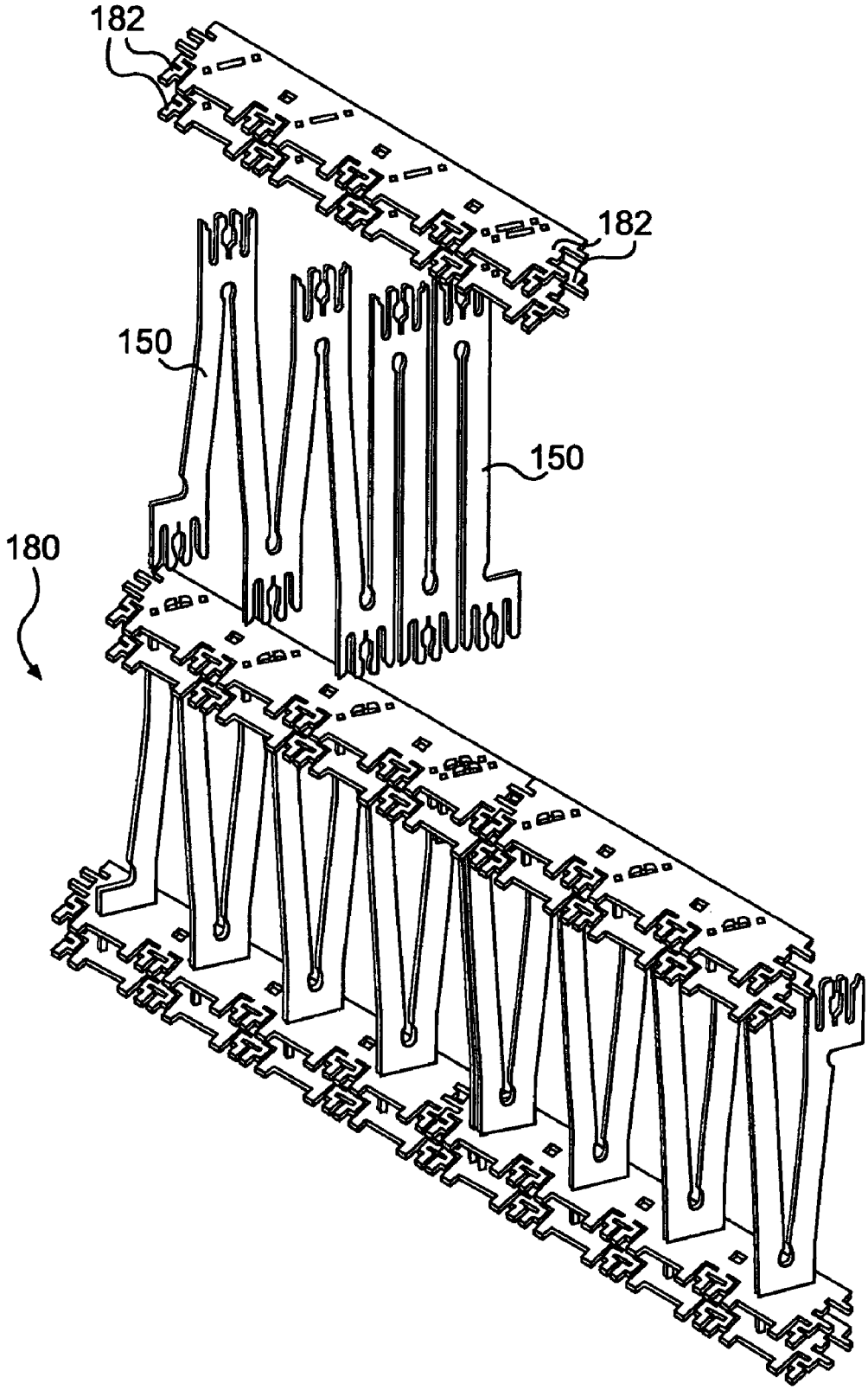
Figure 25K:
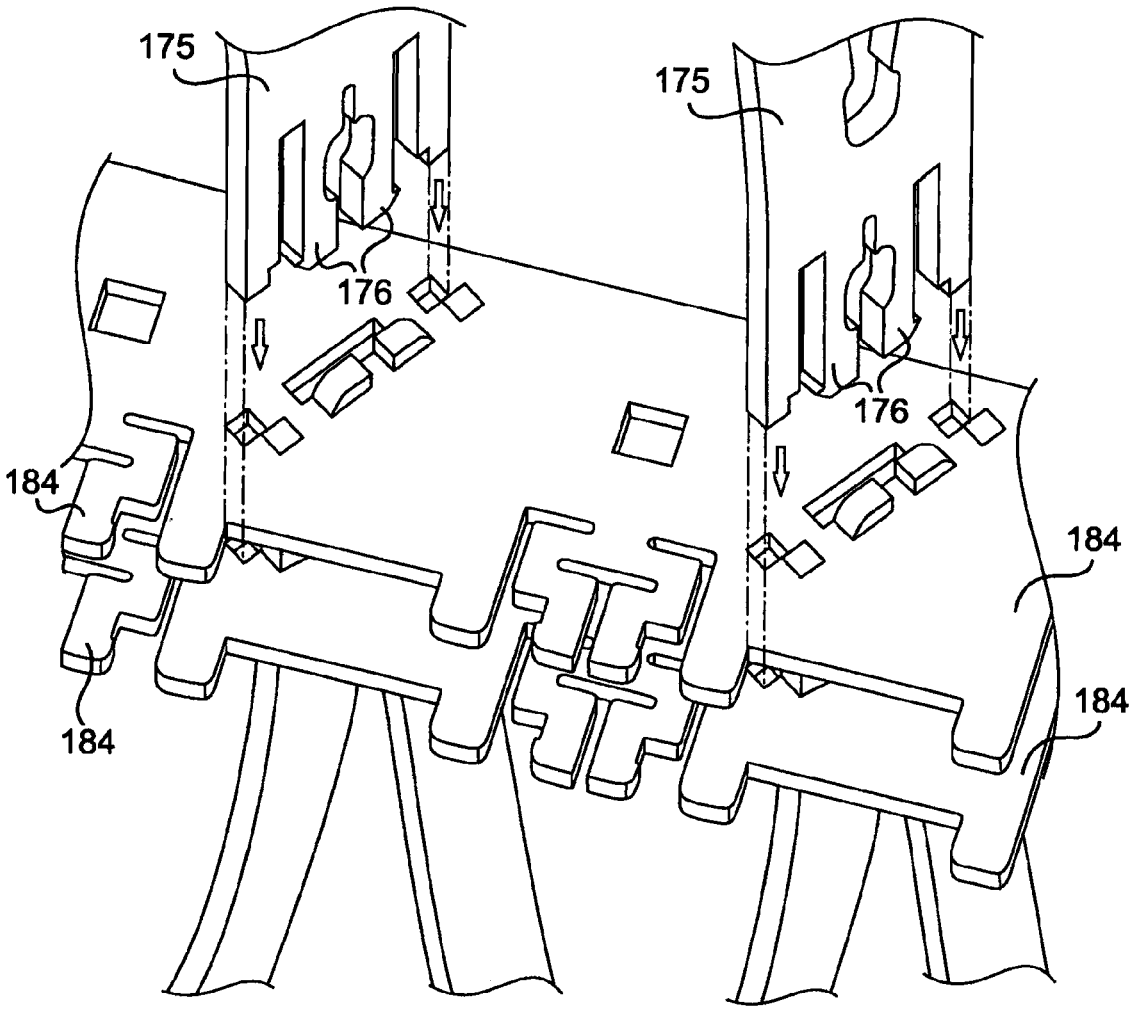
Figure 25L:
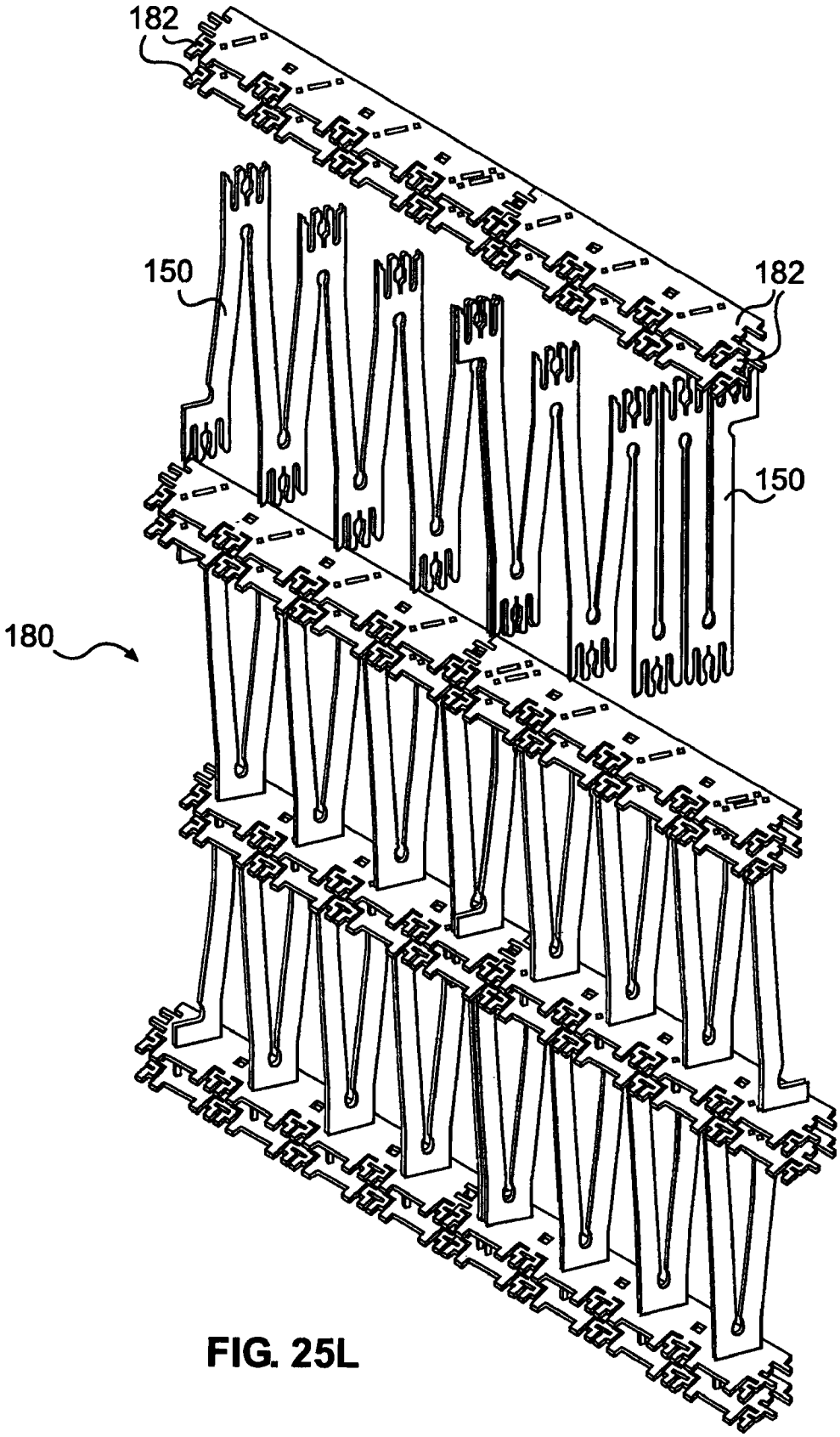
Figure 25M:
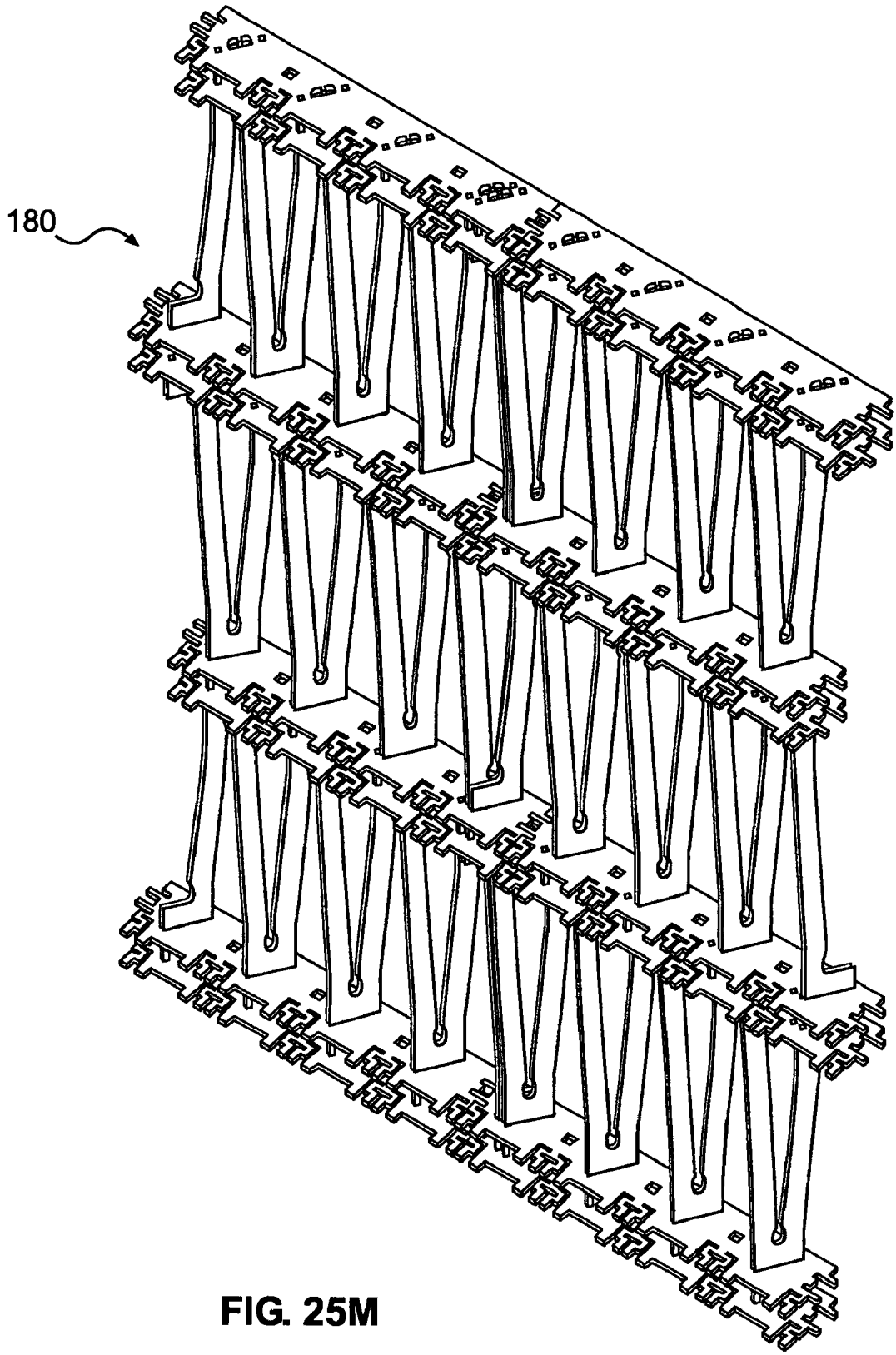
Figure 25N:
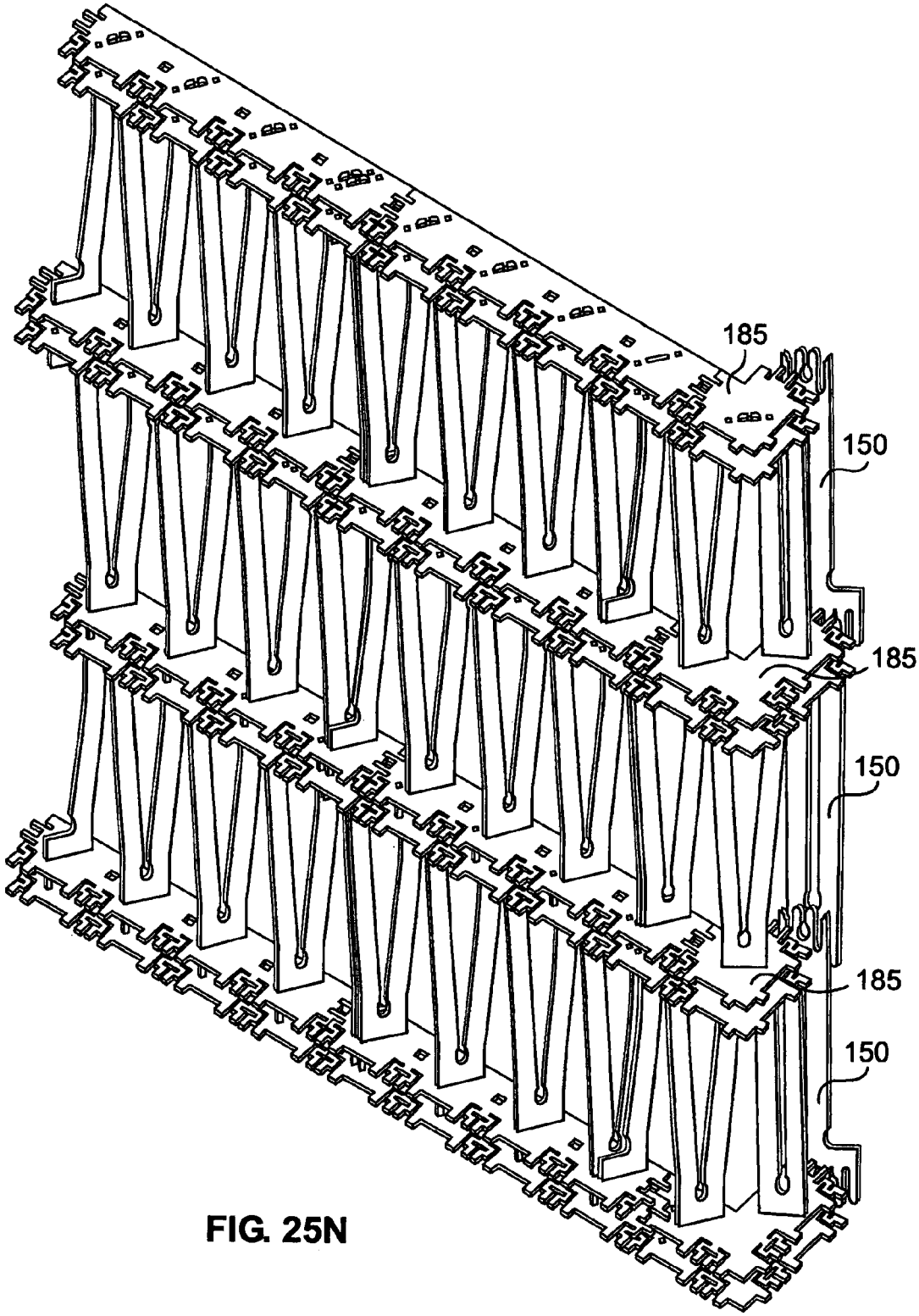
Figure 25O:
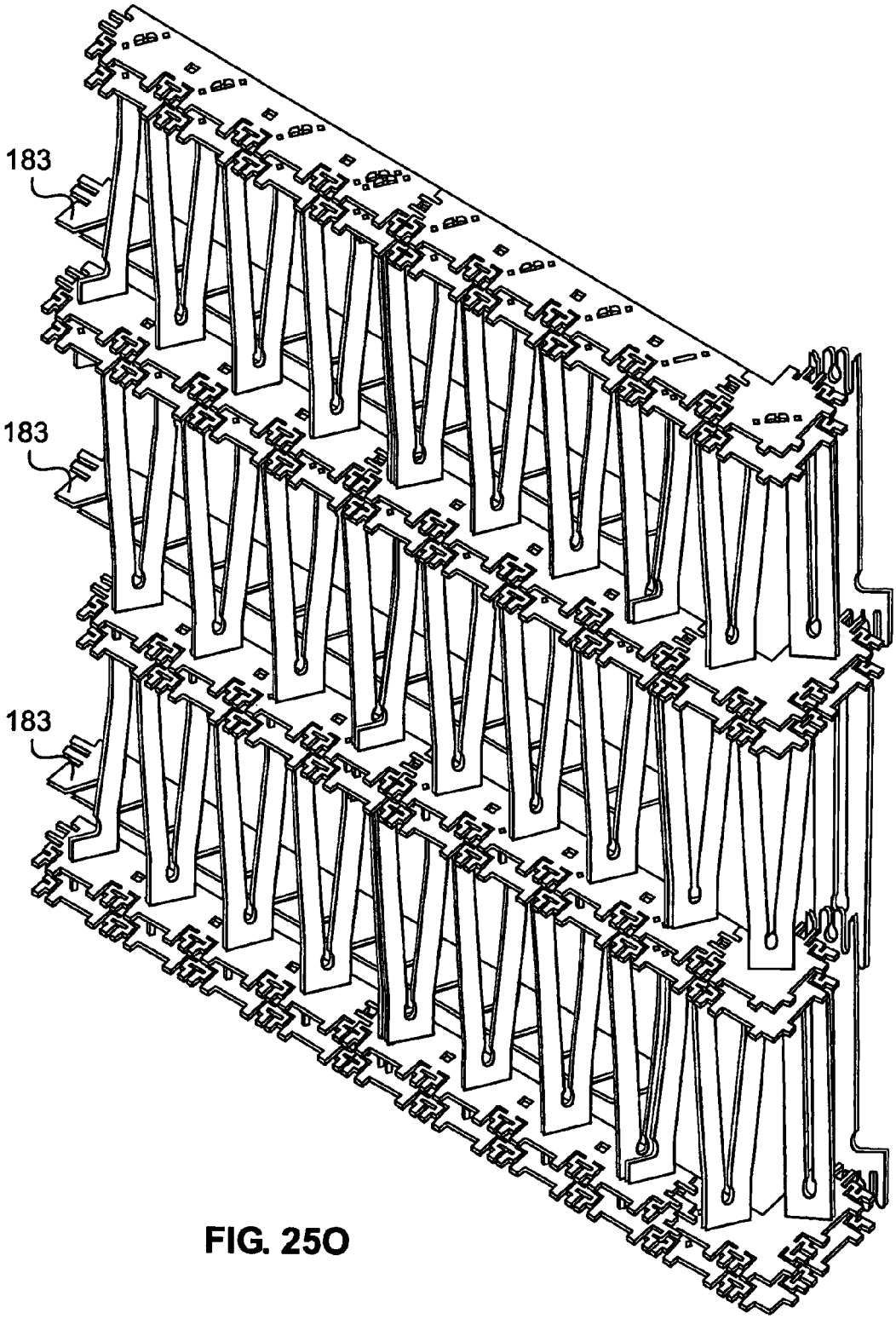
Figure 25P:
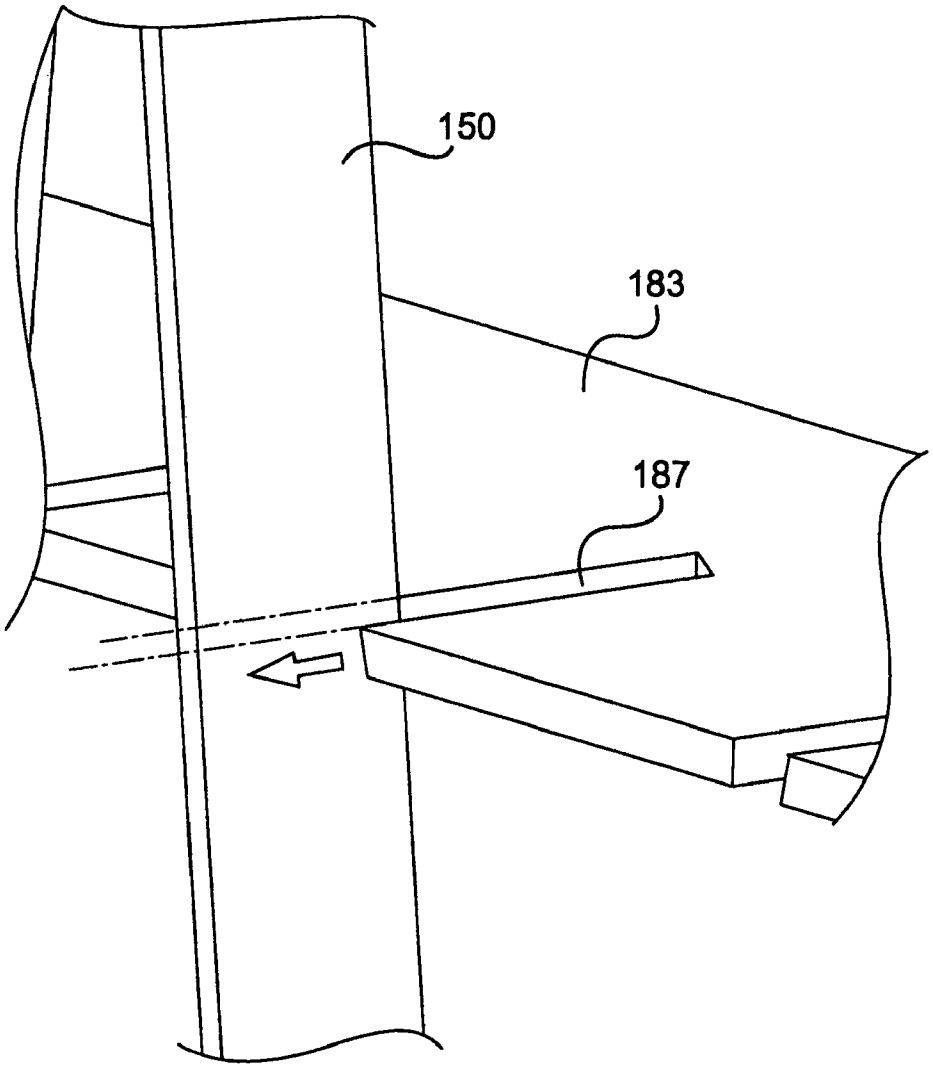
Figure 25Q:
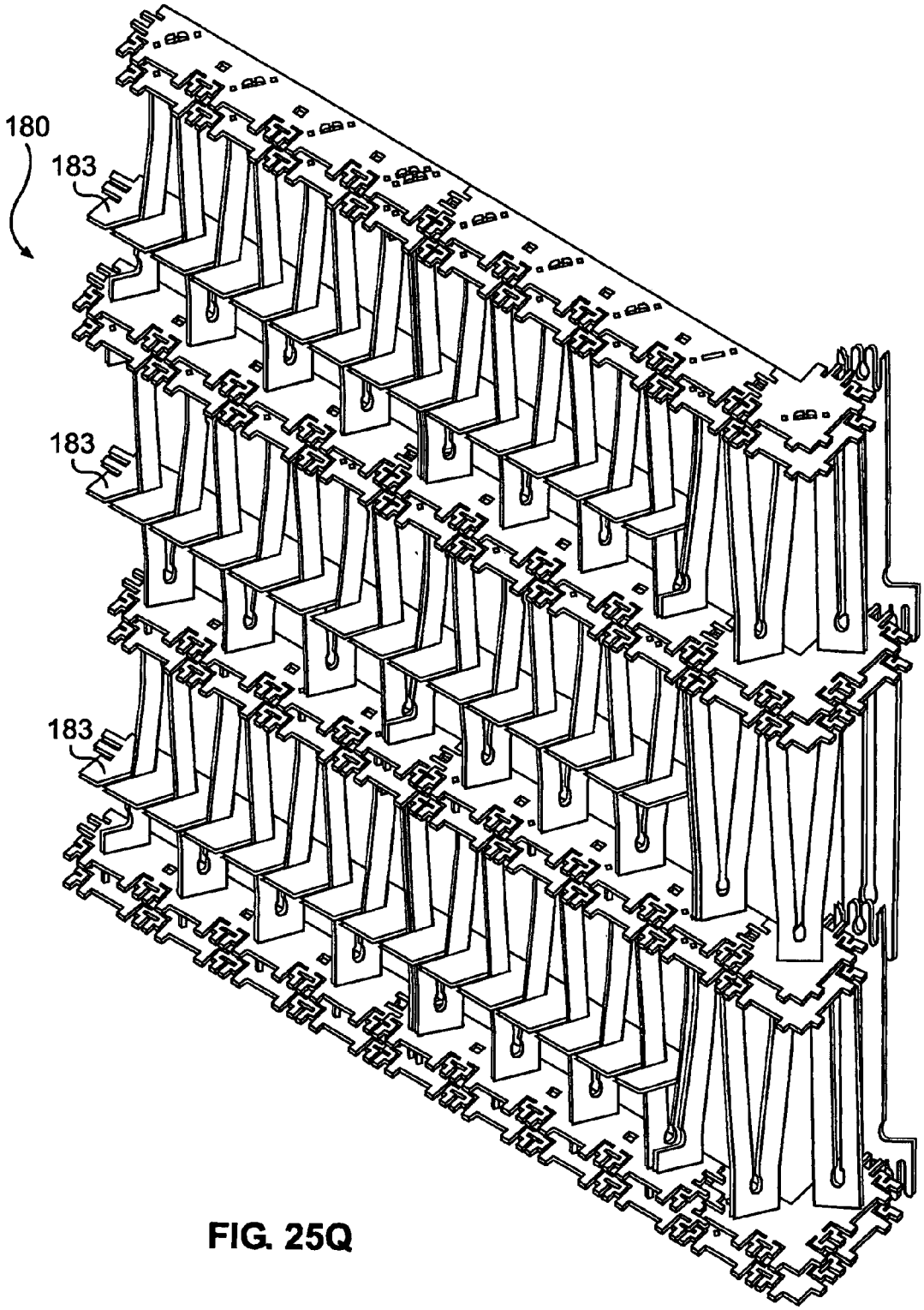
Figure 25R:
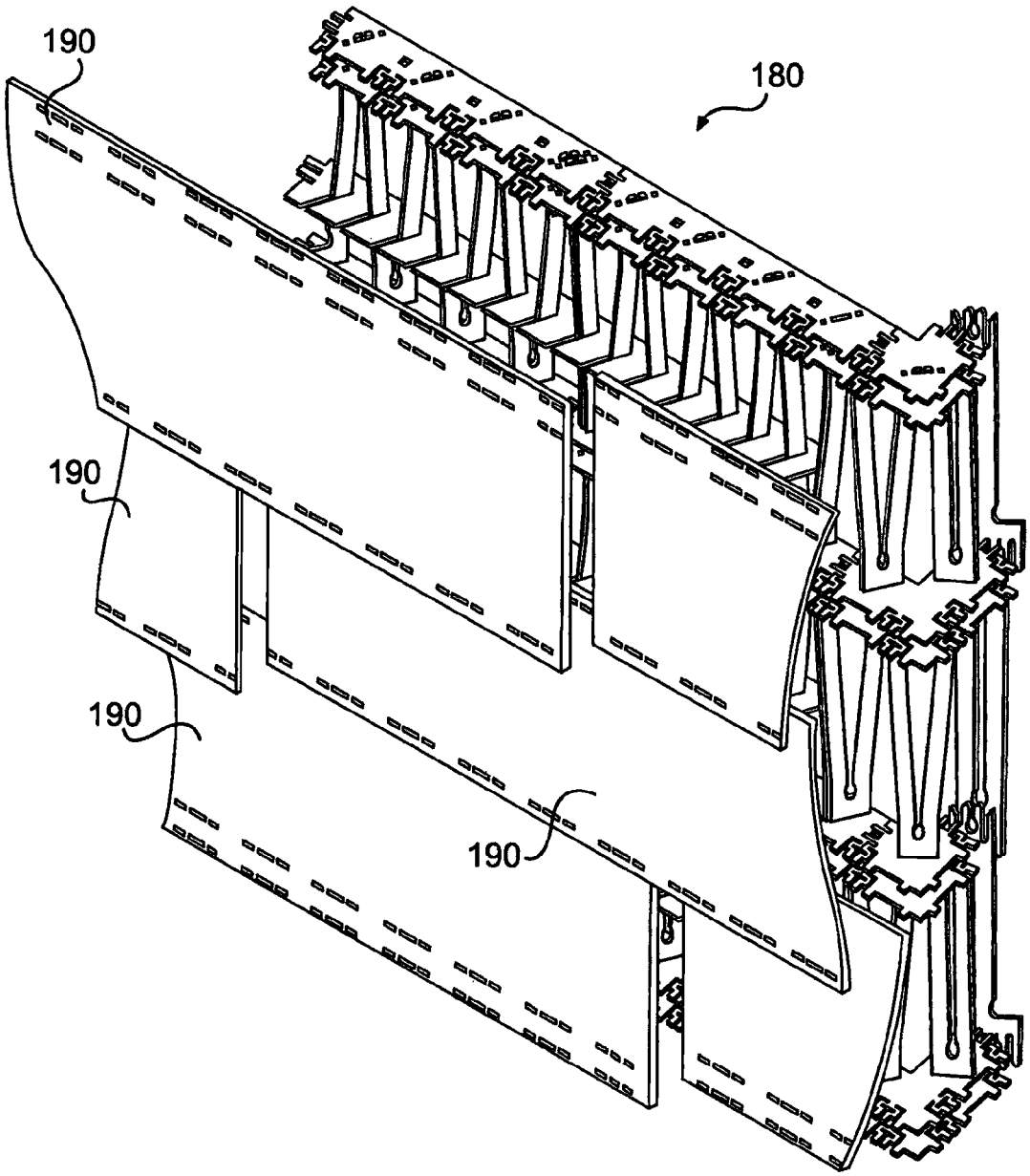
Figure 25S:
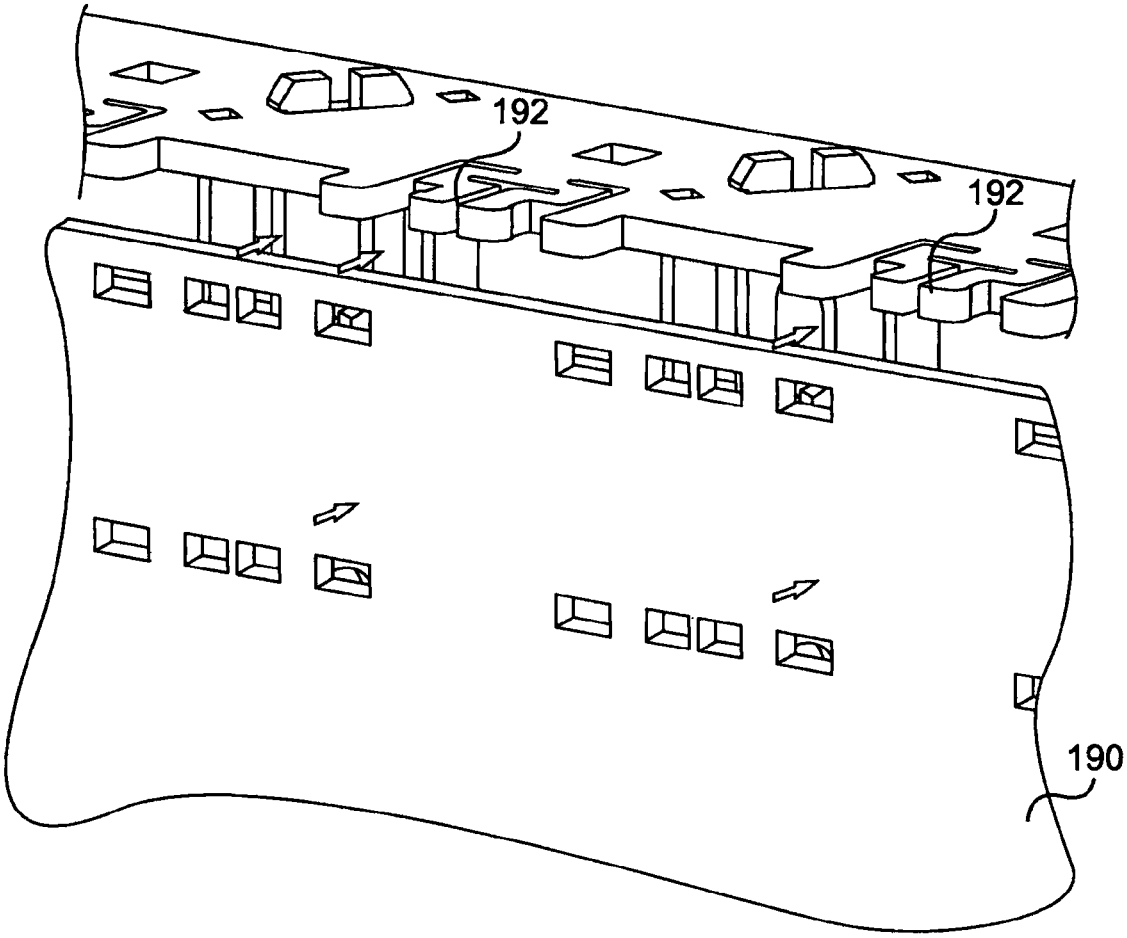
Figure 25T:
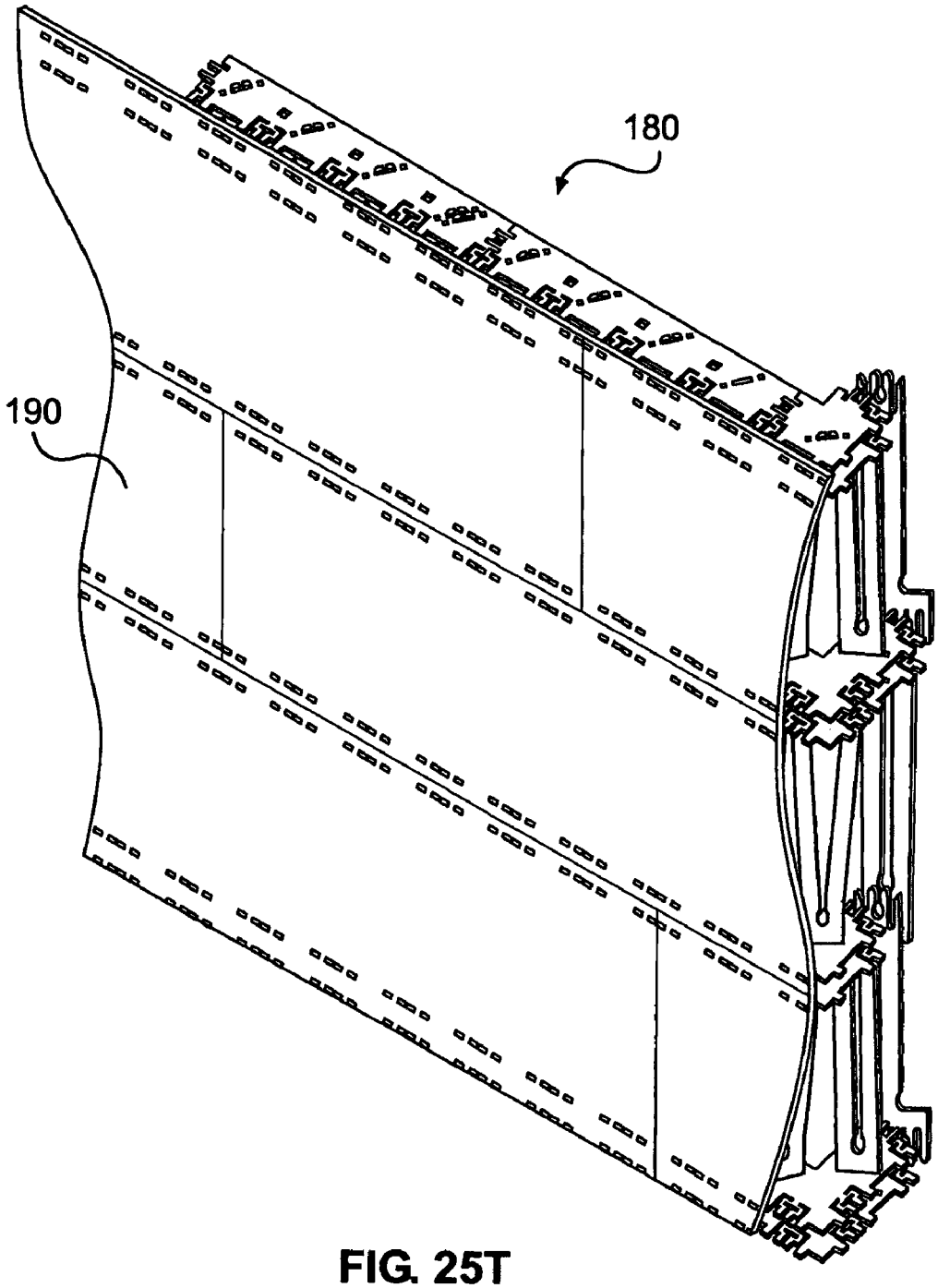

FIGS. 25A-T are perspective views depicting an exemplary method of assembling a multi-tiered building structure from a plurality of expandable panel members and support structures consistent with the present invention.

FIG. 25A depicts two first end plates 182, two second end plates 184, and the panel member 150, in its nonexpanded position, in preparation for assembly into a multi-tiered building structure. FIG. 25B depicts the panel member 150 being at least partially expanded, in preparation for being inserted into the first two end plates 182 and the second two end plates 184. FIG. 25C depicts a portion of the panel member 150 in its fully expanded position, such the full panel member 150 extends a length approximately equal to the length of each of the first two end plates 182 and second two end plates 184. FIG. 25C also depicts an additional set of first end plates 182 and an additional set of second end plates 184 connected to the original first and second end plates 182, 184. The additional sets of first and second end plates 182, 184 may be connected to the original sets of first and second end plates 182, 184 by first and second end plate connectors 196, as illustrated in FIG. 25D.

In one embodiment, the first and second end plate connectors 196 preferably include a set of interconnecting resilient members configured to positively engage each other upon contact. For example, the first and second end plate connectors 196 may include a set of resilient members biased into locking position with respect to an adjacent member. FIG. 25E depicts the plurality of connected first and second end plates 182, 184 and two panel members 150, one only being in a partially expanded position. As illustrated in FIG. 25E, each subsequent panel member 150 may be inverted relative to the previous panel member 150, such that its first leg overlaps the last leg of the previous panel member 150. Accordingly, connection between adjoining panel members 150 may be accomplished by several means, such as glue, fasteners, or other mechanisms, along the length of their overlapping legs. Moreover, because adjoining legs are overlapping, they may provide increased strength and rigidity at locations of connection. In FIG. 25F, both of the panel members 150 are depicted as being in their expanded positions and ready for assembly. FIG. 25G illustrates two first tabs 173 of a panel member 150 being inserted into the apertures 186 of two horizontal first end plates 182. More specifically, in FIGS. 25G-H, two sets of elongate resilient members 176 are illustrated as deforming inwards to enter the apertures 186, and then expanding back outward to lockingly engage the first end plates 182.

FIGS. 25I-M depict the ongoing assembly of panel members 150 and first and second end plates 182, 184 to form any configuration of panel assembly 180. For example, the panel members 150 and first and second end plates 182, 184 may be assembled to create a building structure having any desired number of stories. Moreover, the first and second end plates 182, 184 be connected end-to-end to form any desired length of structure.

FIG. 25N depicts an alternative embodiment of an end plate, which is configured to constitute a corner of the panel assembly and building structure. Specifically, a corner end plate 185 is configured to engage the first and second end plates 182, 184 and the panel members 150, as necessary, to form the desired corners, right-angled or otherwise, in the panel assembly 180. In some instances, the panel members 150 that meet at such corners may be separated from each other, but in other instances, they may be connected, or even unitary. For example, as illustrated in FIG. 25N, each of those panel members 150 located at the corners of the building structure, is configured and expanded to traverse the 90 degree angle, thus providing the structure for its corner. Specifically, each corner panel member 150 may accommodate a corner by being expanded in opposite directions on either side of the leg closest to the corner. In some cases, expanding a panel member 150 at a corner may result in increased bending, compression, and/or torsional forces.

FIG. 25O depicts a panel assembly 180 having a plurality of spacer plates 183 disposed across the panel members 150 between the first end plates and second end plates of each panel member 150. As depicted in greater detail in FIG. 25P, each spacer plate 183 preferably includes a plurality of spaced apart slots 187, which are configured to accept the legs of the panel members 150 when they are in their expanded, or bowed outward, positions. The spacer plates 183 may, therefore, be configured to prevent the over-expansion of the panel members. Such over-expansion may occur during heavy loading resulting from natural disasters or other extraordinary loading conditions, and may result in undesirable permanent deformation or failure of the panel members 150. Accordingly, the spacer plates 183 may provide additional support and stability to the panel assembly 180. FIG. 25Q depicts the panel assembly 180 being in its expanded and assembled configuration, and being supported by a plurality of spacer plates 183.

Finally, FIGS. 25R-T depict the panel assembly 180 being affixed with sheathing 190. Specifically, with reference to FIG. 25S, the resilient clips 192 are configured to engage corresponding apertures in the sheathing 190 so as to fixedly support the sheathing 190 from the support structure of the panel assembly. FIG. 25T partially depicts an embodiment of the fully assembled panel assembly 180 having sheathing 190. The size and shape of each member of sheathing 190 may depend on the various design needs and functionality of each panel assembly. Likewise, the location of the apertures for affixing the sheathing to the panel assembly may vary from the particular arrangement illustrated herein. Of course, the panel assembly 180 of FIG. 25T may be accomplished by the use of these or other related or similar methods. Likewise, the particular exemplary methods recited herein may result in a number of possible panel assemblies other than the panel assembly 180 depicted in FIG. 25T.

Upon consideration of the expandable panel embodiments recited herein, it will be understood by one of skill in the art that any of the disclosed expandable panels, and not just the panel member 150 of FIG. 16A, may be incorporated into a multi-tiered building structure consistent with the present invention. That is, any combination of panel members, support structures, and connectors may be implemented to arrive at a desired building structure.

Other embodiments of the invention will be apparent to those skilled in the art from consideration of the specification and practice of the invention disclosed herein. It is intended that the specification and examples be considered as exemplary only, with a true spirit and scope of the invention being indicated by the following claims. Thus, it should be understood that the invention is not limited to the illustrative examples in this specification. Rather, the invention is intended to cover all modifications and variations that come within the scope of the following claims and their equivalents.

What is claimed is:

1. A panel assembly comprising:

a plate configured to move between a nonexpanded position, wherein the plate forms a substantially flat shape, and an expanded position, wherein portions of the sheet of material undergo torsion;

a first side segment formed in the plate and having an outer leg and an inner leg configured to allow the first side segment to bow when the plate moves from the nonexpanded position to the expanded position;

a second side segment formed in the plate and having an outer leg and an inner leg configured to allow the second side segment to bow when the plate moves from the nonexpanded position to the expanded position; and an inner segment formed in the plate and having a first leg and a second leg configured to allow the inner segment to bow when the plate moves from the nonexpanded position to the expanded position.

2. The panel assembly of claim 1, wherein each of the first side segment, second side segment, and inner segment includes at least one first end joint and at least one second end joint; and both legs of each segment are joined to each other at one of their ends by a respective one of the first and second end joints.

3. The panel assembly of claim 2, wherein the first end joints and second end joints are subjected to one or more of bending, compression, and torsion when the plate is in an expanded position.

4. The panel assembly of claim 2, wherein each of the first end joints includes a first tab protruding therefrom and configured to engage a corresponding aperture in a securing device.

5. The panel assembly of claim 1, further comprising a securing device configured to connect to the plate and maintain the plate in the expanded position.

6. The panel assembly of claim 1, wherein each of the legs includes at least part of a first panel surface and at least part of a second panel surface, wherein the first panel surface substantially faces the adjacent second panel surface when the plate is in the nonexpanded position, and the first panel surface is spaced apart from the second panel surface when the plate is in the expanded position.

7. The panel assembly of claim 6, wherein the first panel surface and the second panel surface are each subjected to one or more of bending, compression, and torsion when the plate is in the expanded position.

8. The panel assembly of claim 7, wherein the first and second panel surfaces define front and rear planes, respectively, which are configured to support sheathing on opposite sides of the panel assembly when the plate is in the expanded position.

9. The panel assembly of claim 8, further comprising sheathing mounted to the front and rear planes of the sheet of material.

10. A method of forming a structure comprising:

providing a panel member having a substantially planar portion having front and rear surfaces, right and left side edges, and first and second distal ends;

forming a plurality of spaced substantially parallel apertures through the panel portion from the front surface to the rear surface so as to define a pattern of legs, a pattern of tabs, and a pair of first and second panel surfaces facing each other;

providing a support structure including a first end plate and a second end plate, each having a plurality of spaced apart apertures;

pulling the panel member in opposite directions by the right and left side edges, thereby spreading apart the panel member along each cut, with the panel surface between the cuts bending apart to define front and rear planes; and securing the panel member in its expanded position.

11. The method of claim 10, further comprising:

inserting the tabs of the panel member into corresponding apertures of the support structure; and connecting a plurality of the panel members together by inserting the tabs of a first panel member into apertures of the support structure which correspond to tabs of a second panel member.

12. The method of claim 11, wherein connection together of the panel members forms a multi-tiered panel assembly.

13. The method of claim 11, further comprising connecting a plurality of the support structures together by inserting a first set of tabs of the panel member into a first support structure and inserting a second set of tabs of the panel member into a second support structure.

14. The method of claim 13, wherein connection together of the plurality of support structures forms a multi-tiered panel assembly.

15. The method of claim 11, further comprising connecting a plurality of the support structures together by:

connecting a first end plate associated with a first panel member to a first end plate associated with a second panel member; and connecting a second end plate associated with the first panel member to a second end plate associated with the second panel member.

16. The method of claim 15, wherein connection together of the first and second end plates with the first panel member forms a multi-tiered panel assembly.

17. The method of claim 11, further comprising:

affixing sheathing adjacent to at least one of the front and rear planes of the panel member, by hanging sheathing from one or more of the first and second panel surfaces.

18. A building structure comprising:

a panel member having a pattern of cuts, a pattern of legs, and a pattern of tabs configured to move the panel member between a nonexpanded position, wherein the panel member forms a substantially flat shape, and an expanded position, wherein portions of the panel member are substantially twisted; and a support structure configured to accept at least one of the pattern of tabs of the panel member and maintain the panel member in the expanded positioned; and a first side segment formed in the plate and having an outer leg and an inner leg configured to allow the first side segment to bow when the plate moves from the nonexpanded position to the expanded position; a second side segment formed in the plate and having an outer leg and an inner leg configured to allow the second side segment to bow when the plate moves from the nonexpanded position to the expanded position; and an inner segment formed in the plate and having a first leg and a second leg configured to allow the inner segment to bow when the plate moves from the nonexpanded position to the expanded position.

19. The building structure of claim 18, wherein the support structure includes a pattern of apertures, each aperture configured to accept one of the pattern of tabs of the panel member so as to maintain the panel member in the expanded position.

20. The building structure of claim 19, wherein the panel member includes a first surface and a second surface; the panel member is configured to move between the nonexpanded position, wherein the first and second surfaces of the panel member face one another and are adjacent to one another, and the expanded position, wherein the first and second surfaces of the panel member are spaced apart from one another; and wherein the pattern of tabs is configured to engage the apertures of the support structure when the first and second surfaces of the panel member are spaced apart from each other.

* * * * *